US009890014B2

(12) United States Patent
Kobayashi et al.

(10) Patent No.: US 9,890,014 B2
(45) Date of Patent: Feb. 13, 2018

(54) MEDIUM CONVEYANCE DEVICE AND MEDIUM TRANSACTION DEVICE

(71) Applicant: Oki Electric Industry Co., Ltd., Tokyo (JP)

(72) Inventors: Ryuuji Kobayashi, Tokyo (JP); Akira Gotou, Tokyo (JP); Kenji Kadota, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/538,161

(22) PCT Filed: Oct. 20, 2015

(86) PCT No.: PCT/JP2015/079588
§ 371 (c)(1),
(2) Date: Jun. 20, 2017

(87) PCT Pub. No.: WO2016/117193
PCT Pub. Date: Jul. 28, 2016

(65) Prior Publication Data

US 2017/0341902 A1 Nov. 30, 2017

(30) Foreign Application Priority Data

Jan. 21, 2015 (JP) ..... 2015-009468

(51) Int. Cl.
*G09F 19/00* (2006.01)
*B65H 83/02* (2006.01)
(Continued)

(52) U.S. Cl.
CPC ..... *B65H 83/025* (2013.01); *G07D 13/00* (2013.01); *G07F 19/205* (2013.01)

(58) Field of Classification Search
CPC .... G07F 19/203; G07F 19/205; G07F 19/208; G09F 19/00; G07D 11/00
(Continued)

(56) References Cited

U.S. PATENT DOCUMENTS 5,611,288 A * 3/1997 Dallman ..... G07F 9/10 109/24.1
5,836,256 A * 11/1998 Senterfeit, Sr. ..... G07F 19/20 109/2
(Continued)

FOREIGN PATENT DOCUMENTS

JP H08-081102 A 3/1996
JP 2003-081203 A 3/2003
(Continued)

*Primary Examiner* — Seung Lee
(74) *Attorney, Agent, or Firm* — Rabin & Berdo, P.C.

(57) ABSTRACT

A medium conveyance device includes a placement body having a bundle conveyance face on which a medium bundle is conveyed. A Scott-Russell body includes an abutting portion that abuts the medium bundle. A movement section causes the Scott-Russell body to abut against the medium bundle and moves the Scott-Russell body along the bundle conveyance face in first or second directions, so as to move the medium bundle along the bundle conveyance face in the direction. The conveyance state switching section switches to a first state in which the Scott-Russell body is caused to abut against a second direction side of the medium bundle and conveyance of the medium bundle toward the first direction is enabled, or to a second state in which the Scott-Russell body is caused to abut against a first direction side of the medium bundle and conveyance of the medium bundle toward the second direction is enabled.

20 Claims, 28 Drawing Sheets

(51) Int. Cl.
*G07D 13/00* (2006.01)
*G07F 19/00* (2006.01)

(58) Field of Classification Search
USPC ..... 235/379
See application file for complete search history.

(56) References Cited

U.S. PATENT DOCUMENTS

| | | | | |
|---|---|---|---|---|
| 6,457,277 | B1 * | 10/2002 | Meyers | G07F 19/20 109/24.1 |
| 8,974,167 | B2 * | 3/2015 | Ito | H01L 21/67769 414/217 |
| 2011/0141448 | A1 * | 6/2011 | Aoki | B65G 49/064 355/72 |

FOREIGN PATENT DOCUMENTS

| | | | |
|---|---|---|---|
| JP | 2004-083256 | A | 3/2004 |
| JP | 2009-208829 | A | 9/2009 |
| JP | 5141477 | B2 | 2/2013 |

* cited by examiner

MEDIUM CONVEYANCE DEVICE AND MEDIUM TRANSACTION DEVICE

TECHNICAL FIELD

The present disclosure relates to a medium conveyance device and a medium transaction device, well-suited for application to, for example, a banknote pay-out device that pays out banknotes serving as a medium.

BACKGROUND ART

Hitherto, banknote pay-out devices that pay out cash such as banknotes or coins in response to a request by a user are widely employed in financial institutions and the like.

Proposals exist for banknote pay-out devices including, for example, a banknote storage box that store banknotes, a stacking section that stacks banknotes conveyed from the banknote storage boxes into banknote bundles, a bundle conveyance section that conveys the banknote bundles, and a pay-out port that hands over the banknotes to a user. See, for example, Japanese Patent No. 4094242 (in particular, FIG. 1).

SUMMARY OF INVENTION

Technical Problem

In bundle conveyance units of such a configuration, upper and lower conveyor belts are disposed so as to sandwich a bundle conveyance path conveying banknote bundles, from above and below. The conveyor belts are run in both directions. The bundle conveyance unit thereby sandwiches a stacked banknote bundle from above and below and conveys the banknote bundle along the conveyance path toward the front or toward the rear while maintaining the stacked state. The bundle conveyance unit also transports a banknote bundle stacked in a stacking section up to the bundle conveyance path by moving a lower side conveyor belt in the vertical direction.

However, generally, when moving conveyor belts, a motive power source (for example a motor) for driving a belt section, a drive force transmission mechanism, and the like are also moved as a single unit, resulting in a comparatively heavy weight. Accordingly, in related technology, the mechanism for moving the conveyor belts becomes substantial, and the configuration becomes more complicated.

In consideration of the above circumstances, the present disclosure proposes a medium conveyance device and a medium transaction device capable of conveying a stacked medium by a simple configuration.

Solution to Problem

A medium conveyance device of a first aspect of the present disclosure includes a placement body including a bundle conveyance face on which a medium bundle configured by stacking plural medium into a bundle shape is conveyed in a state placed on the bundle conveyance face, and a Scott-Russell body including an abutting portion that abuts the medium bundle. Such a medium conveyance device also includes a moving section that causes at least a portion of the Scott-Russell body to abut against the medium bundle and that moves the Scott-Russell body in a first direction along the bundle conveyance face, or in a second direction opposite to the first direction, so as to move the medium bundle along the bundle conveyance face in the first direction or in the second direction. Such a medium conveyance device also includes a conveyance state switching section that switches to a first conveyance state or a second conveyance state in a case in which the Scott-Russell body is moved by the movement section, the first conveyance state in which at least a portion of the Scott-Russell body is caused to abut against the second direction side of the medium bundle and conveyance of the medium bundle toward the first direction is enabled, the second conveyance state in which at least a portion of the Scott-Russell body is caused to abut against the first direction side of the medium bundle and conveyance of the medium bundle toward the second direction is enabled.

A second aspect of the present disclosure is the first aspect, wherein the conveyance state switching section further includes a retract-and-return section that retracts the Scott-Russell body from a bundle conveyance path through which the medium bundle passes as it moves along the bundle conveyance face, or returns a portion of the Scott-Russell body to within the bundle conveyance path by utilizing a force of the movement section to move the Scott-Russell body. The conveyance state switching section also includes a relative position switching section that in a retracted state of the Scott-Russell body from the bundle conveyance path switches a position of the Scott-Russell body relative to the medium bundle to the first direction side or to the second direction side.

A third aspect of the present disclosure is the second aspect, wherein the retract-and-return section includes a post that is provided to the Scott-Russell body, and a slide groove that lets the post slide accompanying movement of the Scott-Russell body by the movement section. The slide groove is formed with a shape following the bundle conveyance face in a movement region in which the medium bundle is moved by the Scott-Russell body, and is formed along a direction intersecting the first direction or the second direction in a retraction region where the Scott-Russell body is retracted from the bundle conveyance path.

A fourth aspect of the present disclosure is the third aspect, wherein when in an orientation for moving the medium bundle the Scott-Russell body positions the post further to the first direction side or further to the second direction side than a swing shaft about which the Scott-Russell body swings.

A fifth aspect of the present disclosure is the fourth aspect, wherein within the retraction region the slide groove includes a pull-back region in which the post is pulled back further from the swing shaft in a direction intersecting the bundle conveyance face than in the movement region.

A sixth aspect of the present disclosure is the third aspect, wherein in the retraction region the Scott-Russell body retracts from the bundle conveyance path by transitioning to an orientation different from an orientation of the Scott-Russell body when in the movement region.

A seventh aspect of the present disclosure is the sixth aspect, wherein the slide groove forms a circuit path including the retraction region, and is provided with a switch to switch a direction of progress of the post at connection portion to the movement region.

An eighth aspect of the present disclosure is the third aspect, wherein in the Scott-Russell body the abutting portion is disposed on the opposite of the post, with respect to a swing shaft about which the Scott-Russell body swings. With respect to the movement region, the retraction region is formed running toward the opposite direction to a direction in which the abutting portion is pulled back from the bundle conveyance face.

A ninth aspect of the present disclosure is the second aspect, wherein the relative position switching section moves the medium bundle toward the first direction or toward the second direction of the Scott-Russell body.

A tenth aspect of the present disclosure is the ninth aspect, wherein the relative position switching section is provided on the first direction side of the placement body, and is configured by a placement conveyor belt that conveys the medium bundle toward the first direction or toward the second direction.

An eleventh aspect of the present disclosure is the second aspect, wherein the relative position switching section moves the Scott-Russell body to the first direction side or to the second direction side of the medium bundle.

A twelfth aspect of the present disclosure is the eleventh aspect, wherein the retract-and-return section includes a post that is provided to the Scott-Russell body, and a slide groove that lets the post slide accompanying movement of the Scott-Russell body by the movement section. The slide groove is formed with a shape following the bundle conveyance face in a movement region in which the medium bundle is moved by the Scott-Russell body, and is formed with a region that moves the post toward the first direction or toward the second direction in a retraction region where the Scott-Russell body is retracted from the bundle conveyance path.

A thirteenth aspect of the present disclosure is the first aspect, wherein the bundle conveyance face of the placement body includes a groove formed running in the first direction or in the second direction and the Scott-Russell body includes a claw-shaped portion. When the medium bundle is being moved along the bundle conveyance face in the first direction or the second direction, the claw-shaped portion extends toward the placement body from an abutting area abutting the medium bundle so as to be positioned inside the groove.

A fourteenth aspect of the present disclosure is the first aspect, further including an opposing conveyor belt that runs along an opposing face opposing the bundle conveyance face, and that conveys the medium bundle sandwiched between the bundle conveyance face and the opposing conveyor belt.

A fifteenth aspect of the present disclosure is the first aspect, wherein the Scott-Russell body includes a first abutting portion that abuts the medium bundle if the Scott-Russell body has approached the bundle conveyance face on the first direction side of the medium bundle, a second abutting portion that abuts the medium bundle if the Scott-Russell body has approached the bundle conveyance face on the second direction side of the medium bundle, a coupling portion that couples the first abutting portion and the second abutting portion together, and a swing section that swings the coupling portion, the first abutting portion, and the second abutting portion further away from the bundle conveyance face than the medium bundle. The conveyance state switching section causes either the first abutting portion or the second abutting portion to approach the bundle conveyance face, and causes the other of the first abutting portion or the second abutting portion to be distanced further from the bundle conveyance face, by utilizing force of the movement section to move the Scott-Russell body so as to swing the Scott-Russell body about the swing section.

A sixteenth aspect of the present disclosure is the fifteenth aspect, wherein the conveyance state switching section includes a guide face along the first direction or the second direction, the Scott-Russell body includes a contact portion that contacts the guide face during movement of the Scott-Russell body in the first direction or the second direction, and the conveyance state switching section switches the Scott-Russell body to either the first conveyance state or the second conveyance state by switching a direction of progress of the Scott-Russell body.

A seventeenth aspect of the present disclosure is the sixteenth aspect, wherein the guide face is formed at one or more locations with a cavity that is a greater distance from the bundle conveyance face than the periphery of the cavity. The contact portion is configured such that in an orientation of the Scott-Russell body in which both the first abutting portion and the second abutting portion are pulled back from the bundle conveyance face a portion of the contact portion reaches inside the cavity, and when the contact portion abuts the guide face at a location other than the cavity, either the first abutting portion or the second abutting portion is caused to approach the bundle conveyance face, and the other out of the first abutting portion or the second abutting portion is distanced further from the bundle conveyance face.

An eighteenth aspect of the present disclosure is the seventeenth aspect, wherein the contact portion is configured by a rotatable roller, and the guide face is provided at one or more locations with a recess that increases the distance from the Scott-Russell body. When the direction of progress of the Scott-Russell body is switched, the guide face causes the roller to temporarily engage with the recess so as to switch the Scott-Russell body to the first conveyance state or to the second conveyance state.

A nineteenth aspect of the present disclosure is the seventeenth aspect, wherein the contact portion is capable of elastic deformation toward the opposite side to the direction of progress of the Scott-Russell body, and the guide face includes plural of the cavities disposed along the first direction or the second direction. After the direction of progress of the Scott-Russell body has been switched, the guide face causes the contact portion to temporarily abut a side edge of one of the cavities so as to swing the Scott-Russell body and switch the Scott-Russell body to the first conveyance state or to the second conveyance state.

A medium conveyance device of a twentieth aspect of the present disclosure includes a stacking section that creates a medium bundle by stacking plural medium to be transacted into a bundle shape, a placement body including a bundle conveyance face on which the medium bundle is conveyed in a state placed on the bundle conveyance face, and a Scott-Russell body including an abutting portion that abuts the medium bundle. Such a medium conveyance device also includes a moving section that causes at least a portion of the Scott-Russell body to abut against the medium bundle and that moves the Scott-Russell body along the bundle conveyance face in a first direction, or in a second direction opposite to the first direction, so as to move the medium bundle along the bundle conveyance face in the first direction or in the second direction. Such a medium conveyance device also includes a conveyance state switching section that switches to a first conveyance state or a second conveyance state in a case in which the Scott-Russell body is moved by the movement section, the first conveyance state in which at least a portion of the Scott-Russell body is caused to abut against the second direction side of the medium bundle and conveyance of the medium bundle toward the first direction is enabled, the second conveyance state in which at least a portion of the Scott-Russell body is caused to abut against the first direction side of the medium bundle and conveyance of the medium bundle toward the second direction is enabled.

The present disclosure enables the medium bundle on a bundle conveyance face of the placement body to be conveyed by the Scott-Russell body in both the first direction and the second direction, and utilizes the force applied by the movement section in order to switch the Scott-Russell body to the first conveyance state or to the second conveyance state. Accordingly, the present disclosure does not need to provide a motive power source to the Scott-Russell body to generate motive power, enabling the Scott-Russell body to be configured more simply and lighter, and accordingly enabling the movement section to also be configured more simply.

Advantageous Effects of Invention

According to the present disclosure, a medium conveyance device and a medium transaction device capable of conveying a stacked medium can be realized with a simple configuration.

DESCRIPTION OF EMBODIMENTS

Explanation follows regarding exemplary embodiments of the present disclosure, with reference to the drawings.

1. First Exemplary Embodiment 1-1. Banknote Pay-Out Device Configuration

Figure 1:
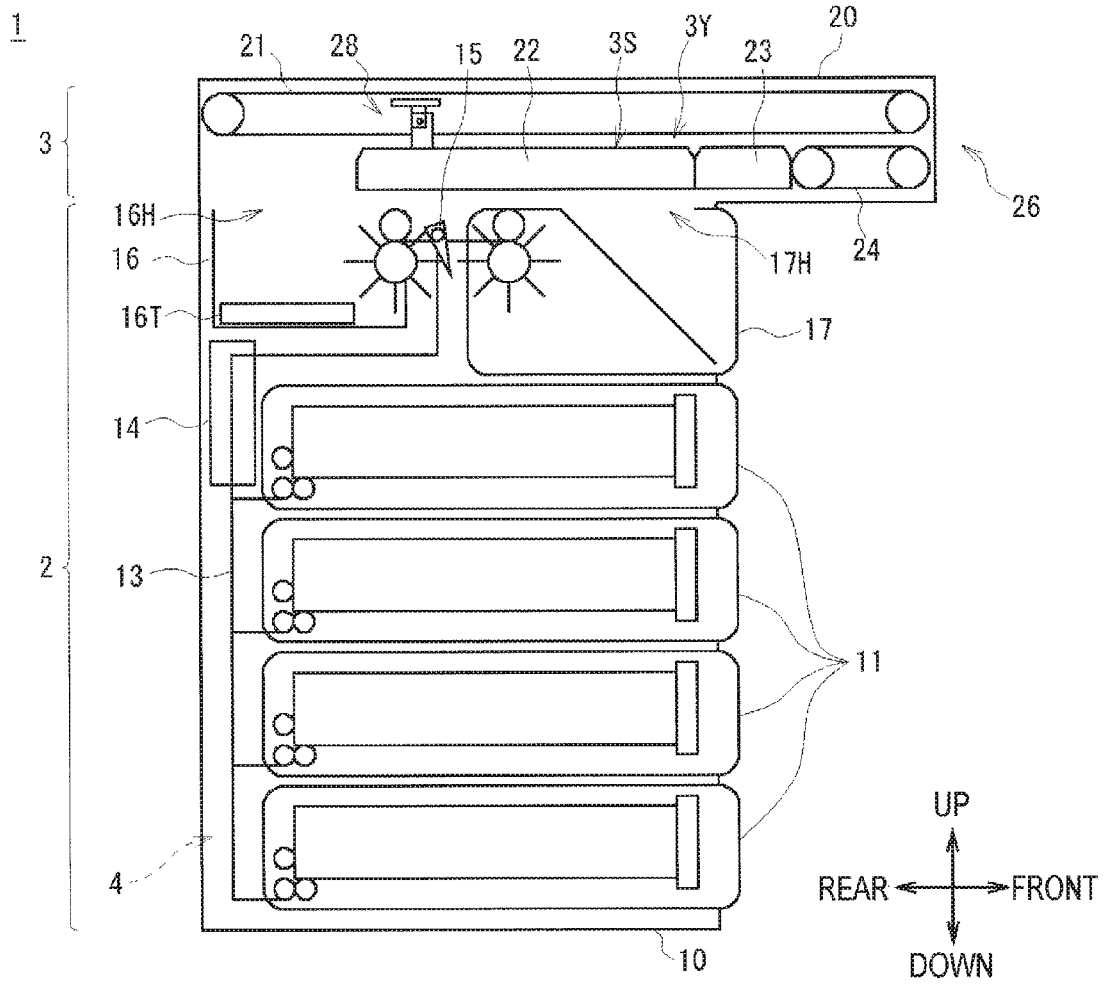
FIG. 1 is a schematic diagram illustrating an overall configuration of a banknote pay-out device.

As illustrated in schematic side view in FIG. 1, a banknote pay-out device 1 according to a first exemplary embodiment is what is referred to as a cash dispenser, for installation in financial institutions, various commercial premises, or the like. The banknote pay-out device 1 pays out banknotes in response to operation by a user (namely a customer or the like of the financial institution or the commercial premises). The banknote pay-out device 1 has a configuration broadly divided into a storage unit 2 on a lower side, and a bundle conveyance unit 3 on an upper side, and incorporates a controller 4 that controls the overall banknote pay-out device 1.

The controller 4 is configured around a Central Processing Unit (CPU), not illustrated in the drawings, and performs processing such as pay-out processing by reading and executing a predetermined program from Read Only Memory (ROM), flash memory, or the like, not illustrated in the drawings. The controller 4 also includes an internal storage section configured by Random Access Memory (RAM), a hard disk drive, flash memory, or the like, and stores various information in the storage section.

In the following explanation, the side of the banknote pay-out device 1 faced by a user is defined as the front side, and the opposite side thereto is defined as the rear side. The left side and the right side left are respectively defined by the left and right from the perspective of a user facing the front side, and the upper side and lower side are also defined from the perspective of a user facing the front side.

In the storage unit 2, plural sections that perform various processing relating to banknotes are incorporated inside a rectangular block shaped storage casing 10. Four banknote storage boxes 11, a conveyance section 13, a classification section 14, a switching section 15, a stacking section 16, and a reject storage box 17 are provided inside the storage casing 10.

The banknote storage boxes 11 are attached one on top of the other from the vertical direction central position toward the lower side at the front side of the storage casing 10, and are respectively stored with banknotes of a predetermined denomination. A feed-out section is provided at a rear side lower portion of each banknote storage box 11, to separate and feed out stored banknotes one note at a time.

The conveyance section 13 configures a conveyance path, this being a path along which banknotes are conveyed, from rollers, belts, and a motor or the like that drives them, not illustrated in the drawings. As shown by solid lines in the drawings, the conveyance path is connected to the feed-out section of each banknote storage box 11, and is disposed so as to advance along the vertical direction at the rear side of the respective banknote storage boxes 11 before reaching the vicinity of a front-rear direction central position at the upper side of the banknote storage box 11 at the uppermost position. The conveyance section 13 moves banknotes fed out from the feed-out sections of the respective banknote storage box 11 substantially upward.

The classification section 14 is provided along the conveyance path of the conveyance section 13, at the rear side of the banknote storage box 11 positioned at the uppermost side. Plural sensors of various types, such as a thickness sensor and an image sensor, are incorporated inside the classification section 14. The classification section 14 classifies the denomination, travel state, and so on of conveyed banknotes based on information obtained from the respective sensors, and supplies the classification results to the controller 4. The controller 4 determines the conveyance destination of each banknote based on the acquired classification results. Specifically, the controller 4 determines the stacking section 16 to be the conveyance destination for normal banknotes that are suitable for pay-out, and determines the reject storage box 17 to be the conveyance destination for banknotes that are unsuitable for pay-out (referred to below as reject banknotes).

The switching section 15 is disposed substantially at the front-rear direction center at the upper side of the uppermost banknote storage box 11. Under the control of the controller 4, the switching section 15 switches the banknote direction of progress by changing an angle of inclination of a blade (illustrated in a triangular shape in the drawings) that contacts banknotes so as to change their direction of travel. The switching section 15 is connected through the conveyance section 13 to the classification section 14 at the lower side, the stacking section 16 at the rear side, and the reject storage box 17 at the front side. The switching section 15 switches the direction of travel of the respective banknotes conveyed from below according to the conveyance destination determined by the controller 4, and moves the banknotes to the stacking section 16 at the rear side or the reject storage box 17 at the front side.

The stacking section 16 is positioned at the rear side of an uppermost side inside the storage casing 10. A stacking space 16S in which banknotes are stacked is formed inside the stacking section 16. The stacking section 16 includes a stage 16T, on an upper face of which banknotes are stacked, inside the stacking space 16S.

A discharge section 16R for discharging banknotes conveyed from the switching section 15 into the stacking space 16S is provided toward the top of the front side of the stacking section 16. The stacking section 16 is thereby capable of stacking banknotes conveyed from the switching section 15 and discharged into the stacking space 16S by the discharge section 16R on the stage 16T. Banknotes stacked on the stage 16T in this manner are piled up in the form of a bundle. Accordingly the banknotes piled up in this manner are therefore also referred to below as a banknote bundle SB. Note that the banknote bundle SB is not wrapped with a paper band or the like, and the banknote bundle SB is simply a pile of stacked banknotes, so there is a possibility of the banknote bundle W collapsing if unintentionally applied with external force.

The stage 16T can also be moved in an vertical direction by a stage moving mechanism, not illustrated in the drawings. An upper face of the stacking section 16 is provided with a stacking hole 16H penetrating in the vertical direction over a range corresponding to the stacking space 16S. The stacking hole 16H also penetrates an upper face of the storage casing 10, and places the stacking space 16S in communication with a space further toward the upper side than the storage casing 10. The stacking section 16 is thereby capable of lifting the stage 16T and the stacked bundle of banknotes (banknote bundle SB) further toward the upper side than the upper face of the storage casing 10, namely to inside the bundle conveyance unit 3, by moving the stage 16T upward in a state in which banknotes have been stacked on the stage 16T.

The reject storage box 17 is positioned at the front side of the uppermost side inside the storage casing 10, and forms a storage space 17S inside which banknotes are stored. A discharge section 17R that discharges banknotes conveyed by the switching section 15 into the storage space 17S is provided at the rear side and toward the top of the reject storage box 17. Accordingly, the reject storage box 17 is capable of storing banknotes (namely, reject banknotes) conveyed from the switching section 15 and discharged into the storage space 17S by the discharge section 17R.

An intake hole 17H is provided penetrating an upper face of the reject storage box 17 in the vertical direction over a range corresponding to the storage space 17S. The intake hole 17H also penetrates an upper face of the storage casing 10, thereby placing the storage space 17S in communication with a space further to the upper side than the storage casing 10. When a banknote has dropped down from the bundle conveyance unit 3 positioned above the reject storage box 17, the banknote can be stored inside the storage space 17S.

Similarly to the banknote storage boxes 11, the reject storage box 17 can be detached from the storage casing 10 by being pulled out toward the front with respect to the storage casing 10. The reject storage box 17 can also be mounted in the storage casing 10 by being positioned with respect to the storage casing 10 and being pushed toward the rear.

1-2. Bundle Conveyance Unit Configuration

The bundle conveyance unit 3 is formed overall in a flattened rectangular block shape that is short in the vertical direction and long in the front-rear direction. The front-rear direction length of the bundle conveyance unit 3 is longer than that of the storage unit 2. The bundle conveyance unit 3 forms a bundle conveyance path 3Y, this being a path along which a banknote bundle SB passes when conveying the banknote bundle SB, from various members incorporated inside a rectangular block shaped bundle conveyance casing 20. A front end of the bundle conveyance casing 20, namely a front end of the bundle conveyance path 3Y, is formed with a pay-out port 26 that hands over the banknote bundle SB to the user.

Note that respective sensors for detecting a banknote bundle SB are provided at plural locations along the bundle conveyance path 3Y, for example in the vicinity of the pay-out port 26. The sensors are configured by combinations of light emitting elements that emit a predetermined detection light, and light receiving elements that receive the detection light. Optical paths of the detection light intersect the bundle conveyance path 3Y, and the controller 4 is notified of light reception results for the detection light. The controller 4 is capable of determining whether or not a banknote bundle SB is present at each location along the bundle conveyance path 3Y based on the light reception results.

An upper conveyor belt 21 is provided at an upper side portion inside the bundle conveyance casing 20. The upper conveyor belt 21 is entrained around the peripheries of respective rollers disposed in the vicinity of a rear end and in the vicinity of a front end of the upper conveyor belt 21, and when the rollers are rotated by a predetermined motor (not illustrated in the drawings) under control of the controller 4, a lower face of the upper conveyor belt 21 travels along the front-rear direction. For ease of explanation, in the following explanation the direction of travel of the lower face portion of the upper conveyor belt 21 is taken as the direction of travel of the upper conveyor belt 21.

In sequence from the rear side, a moving conveyance guide 22, a fixed conveyance guide 23, and a lower conveyor belt 24 are provided inside the bundle conveyance casing 20 at a portion to the lower side of the upper conveyor belt 21, namely on the opposite side of the bundle conveyance path 3Y to the upper conveyor belt 21.

The moving conveyance guide 22 is formed in a flattened rectangular block shape or plate shape that is thin in the vertical direction. An upper face of the moving conveyance guide 22 faces or abuts a lower face of the upper conveyor belt 21. Note that the length of the moving conveyance guide 22 in the left-right direction is longer than the length of a long edge of a banknote. The moving conveyance guide 22 can be moved in the front-rear direction with respect to the bundle conveyance casing 20 by a moving mechanism, not illustrated in the drawings. When the moving conveyance guide 22 has moved to the front, the stacking hole 16H of the stacking section 16 is opened up, placing the stacking space 16S in communication with the bundle conveyance path 3Y. When the moving conveyance guide 22 has been moved to the rear, the intake hole 17H of the reject storage box 17 is opened up, placing the stacking space 16S in communication with the bundle conveyance path 3Y. The fixed conveyance guide 23 is formed in a plate shape that is thin in the vertical direction, similarly to the moving conveyance guide 22, and is fixed with respect to the bundle conveyance casing 20.

The lower conveyor belt 24 has a configuration similar to that of the upper conveyor belt 21, however, the lower conveyor belt 24 is shortened in the front-rear direction. An upper face portion of the lower conveyor belt 24 is aligned so as to be level with the upper face of the moving conveyance guide 22 and the fixed conveyance guide 23, and faces or abuts the lower face of the upper conveyor belt 21. Namely, the upper face of the lower conveyor belt 24 forms a lower face portion of the bundle conveyance path 3Y together with the upper faces of the moving conveyance guide 22 and the fixed conveyance guide 23. In the following explanation, the upper faces of the moving conveyance guide 22, the fixed conveyance guide 23, and the lower conveyor belt 24 are also referred to as a bundle conveyance face 3S. Moreover, the upper face of the lower conveyor belt 24 travels in the front-rear direction, similarly to the lower face of the upper conveyor belt 21. For ease of explanation, in the following explanation the direction of travel of the upper face portion of the lower conveyor belt 24 is taken as the direction of travel of the lower conveyor belt 24.

Moreover, the stage 16T of the stacking section 16 is moved upward in a state in which the moving conveyance guide 22 has been moved to the front (FIG. 1), to align the height of the upper face of the stage 16T so as to be substantially level with the bundle conveyance face 3S. The stage 16T accordingly forms part of the bundle conveyance path 3Y.

Figure 2A:
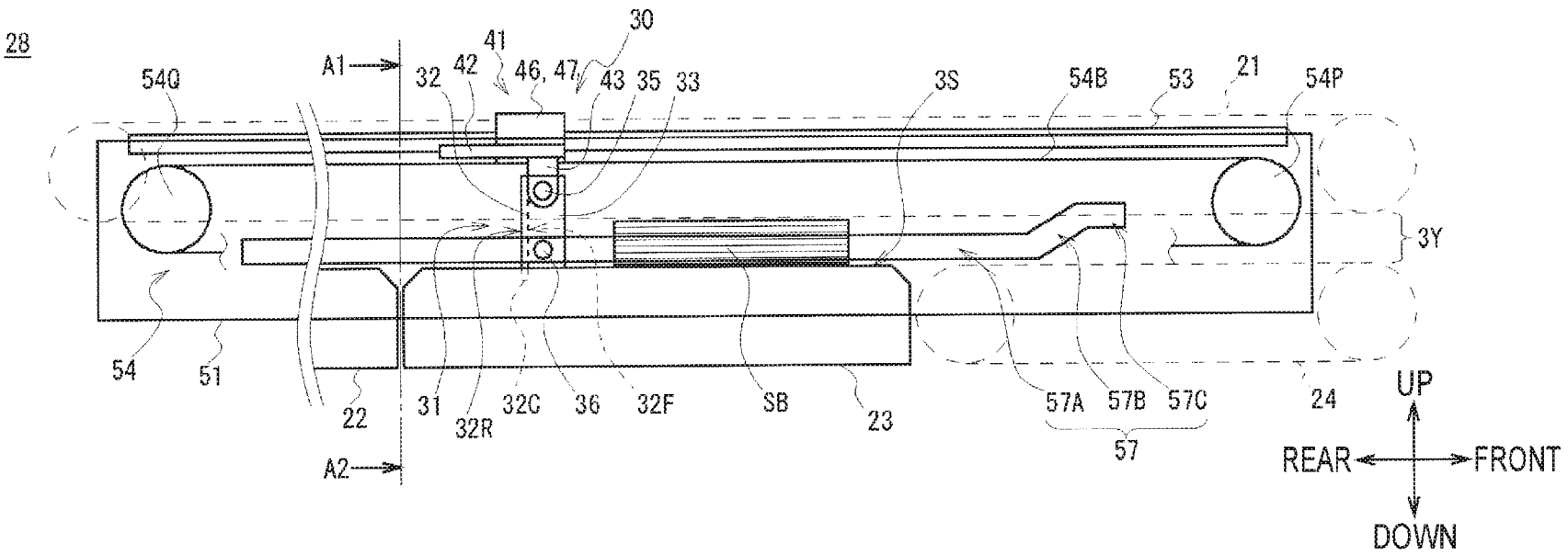
FIG. 2A is a schematic diagram illustrating configuration of a bundle conveyance unit according to a first exemplary embodiment.
Figure 2B:
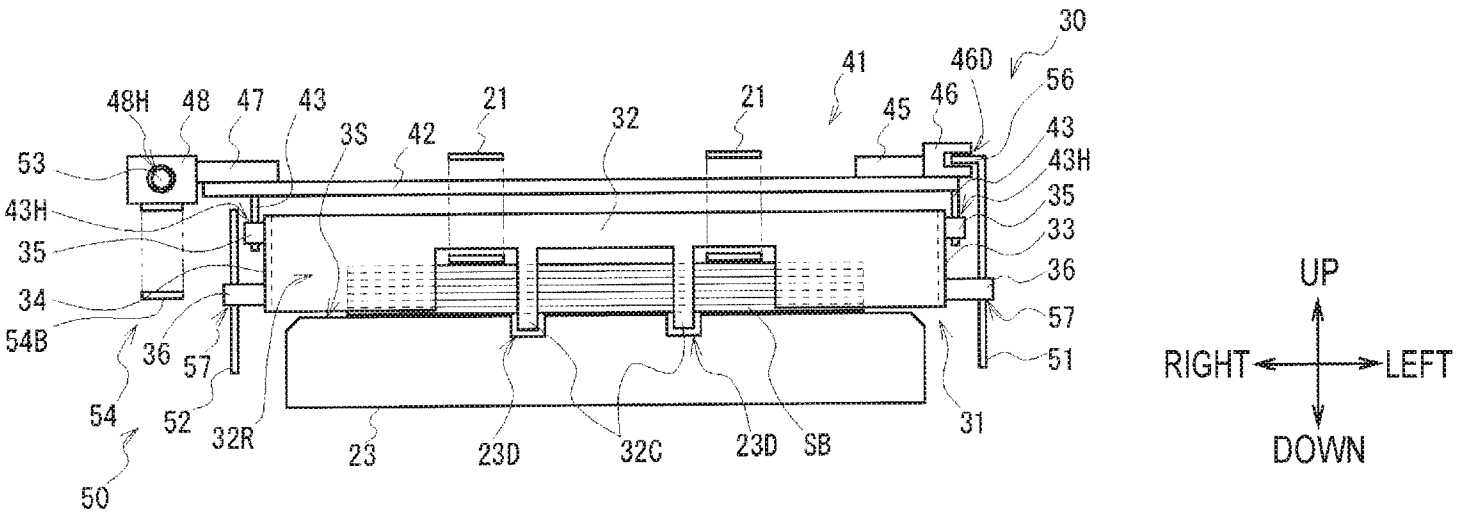
FIG. 2B is a schematic diagram illustrating configuration of a bundle conveyance unit according to the first exemplary embodiment.

In addition to the above configuration, a Scott-Russell mechanism 28 is provided inside the bundle conveyance unit 3. The Scott-Russell mechanism 28 moves a banknote bundle SB in the front-rear direction along the bundle conveyance face 3S, namely along the upper faces of the moving conveyance guide 22, the fixed conveyance guide 23, the lower conveyor belt 24, and the stage 16T. As illustrated in side view in FIG. 2A, and as illustrated in FIG. 2B, this being a cross-section taken along line Al-A2, the Scott-Russell mechanism 28 is configured by a Scott-Russell section 30 that abuts the banknote bundle SB and moves the banknote bundle SB in the front-rear direction, and a moving section 50 that moves the Scott-Russell section 30. Note that in FIG. 2A and FIG. 2B, the upper conveyor belt 21 and the lower conveyor belt 24 are illustrated by dashed lines, or with some components see-through, for ease of illustration.

1-2-1. Moving Section Configuration

Figure 3:
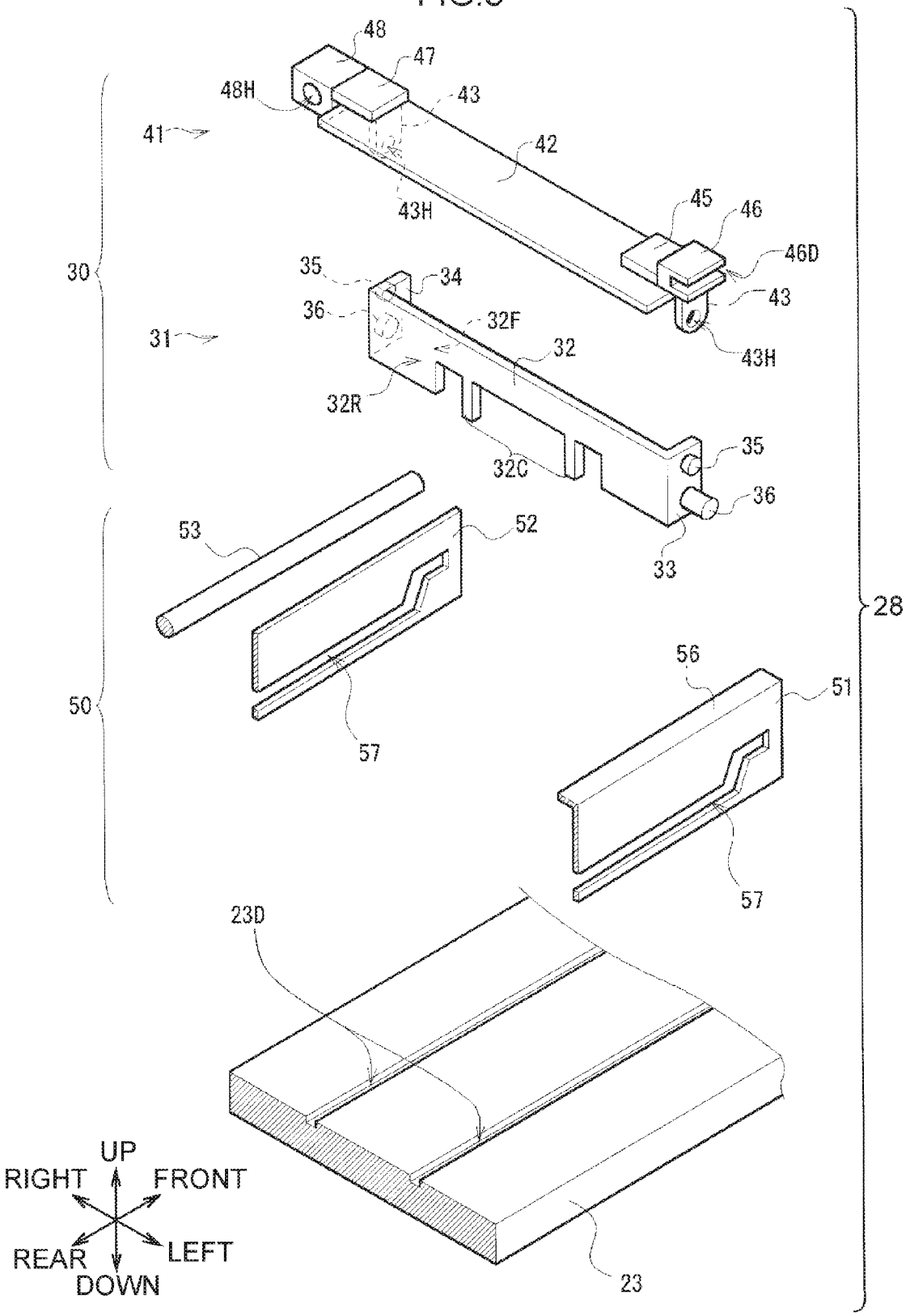
FIG. 3 is a schematic perspective view illustrating configuration of a Scott-Russell section and a moving section according to the first exemplary embodiment.

As illustrated in exploded perspective view in FIG. 3, the moving section 50 is configured by a left guide plate 51, a right guide plate 52, a slide shaft 53, and a drive belt section 54 (FIG. 2), as well as by a motor, gears, and the like, not illustrated in the drawings. The left guide plate 51 is formed in a plate shape that is thin in the left-right direction and long in the front-rear direction, and is fixed to the bundle conveyance casing 20 (FIG. 1) at a position in the vicinity of left edges of the moving conveyance guide 22, the fixed conveyance guide 23, and the like. A rail 56 extends out perpendicularly toward the right from an upper edge of the left guide plate 51. The rail 56 is formed in a straight line shape running along the front-rear direction, and has a short length in the left-right direction.

The left guide plate 51 is also provided with a slide groove 57 penetrating the left guide plate 51 in the left-right direction. As illustrated in FIG. 2A, the slide groove 57 is formed long and thin, and runs in the front-rear direction overall. The slide groove 57 has a substantially uniform length in the vertical direction, namely a substantially uniform groove width; however, the slide groove 57 is bent upward at a portion in the vicinity of a front end, thereby dividing the slide groove 57 into three regions of a movement region 57A, an inclined region 57B, and a separation region 57C.

The movement region 57A is formed in a straight line shape along the front-rear direction, and maintains a substantially uniform height from the bundle conveyance face 3S over its entire range. The separation region 57C is at a greater distance from the bundle conveyance face 3S, namely is disposed at a higher location than the movement region 57A, and has a shorter length in the front-rear direction than the movement region 57A. The inclined region 57B links a front end of the movement region 57A to a rear end of the separation region 57C, and is inclined so as to be higher at its front end and lower at its rear end.

The right guide plate 52 is formed in a plate shape that, similarly to the left guide plate 51, is thin in the left-right direction and long in the front-rear direction, and is fixed to the bundle conveyance casing 20 (FIG. 1) at a position in the vicinity of right edges of the moving conveyance guide 22, the fixed conveyance guide 23, and the like. The right guide plate 52 is formed substantially left-right symmetrical to the left guide plate 51, and is formed including a slide groove 57 and lacking the rail 56. The slide shaft 53 is formed in a long, thin, circular column shape with its center axis running in the front-rear direction, and is fixed to the bundle conveyance casing 20 (FIG. 1) at a position slightly to the right side of an upper edge of the right guide plate 52.

The drive belt section 54 (FIGS. 2) is positioned at the right side of the right guide plate 52 and below the slide shaft 53. The drive belt section 54 is configured by two pulleys 54P and 54Q respectively disposed in the vicinity of a front end and in the vicinity of a rear end inside the bundle conveyance casing 20, and a belt 54B entrained around the periphery of the pulleys 54P and 54Q. Drive force from a motor, not illustrated in the drawings, is transmitted to the pulley 54Q on the rear side through gears and the like, not illustrated in the drawings. Rotation and stopping, as well as the rotation speed, rotation direction, and the like of the motor are controlled under the control of the controller 4. The drive belt section 54 can therefore be run such that an upper side portion of the belt 54B runs toward the front, as a first direction, or toward the rear, as a second direction, by rotating the pulley 54Q in the clockwise direction or the counterclockwise direction in the drawings under the control of the controller 4.

1-2-2. Scott-Russell Section Configuration

The Scott-Russell section 30 (FIG. 3) is configured by a Scott-Russell body 31 that applies a pushing force to the banknote bundle SB, and a support body 41 that is positioned above the bundle conveyance path 3Y and that supports the Scott-Russell body 31.

The Scott-Russell body 31 is configured around a Scott-Russell plate 32. The Scott-Russell plate 32 is configured in a plate shape that is long in the left-right direction and thin in the front-rear direction, and is formed with a flat front face 32F and a flat rear face 32R. As illustrated in FIG. 2B, the length of the Scott-Russell plate 32 in the left-right direction is longer than the length of the moving conveyance guide 22 and the like in the left-right direction, and is narrow (shorter) than a separation between the left guide plate 51 and the right guide plate 52.

The Scott-Russell plate 32 is formed with plural notch shapes, cut in deeply from portions of the lower edge as far as the vicinity of the center of the Scott-Russell plate 32, in order to avoid interference between the Scott-Russell plate 32 and the upper conveyor belt 21. The Scott-Russell plate 32 is also formed with claw-shaped portions 32C projecting out further downwards than the lower edge of the Scott-Russell plate 32, at two locations between notch shapes. Respective claw-guide grooves 22D and 23D that are long and thin in the front-rear direction are formed at locations on the upper faces of the moving conveyance guide 22 and the fixed conveyance guide 23 at locations corresponding to the claw-shaped portions 32C.

A left side plate 33 and a right side plate 34 are provided perpendicularly toward the front side at both left and right ends of the Scott-Russell plate 32. The left side plate 33 and the right side plate 34 are plate shapes that are thin in the left-right direction, and have substantially the same length as the Scott-Russell plate 32 in the vertical direction; however, the left side plate 33 and the right side plate 34 have a very short length in the front-rear direction. A small circular column shaped swing shaft 35 projects out toward the left from a location toward the top of an outside face, namely a left side face, of the left side plate 33. Moreover, a post 36 that has a small circular column shape similar to the swing shaft 35 projects out toward the left below the swing shaft 35. The diameter of the post 36 is slightly smaller than the groove width of the slide groove 57 formed to the left guide plate 51. A swing shaft 35 and a post 36 also project out from a right side face of the right side plate 34 so as to be substantially left-right symmetrical to the left side face of the left side plate 33.

The support body 41 (FIG. 3) is configured around a base 42. The base 42 is formed in a plate shape that is long in the left-right direction and short in the vertical direction. Note that the base 42 is formed longer than the Scott-Russell plate 32 in the left-right direction. Swing support plates 43 project downward from the vicinity of a left end and from the vicinity of a right end of a lower face of the base 42.

The swing support plates 43 are formed in small plate shapes that are thin in the left-right direction and comparatively short in the front-rear direction and the vertical direction. The separation between the left and right swing support plates 43 is slightly greater than the length of the Scott-Russell plate 32 of the Scott-Russell body 31 in the left-right direction. Shaft holes 43H, configured as circular holes, are formed penetrating the swing support plates 43 in the left-right direction. The diameter of the shaft holes 43H is slightly larger than the diameter of the swing shafts 35 respectively provided to the left side plate 33 and the right side plate 34 of the Scott-Russell body 31.

In the Scott-Russell section 30, during assembly of the Scott-Russell body 31 to the support body 41, the left and right swing shafts 35 are inserted through the left and right shaft holes 43H respectively. The Scott-Russell body 31 is thereby capable of swinging about the swing shafts 35 with respect to the support body 41. For example, in the Scott-Russell section 30, the front face 32F of the Scott-Russell plate 32 is capable of facing forward, or forward and diagonally downward, by the Scott-Russell body 31 swinging.

A rail guide 46 is attached to the vicinity of a left end of the base 42 through an attachment member 45 attached to an upper face of the base 42. A straight line shaped rail groove 46D is formed running in the front-rear direction substantially at the vertical center of the left side face of the rail guide 46. The vertical direction height, namely the groove width, of the rail groove 46D is formed slightly larger than the vertical direction length, namely the thickness, of the rail 56 of the left guide plate 51.

A slide guide 48 is also attached to the vicinity of a right end of the base 42 through an attachment member 47 attached to the upper face of the base 42. A shaft hole 48H, configured by a circular hole, is formed penetrating the slide guide 48 in the front-rear direction. The diameter of the shaft hole 48H is slightly larger than the diameter of the slide shaft 53. A lower face of the slide guide 48 is fixed to an upper side portion of the belt 54B of the drive belt section 54.

According to this configuration, when assembling the support body 41 of the Scott-Russell section 30 to the bundle conveyance unit 3, the rail 56 is sandwiched from above and below by the rail groove 46D of the rail guide 46, the slide shaft 53 is inserted through the shaft hole 48H of the slide guide 48, and the lower face of the slide guide 48 is fixed to the upper side portion of the belt 54B of the drive belt section 54. Moreover, in the Scott-Russell body 31 of the Scott-Russell section 30, the left and right posts 36 are respectively inserted through the left and right slide grooves 57.

In this state, the moving section 50 drives the belt 54B of the drive belt section 54. When this is performed, the Scott-Russell section 30 can be moved in the front-rear direction as the rail guide 46 and the slide guide 48 slide against the rail 56 and the slide shaft 53 respectively, and the left and right posts 36 slide within the left and right slide grooves 57.

Note that as described above, the slide grooves 57 are divided into the three regions of the movement region 57A, the inclined region 57B, and the separation region 57C that have different heights to each other in the vertical direction. Accordingly, in the Scott-Russell section 30 the Scott-Russell body 31 can be swung following the posts 36 according to the height of each region of the slide grooves 57 (described in detail later).

In this manner, in the bundle conveyance unit 3, the Scott-Russell body 31 is swung according to the height of the slide grooves 57 as the moving section 50 moves the Scott-Russell section 30 in the front-rear direction along the upper faces of the moving conveyance guide 22 and the like.

1-3. Banknote Bundle Conveyance Operation

Next, explanation follows regarding a conveyance operation of the banknote bundle SB by the bundle conveyance unit 3. Note that the forthcoming explanation anticipates a state in which during pay-out processing by the banknote pay-out device 1, banknotes are stacked in the stacking section 16 to form a banknote bundle SB, and the banknote bundle SB is lifted into the bundle conveyance path 3Y of the bundle conveyance unit 3 by raising the stage 16T. In the bundle conveyance unit 3, the Scott-Russell section 30 is moved to the rearmost position in advance, namely is moved in advance to the rear side of the banknote bundle SB.

Figure 4A:
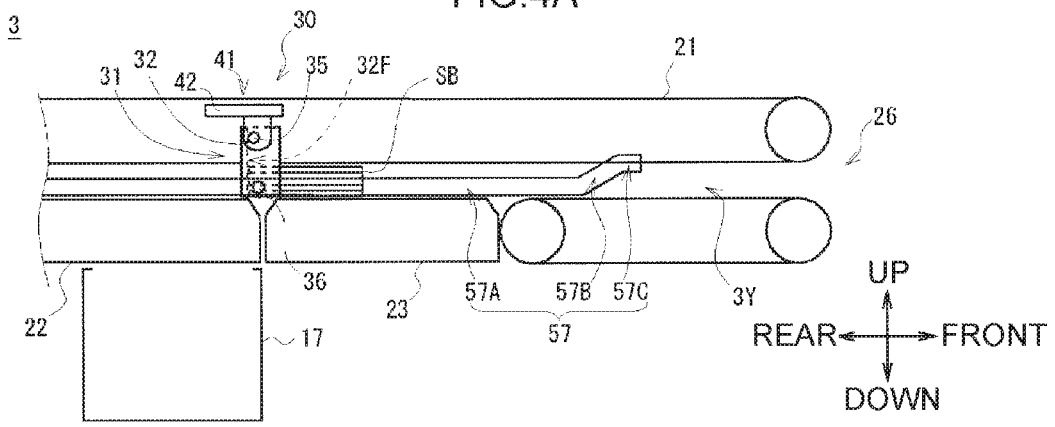
FIG. 4A is a schematic diagram illustrating a conveyance operation (1) of a banknote bundle according to the first exemplary embodiment.

First, the bundle conveyance unit 3 begins a pay-out conveyance operation under the control of the controller 4. When this is performed, as illustrated in FIG. 4A, the bundle conveyance unit 3 uses the moving section 50 to move the Scott-Russell section 30 toward the front, and drives the upper conveyor belt 21 and the lower conveyor belt 24 toward the front respectively. Note that in FIG. 4A, for ease of explanation, some components such as the slide shaft 53 and the drive belt section 54 are omitted from illustration, and lines showing the external profile of the left guide plate 51 etc. are also omitted.

At this point, the left and right posts 36 of the Scott-Russell body 31 of the Scott-Russell section 30 are in the movement regions 57A of the slide grooves 57 of the left guide plate 51 and the right guide plate 52, such that the front face 32F of the Scott-Russell plate 32 faces toward the front and a portion of the front face 32F is in a state abutting the banknote bundle SB. In the following explanation, such an orientation in which the Scott-Russell body 31 faces the front face 32F of the Scott-Russell plate 32 toward the front, and the Scott-Russell body 31 is capable of conveying the banknote bundle SB is referred to as the conveyance-enabled orientation.

Accordingly, in the bundle conveyance unit 3, a portion of the front face 32F of the Scott-Russell plate 32 abuts and applies a force toward the front to the rear side of the banknote bundle SB, moving the banknote bundle SB toward the front while sliding the banknote bundle SB across the upper face of the moving conveyance guide 22 and the fixed conveyance guide 23. In the following explanation, this state, in which the banknote bundle SB is positioned at the front side of the Scott-Russell body 31 in the conveyance-enabled orientation, and the banknote bundle SB can be conveyed toward the front, is referred to as the forward conveyance state.

Moreover, at this time, the claw-shaped portions 32C of the Scott-Russell plate 32 move toward the front in a state entering into the claw-guide grooves 22D of the moving conveyance guide 22 or the claw-guide grooves 23D of the fixed conveyance guide 23. Accordingly, the bundle conveyance unit 3 is capable of abutting the long edge positioned on the rear side of all of the banknotes contained in the banknote bundle SB, from an uppermost face to a lowermost face, with the front face 32F of the Scott-Russell plate 32, and applying force toward the front. This thereby enables the bundle conveyance unit 3 to move the banknote bundle SB stably along the bundle conveyance path 3Y toward the front, maintaining the banknote bundle SB in a stacked state without the banknote bundle SB collapsing.

Figure 4B:
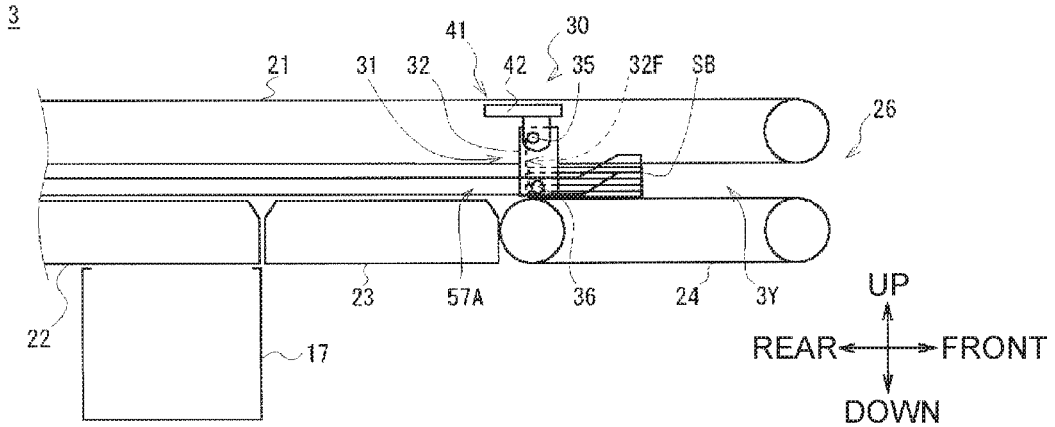
FIG. 4B is a schematic diagram illustrating a conveyance operation (1) of a banknote bundle according to the first exemplary embodiment.

As illustrated in FIG. 4B, when the vicinity of a leading edge of the banknote bundle SB has finally reached the upper face of the lower conveyor belt 24 in the bundle conveyance unit 3, the banknote bundle SB enters a state sandwiched between the lower face of the upper conveyor belt 21 and the upper face of the lower conveyor belt 24. When this occurs, the bundle conveyance unit 3 pauses movement of the Scott-Russell section 30 toward the front by the moving section 50. The banknote bundle SB is thereby separated from the Scott-Russell plate 32 of the Scott-Russell section 30, and is moved toward the front while remaining in the state sandwiched from above and below by the upper conveyor belt 21 and the lower conveyor belt 24 that are traveling toward the front.

Figure 4C:
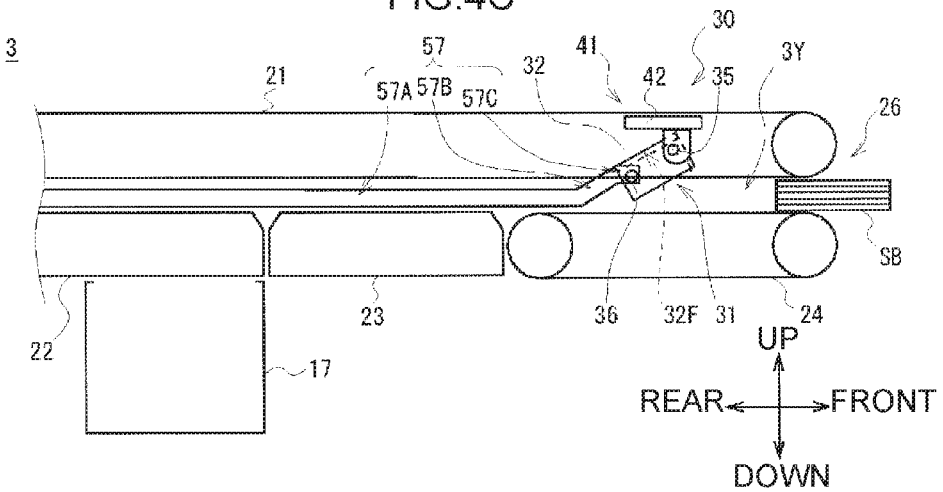
FIG. 4C is a schematic diagram illustrating a conveyance operation (1) of a banknote bundle according to the first exemplary embodiment.

The arrival of the banknote bundle SB at the pay-out port 26 is then detected by sensors, not illustrated in the drawings, and the bundle conveyance unit 3 stops the upper conveyor belt 21 and the lower conveyor belt 24 under the control of the controller 4. Accordingly, as illustrated in FIG. 4C, the bundle conveyance unit 3 grips the rear side of the banknote bundle SB between the upper conveyor belt 21 and the lower conveyor belt 24, and prompts the user to take the banknote bundle SB in a state in which the front side of the banknote bundle SB is exposed in the pay-out port 26.

Moreover, the bundle conveyance unit 3 uses the moving section 50 to recommence movement of the Scott-Russell section 30 toward the front. When this is performed, the support body 41 of the Scott-Russell section 30 moves toward the front along the slide shaft 53 and the rail 56 without any change in height. However, since the posts 36 of the Scott-Russell body 31 arrive at the inclined regions 57B of the slide grooves 57, the posts 36 gradually ascend along the inclined regions 57B, accompanying which the front face 32F of the Scott-Russell plate 32 gradually faces downward, namely swings in the clockwise direction in the drawings.

When the posts 36 finally arrive at the separation regions 57C of the slide grooves 57, the bundle conveyance unit 3 stops the movement of the Scott-Russell section 30 by the moving section 50. When this is performed, as illustrated in FIG. 4C, the Scott-Russell plate 32 is lifted further toward the upper side than the lower face of the upper conveyor belt 21, namely to the upper side of the bundle conveyance path 3Y, to adopt a completely retracted state with respect to the bundle conveyance path 3Y. In the following explanation, this orientation in which the front face 32F of the Scott-Russell plate 32 faces diagonally downward toward the front and the Scott-Russell body 31 is completely retracted from the bundle conveyance path 3Y is referred to as the retracted orientation. In other words, the inclined region 57B and the separation region 57C are regions for causing the Scott-Russell body 31 to transition to the retracted state. The inclined region 57B and the separation region 57C are therefore referred to collectively as the retraction region below. The pay-out conveyance operation is complete when the Scott-Russell body 31 of the bundle conveyance unit 3 has finished its transition to the retracted orientation.

Note that when a user forgets to take the banknote bundle SB, the banknote pay-out device 1 performs a take-in conveyance operation to take the banknote bundle SB back in. Specifically, the controller 4 uses a sensor 27 and the like to monitor whether or not the banknote bundle SB has been taken out in a state in which the front side of the banknote bundle SB is exposed in the pay-out port 26 as illustrated in FIG. 4C. If the controller 4 detects that the banknote bundle SB has not been taken out within a predetermined time (for example one minute), the banknote bundle SB take-in conveyance operation is initiated.

Figure 5A:
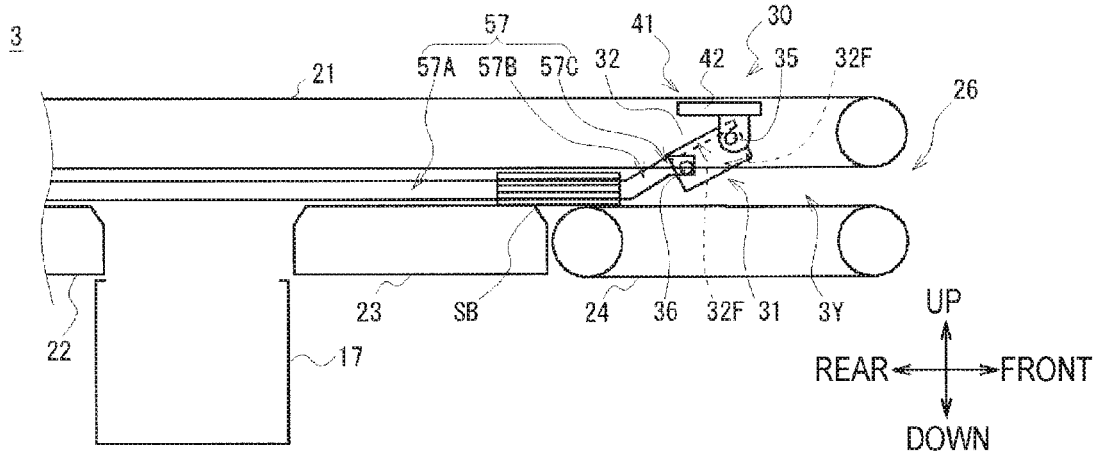
FIG. 5A is a schematic diagram illustrating a conveyance operation (2) of a banknote bundle according to the first exemplary embodiment.

Specifically, first, the bundle conveyance unit 3 moves the moving conveyance guide 22 toward the rear under the control of the controller 4, such that as illustrated in FIG. 5A, the intake hole 17H of the reject storage box 17 is placed in communication with the bundle conveyance path 3Y. Next, the bundle conveyance unit 3 drives the upper conveyor belt 21 and the lower conveyor belt 24 toward the rear respectively, moving the banknote bundle SB toward the rear, with the Scott-Russell section 30 remaining stationary, namely, with the Scott-Russell body 31 still in the retracted orientation. The banknote bundle SB thereby passes the lower side of the Scott-Russell plate 32 of the Scott-Russell body 31 that is in the retracted orientation, and reaches a position further to the rear side than the Scott-Russell plate 32.

When the bundle conveyance unit 3 detects the arrival of the front end of the banknote bundle SB in the vicinity of a rear end of the upper face of the lower conveyor belt 24 using sensors, not illustrated in the drawings, the bundle conveyance unit 3 pauses the upper conveyor belt 21 and the lower conveyor belt 24, such that the banknote bundle SB becomes stationary.

Figure 5B:
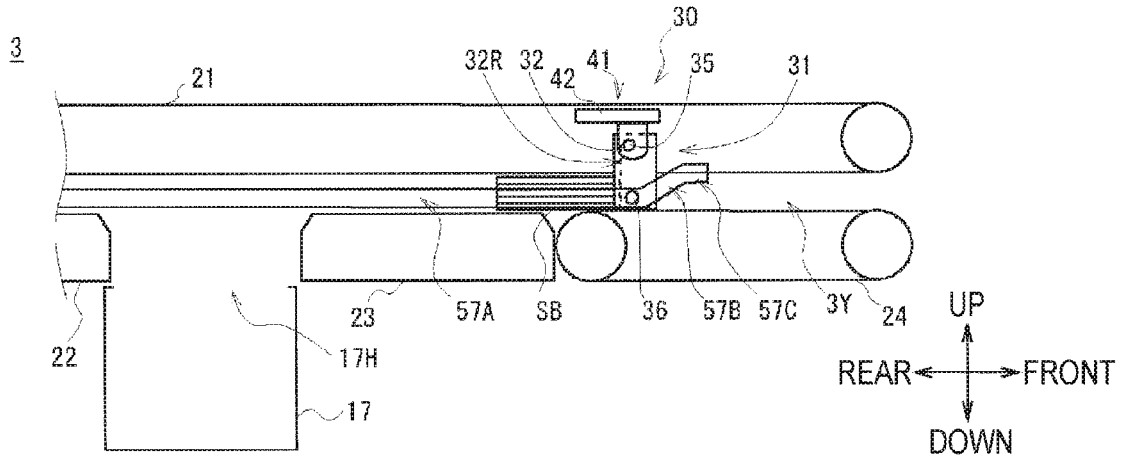
FIG. 5B is a schematic diagram illustrating a conveyance operation (2) of a banknote bundle according to the first exemplary embodiment.

Next, the bundle conveyance unit 3 uses the moving section 50 to move the Scott-Russell section 30 toward the rear, such that the posts 36 are moved toward the rear along the slide grooves 57, and from the separation regions 57C, the posts 36 arrive in the vicinity of the front end of the movement regions 57A via the inclined regions 57B, as illustrated in FIG. 5B. When this is performed, the Scott-Russell body 31 of the Scott-Russell section 30 swings gradually from the retracted orientation in the counterclockwise direction in the drawings, ultimately reaching the conveyance-enabled orientation, namely the orientation in which the front face 32F of the Scott-Russell plate 32 faces toward the front.

Figure 5C:
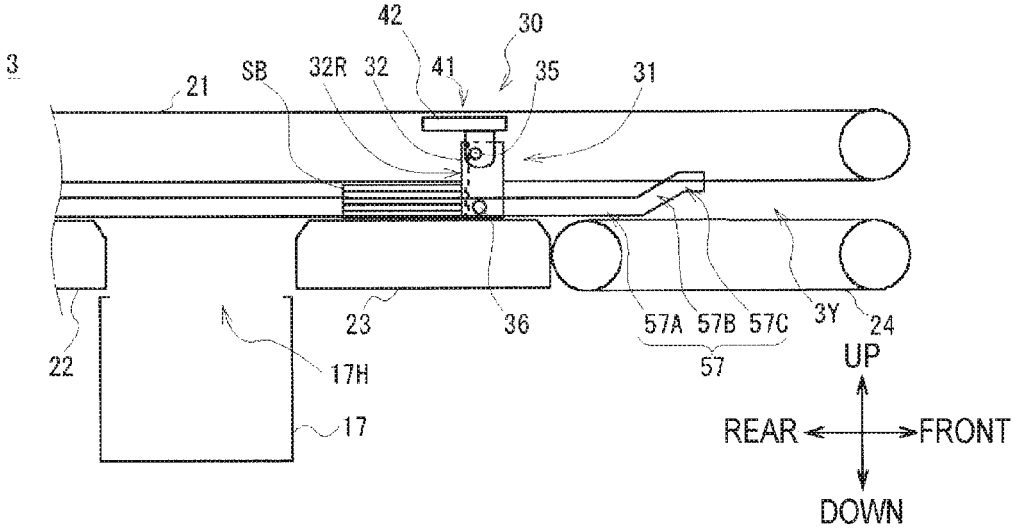
FIG. 5C is a schematic diagram illustrating a conveyance operation (2) of a banknote bundle according to the first exemplary embodiment.

The bundle conveyance unit 3 then moves the upper conveyor belt 21 toward the rear, and moves the Scott-Russell section 30 toward the rear using the moving section 50, such that as illustrated in FIG. 5C, the rear face 32R of the Scott-Russell plate 32 abuts the front end of the banknote bundle SB and applies the banknote bundle SB with a force toward the rear, thereby moving the banknote bundle SB toward the rear.

When this is performed, the claw-shaped portions 32C of the Scott-Russell plate 32 move toward the rear in a state in which the claw-shaped portions 32C have entered into the claw-guide grooves 23D of the fixed conveyance guide 23, similarly to as illustrated in FIG. 4A, but with the front and rear reversed. The bundle conveyance unit 3 is thereby capable of abutting the long edge positioned on the front side of all of the banknotes contained in the banknote bundle SB, from the uppermost face to the lowermost face, with the rear face 32R and the Scott-Russell plate 32, and applying force toward the rear. The bundle conveyance unit 3 is thereby capable of moving the banknote bundle SB stably along the bundle conveyance path 3Y toward the rear, maintaining the banknote bundle SB in a stacked state without the banknote bundle SB collapsing. In the following explanation, such a state in which the banknote bundle SB is positioned at the rear side of the Scott-Russell body 31 in the conveyance-enabled orientation and the banknote bundle SB can be conveyed toward the rear is referred to as the rearward conveyance state.

When the bundle conveyance unit 3 finally brings the banknote bundle SB as far as the rear end of the fixed conveyance guide 23, the banknote bundle SB is caused to fall into the intake hole 17H, to be stored inside the reject storage box 17. The bundle conveyance unit 3 then moves the Scott-Russell section 30 to the rearmost position so as to be prepared for the next pay-out conveyance operation, and the take-in conveyance operation is ended.

Note that if the banknote bundle SB is taken by the user in the state illustrated in FIG. 4C, the bundle conveyance unit 3 moves the Scott-Russell section 30 toward the rear side so as to cause the Scott-Russell body 31 to transition from the retracted orientation to the conveyance-enabled orientation, and moreover positions the Scott-Russell section 30 at the rearmost position of the bundle conveyance path 3Y, thereby preparing for the next pay-out conveyance operation.

In the above configuration, in the bundle conveyance unit 3 of the banknote pay-out device 1 according to the first exemplary embodiment, the slide grooves 57 are provided to the left guide plate 51 and the right guide plate 52 so as to have a different height from the bundle conveyance face 3S in each region, and the posts 36 of the Scott-Russell body 31 are inserted through the slide grooves 57. Accordingly, by using the moving section 50 to move the Scott-Russell section 30 in the front-rear direction, the bundle conveyance unit 3 is capable of causing the Scott-Russell body 31 to adopt the conveyance-enabled orientation in the movement region 57A, and to transition to the retracted orientation in the separation region 57C.

In the bundle conveyance unit 3, when the Scott-Russell body 31 is in the conveyance-enabled orientation, the banknote bundle SB can be conveyed by moving the Scott-Russell section 30 toward the front or toward the rear along the bundle conveyance path 3Y in a state in which part of the front face 32F or the rear face 32R of the Scott-Russell plate 32 abuts the banknote bundle SB. Moreover in the bundle conveyance unit 3, when the Scott-Russell plate 32 is in the retracted orientation, the banknote bundle SB can be moved toward the front side or the rear side of the Scott-Russell plate 32 by moving the banknote bundle SB toward the front or toward the rear in a state gripped from above and below by the upper conveyor belt 21 and the lower conveyor belt 24.

Namely, the bundle conveyance unit 3 is capable of switching the direction of progress of the banknote bundle SB, namely the conveyance direction, toward the front or toward the rear by causing the Scott-Russell body 31 to transition to the conveyance-enabled orientation or the retracted orientation, without providing a motive power source such as a motor to the Scott-Russell section 30 moving toward the front and rear.

Accordingly in the bundle conveyance unit 3, the weight of the Scott-Russell section 30 can be suppressed in comparison to cases in which a motive power source such as a motor is incorporated in the moving Scott-Russell section 30. Moreover, there is no need to increase the rigidity of the respective sections configuring the moving section 50 of the bundle conveyance unit 3, and drive can be performed with a compact motor of comparatively small output, enabling the overall configuration to be simplified. This enables a contribution to be made to reducing the size and reducing the power consumption of the banknote pay-out device 1.

In the bundle conveyance unit 3, the banknote bundle SB can be conveyed while being caused by the moving Scott-Russell section 30 to slide over the upper face of the fixed conveyance guide 23 and the like. There is therefore no need for the stage 16T, the moving conveyance guide 22, or the fixed conveyance guide 23 to be incorporated with mechanisms such as belts to move the banknote bundle SB. This thereby enables a more lightweight configuration of the bundle conveyance unit 3 due to configuring the moving stage 16T and moving conveyance guide 22 from simple plate shaped members, thus enabling a reduction in size of the motors and the like for moving the stage 16T and the moving conveyance guide 22, and enabling a simpler device configuration.

Moreover, in the Scott-Russell section 30, the support body 41 is only moved in the front-rear direction along the slide shaft 53 and the rail 56, and so the height, namely the distance of the shaft holes 43H from the bundle conveyance face 3S can be kept uniform at all times. Accordingly, in the Scott-Russell body 31, inserting the swing shafts 35 through the respective shaft holes 43H and inserting the posts 36 through the slide grooves 57 enables the swing angle about the swing shafts 35 to be determined solely by the height of the slide grooves 57.

The slide groove 57 has a substantially uniform height from the bundle conveyance face 3S in the movement region 57A. Accordingly, the Scott-Russell body 31 can be maintained in the conveyance-enabled orientation while the posts 36 of the Scott-Russell section 30 are in the movement region 57A, enabling the front face 32F of the Scott-Russell plate 32 to always face toward the front, and for the rear side of the banknote bundle SB to always be abutted by the substantially vertical face. This thereby enables the Scott-Russell section 30 to apply a stable force to the banknote bundle SB from the Scott-Russell plate 32 during conveyance, enabling the banknote bundle SB to be moved in the stacked state without collapsing.

Moreover, in the bundle conveyance unit 3, the claw-shaped portions 32C that project further downward than their surroundings are formed at the lower edge of the Scott-Russell plate 32, and the claw-guide grooves 22D and 23D are respectively formed in the upper faces of the moving conveyance guide 22 and the fixed conveyance guide 23, such that the claw-shaped portions 32C enter the claw-guide grooves 22D and 23D when the posts 36 move in the movement regions 57A. This thereby enables the claw-shaped portions 32C to be positioned further toward the lower side than the lowermost face of the banknote bundle SB in the bundle conveyance unit 3, such that all of the banknotes contained in the banknote bundle SB, from the uppermost face to the lowermost face thereof, are conveyed toward the front or toward the rear without any banknotes being left behind.

Moreover, in the bundle conveyance unit 3, the upper conveyor belt 21 is provided at the upper side of the bundle conveyance path 3Y over substantially the entire range of the bundle conveyance path 3Y. Accordingly, in the bundle conveyance unit 3, the upper face of the banknote bundle SB, made up of stacked paper sheet shaped banknotes that are not bound together, can be moved while being pressed toward the bundle conveyance face 3S by the lower face of the upper conveyor belt 21, thereby enabling collapse of the banknote bundle SB during conveyance to be forestalled.

According to the above configuration, the bundle conveyance unit 3 of the banknote pay-out device 1 of the first exemplary embodiment moves the Scott-Russell section 30 toward the front or toward the rear while moving the posts 36 along the slide grooves 57. When this is performed, the bundle conveyance unit 3 conveys the banknote bundle SB along the bundle conveyance path 3Y toward the front, after which the Scott-Russell body 31 is caused to transition from the conveyance-enabled orientation to the retracted orientation, and the banknote bundle SB is conveyed toward the rear by the lower conveyor belt 24 and the like before returning the Scott-Russell body 31 to the conveyance-enabled orientation to switch from a forward conveyance state to a rearward conveyance state, enabling the banknote bundle SB to be conveyed toward the rear along the bundle conveyance path 3Y. The bundle conveyance unit 3 is accordingly capable of switching the banknote bundle SB conveyance direction from a forward direction to a rearward direction without providing a motive power source to the Scott-Russell section 30, which moves in the front-rear direction.

2. Second Exemplary Embodiment

Figure 6A:
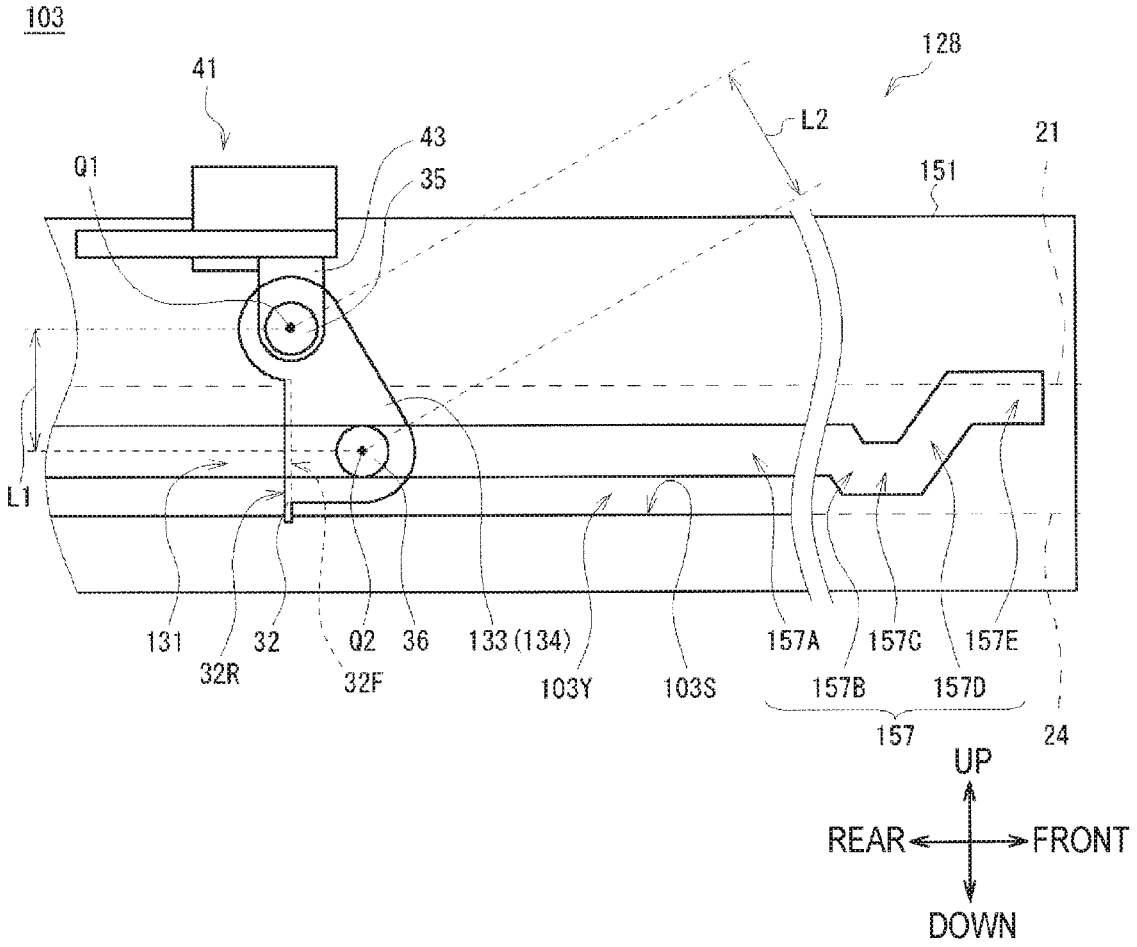
FIG. 6A is a schematic diagram illustrating a configuration of a bundle conveyance unit according to a second exemplary embodiment.

In a second exemplary embodiment, the banknote bundle SB is conveyed in the front-rear direction along a bundle conveyance path 103Y by a bundle conveyance unit 103 illustrated in FIG. 6A instead of by the bundle conveyance unit 3 of the first exemplary embodiment. The bundle conveyance unit 103 differs from the bundle conveyance unit 3 in the point that it is provided with a Scott-Russell mechanism 128 instead of the Scott-Russell mechanism 28. The Scott-Russell mechanism 128 is configured by a Scott-Russell section 130 and a moving section 150 instead of the Scott-Russell section 30 and the moving section 50 of the first exemplary embodiment.

2-1. Scott-Russell Section and Moving Section Configuration

The Scott-Russell section 130 includes a support body 41 similar to that of the first exemplary embodiment, and a Scott-Russell body 131 having a configuration that differs partly from that of the Scott-Russell body 31. The Scott-Russell body 131 differs from the Scott-Russell body 31 of the first exemplary embodiment in the point that it includes a left side plate 133 and a right side plate 134 instead of the left side plate 33 and the right side plate 34. The Scott-Russell body 131 includes a Scott-Russell plate 32, swing shafts 35, and posts 36 that are each configured similarly to the Scott-Russell body 31 of the first exemplary embodiment.

The left side plate 133 has a plate shape that is thin in the left-right direction, similarly to the left side plate 33; however, the left side plate 133 has a different shape to that of the left side plate 33. Specifically, as viewed from the left, the left side plate 133 has a triangular or trapezoidal shape including a front edge that is inclined overall, and a lower side that projects out toward the front. The vicinity of an upper end of a rear edge of the left side plate 133 is connected to a semicircle. The center of this semicircular portion is positioned substantially directly above the Scott-Russell plate 32.

Above the left side plate 133, the swing shaft 35 projects out toward the left from the vicinity of the center of the semicircular portion. Namely, a point Q1 representing the center axis of the swing shaft 35 is positioned substantially directly above the Scott-Russell plate 32. The post 36 projects out toward the left from a location at the lower side of, and toward the front of, the swing shaft 35. Namely, the post 36 and a point Q2 representing the center of the post 36 are positioned at the front of and below the swing shaft 35, and are positioned at the front side of the Scott-Russell plate 32.

The moving section 150 includes a left guide plate 151 and a right guide plate 152 instead of the left guide plate 51 and the right guide plate 52 of the first exemplary embodiment. The left guide plate 151 and the right guide plate 152 are configured similarly overall to the left guide plate 51 and the right guide plate 52; however, each includes a slide groove 157 instead of the slide groove 57.

Although the slide groove 157 resembles the slide groove 57 of the first exemplary embodiment overall, the slide groove 157 is formed with a partially different profile. Specifically, the slide groove 157 includes a movement region 157A, an inclined region 157D, and a separation region 157E, respectively corresponding to the movement region 57A, the inclined region 57B, and the separation region 57C, and also includes a lowering region 157B and a pull-back region 157C formed between the movement region 157A and the inclined region 157D. Note that in the present exemplary embodiment, the lowering region 157B, the pull-back region 157C, the inclined region 157D, and the separation region 157E are collectively referred to as a retraction region.

The lowering region 157B is inclined diagonally downward toward the front from a front end of the movement region 157A, and has an incline direction opposite to that of the inclined region 157D in the vertical direction. The length of the lowering region 157B in the vertical direction is sufficiently shorter than that of the inclined region 157D.

The pull-back region 157C is formed in a straight line shape running along the front-rear direction, similarly to the movement region 157A and the separation region 157E. A front end of the pull-back region 157C is connected to a front lower end of the lowering region 157B, and is therefore positioned further toward the lower side than the movement region 157A. In other words, as viewed along the left-right direction, the pull-back region 157C is lowered so as to form a step with respect to the movement region 157A.

As illustrated in FIG. 6A, in the Scott-Russell mechanism 128, similarly to in the first exemplary embodiment, the posts 36 are inserted through the slide grooves 157 by assembling the Scott-Russell section 130 and the moving section 150 together. Also similarly to in the first exemplary embodiment, the support body 41 of the Scott-Russell section 130 moves toward the front along the slide shaft 53 and the rail 56 (FIGS. 2 and FIG. 3) without changing in height. When this is performed, the swing shafts 35 that are swingably supported by the swing support plates 43 only move in the front-rear direction, and do not move in the vertical direction.

Note that as illustrated in FIG. 6A, length L1 is shorter than length L2, wherein length L1 is the distance between the center points Q1 and Q2 in the vertical direction, and length L2 is the absolute distance between the center points Q1 and Q2.

2-2. Banknote Bundle Conveyance Operation

Next, explanation follows regarding a conveyance operation of the banknote bundle SB by the bundle conveyance unit 103. As illustrated in FIG. 6A, in a pay-out conveyance operation, the bundle conveyance unit 103 uses the moving section 150 to move the Scott-Russell section 130 toward the front in a state in which the banknote bundle SB has been placed on the fixed conveyance guide 23.

When this is performed, the left and right posts 36 of the Scott-Russell body 131 of the Scott-Russell section 130 are in the movement regions 157A of the slide grooves 157, to adopt a state in which the front face 32F of the Scott-Russell plate 32 faces toward the front, and a portion of the front face 32F abuts the banknote bundle SB, similarly to in the first exemplary embodiment. In the present exemplary embodiment, such an orientation in which the front face 32F of the Scott-Russell plate 32 faces toward the front and the Scott-Russell body 131 is capable of conveying the banknote bundle SB is referred to hereafter as the conveyance-enabled orientation. Moreover, in the present exemplary embodiment, a state in which the Scott-Russell body 131 is in the conveyance-enabled orientation, and the Scott-Russell plate 32 is positioned at the rear side of the banknote bundle SB and is capable of conveying the banknote bundle SB toward the front is referred to as the forward conveyance state.

Figure 7A:
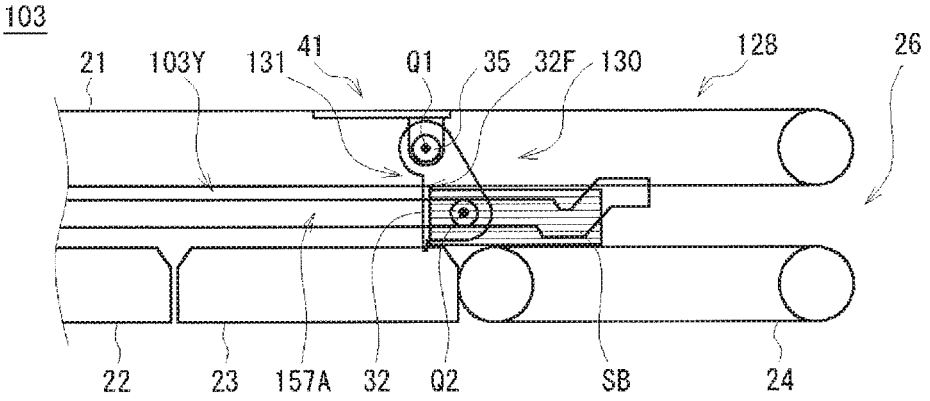
FIG. 7A is a schematic diagram illustrating a conveyance operation of a banknote bundle according to the second exemplary embodiment.
Figure 7B:
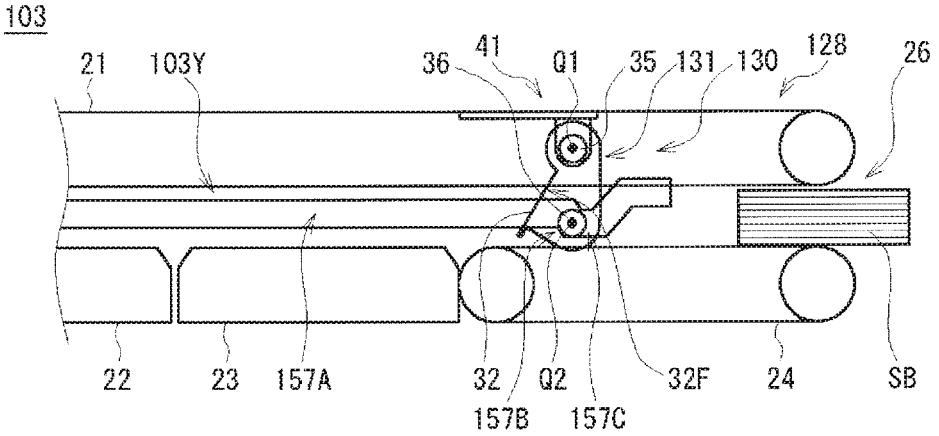
FIG. 7B is a schematic diagram illustrating a conveyance operation of a banknote bundle according to the second exemplary embodiment.

As illustrated in FIG. 7A, in the bundle conveyance unit 103, when the vicinity of the leading end of the banknote bundle SB finally reaches the upper face of the lower conveyor belt 24, similarly to as illustrated in FIG. 4B, the banknote bundle SB enters a state sandwiched from above and below by the lower face of the upper conveyor belt 21 and the upper face of the lower conveyor belt 24. The bundle conveyance unit 103 then pauses the movement of the Scott-Russell section 130 toward the front by the moving section 150, and as illustrated in FIG. 7B, with the banknote bundle SB gripped from above and below by the upper conveyor belt 21 and the lower conveyor belt 24, conveys the banknote bundle SB forward to the pay-out port 26 to be taken by the user.

The bundle conveyance unit 103 then recommences movement of the Scott-Russell section 130 toward the front by the moving section 150. When this is performed, in the Scott-Russell section 130, while maintaining the height of the swing shafts 35, the posts 36 reach the lowering regions 157B from the movement regions 157A of the slide grooves 157, and then the posts 36 are lowered along the lowering regions 157B, and finally reach the pull-back regions 157C.

When this is performed, the posts 36 are displaced further downward, namely toward a direction to pull back from the swing shaft 35, in the vertical direction than when the posts 36 were positioned in the movement regions 157A (FIG. 7A). Accompanying the lowering of the posts 36, the Scott-Russell body 131 swings about the swing shaft 35 such that the front face 32F of the Scott-Russell plate 32 gradually faces downward, namely swings in the clockwise direction in the drawings.

Figure 7C:
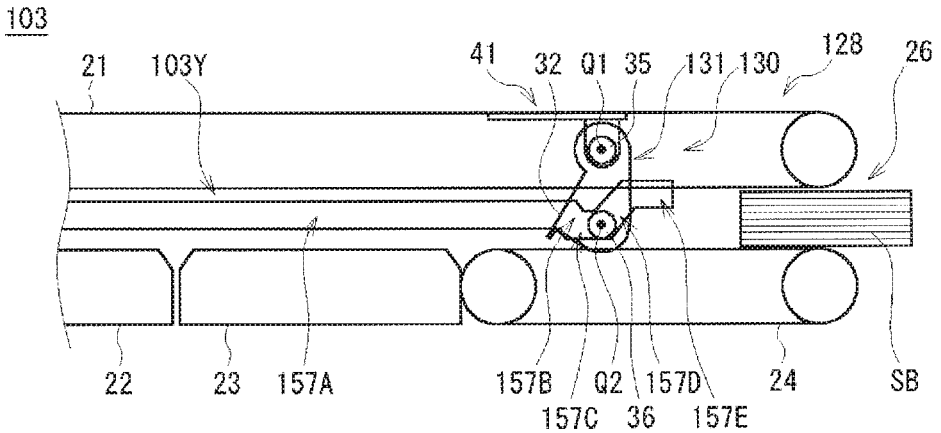
FIG. 7C is a schematic diagram illustrating a conveyance operation of a banknote bundle according to the second exemplary embodiment.
Figure 7D:
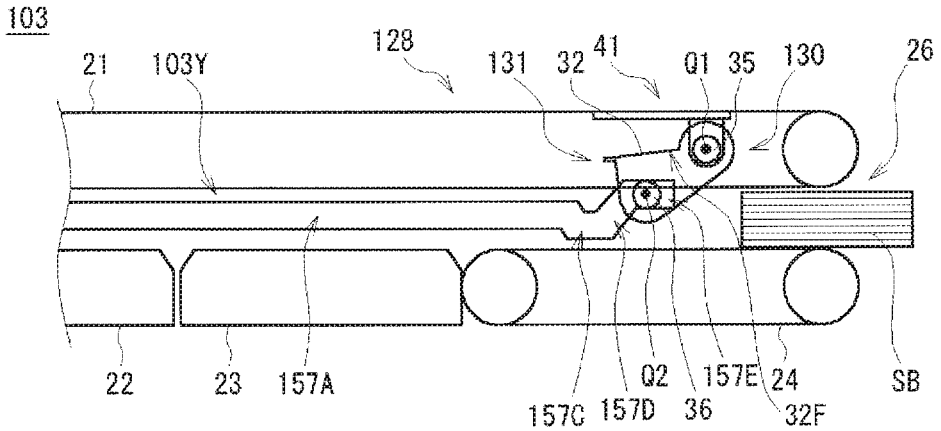
FIG. 7D is a schematic diagram illustrating a conveyance operation of a banknote bundle according to the second exemplary embodiment.

The bundle conveyance unit 103 then uses the moving section 150 to move the Scott-Russell section 130 further toward the front. When this is performed, as illustrated in FIG. 7C, the Scott-Russell body 131 first moves the posts 36 slightly toward the front along the pull-back regions 157C of the slide grooves 157, and then moves the posts 36 to the front end of the pull-back regions 157C, namely a lower end of the inclined regions 157D. The Scott-Russell body 131 then raises the posts 36 along the inclined regions 157D, and finally, as illustrated in FIG. 7D, the posts 36 reach the separation regions 157E.

When this is performed, the Scott-Russell body 131 is swung about the swing shaft 35 in the clockwise direction in the drawings, and the lower edge of the Scott-Russell plate 32 is lifted further toward the upper side than the upper face of the banknote bundle SB so as to be pulled back from the banknote bundle. In the present exemplary embodiment, this orientation is referred to hereafter as the retracted orientation. At this point, the posts 36 and the center point Q2 are positioned further toward the rear side than the swing shafts 35 and the center point Q1.

The bundle conveyance unit 103 ends the pay-out conveyance operation at this stage. Note that when a user forgets to take the banknote bundle SB, the bundle conveyance unit 103 commences the banknote bundle SB take-in conveyance operation.

Specifically, similarly to as illustrated in FIG. 5A, the bundle conveyance unit 103 respectively drives the upper conveyor belt 21 and the lower conveyor belt 24 toward the rear, moving the banknote bundle SB toward the rear, with the Scott-Russell section 130 remaining stationary, namely, with the Scott-Russell body 131 still in the retracted orientation. The banknote bundle SB thereby passes below the Scott-Russell plate 32 of the Scott-Russell body 131 in the retracted orientation, and arrives at a position further to the rear side than the Scott-Russell plate 32.

Next, the bundle conveyance unit 103 uses the moving section 150 to move the Scott-Russell section 130 toward the rear, thus moving the posts 36 toward the rear along the slide grooves 157. When this is performed, as illustrated in FIG. 7C, FIG. 7B, and FIG. 7A, the posts 36 move in sequence from the separation regions 157E through the inclined regions 157D, the pull-back regions 157C, and the lowering regions 157B, so as to arrive in the movement regions 157A. Accompanying this, the Scott-Russell body 131 at the front side of the banknote bundle SB swings gradually from the retracted orientation in the counterclockwise direction in the drawings, finally reaching the conveyance-enabled orientation, namely an orientation in which the front face 32F of the Scott-Russell plate 32 faces toward the front.

Following this, the bundle conveyance unit 103 drives the upper conveyor belt 21 toward the rear, and uses the moving section 150 to move the Scott-Russell section 130 toward the rear. Accordingly, the rear face 32R (FIG. 6A) of the Scott-Russell plate 32 abuts the front end of the banknote bundle SB and applies the banknote bundle SB with force toward the rear such that the rearward conveyance state is adopted, and the banknote bundle SB is moved toward the rear. The bundle conveyance unit 103 can accordingly make the banknote bundle SB fall through the intake hole 17H to be stored in the reject storage box 17, similarly to as illustrated in FIG. 5C.

According to the above configuration, in the bundle conveyance unit 103 according to the second exemplary embodiment, the slide grooves 157 that are at a different height from the bundle conveyance face 3S in each region are provided to the left guide plate 151 and the right guide plate 152, and the posts 36 of the Scott-Russell body 131 are inserted through the slide grooves 157. Accordingly, similarly to in the first exemplary embodiment, by using the moving section 150 to move the Scott-Russell section 130 in the front-rear direction, the bundle conveyance unit 103 is capable of causing the Scott-Russell body 131 to adopt the conveyance-enabled orientation in the movement region 157A, and to transition to the retracted orientation in the separation region 157E.

Namely, the bundle conveyance unit 103 is capable of causing the Scott-Russell body 131 to transition to the conveyance-enabled orientation or the retracted orientation by displacing the posts 36 in the vertical direction according to the profile of the slide groove 157, without providing a motive power source to the Scott-Russell section 130, which moves in the front-rear direction. Moreover, similarly to in the first exemplary embodiment, the bundle conveyance unit 103 is capable of switching the conveyance direction of the banknote bundle SB toward the front or toward the rear by combining a change in orientation of the Scott-Russell body 131 with the front-rear direction conveyance operation of the banknote bundle SB by the upper conveyor belt 21 and the lower conveyor belt 24.

Note that in the first exemplary embodiment, when the Scott-Russell body 31 is in the conveyance-enabled orientation, the posts 36 are positioned substantially directly below the swing shafts 35. Namely, when the Scott-Russell body 31 is in the conveyance-enabled orientation, the direction in which the posts 36 are capable of moving with respect to the swing shafts 35 is a direction tangential to an imaginary circle centered on the swing shaft 35, namely the front-rear direction, corresponding to a direction running along the movement region 157A.

Accordingly, in cases in which, for example, the posts 36 are slightly loose in the movement regions 57A of the slide grooves 57, the front-rear direction movement is hardly restricted by side edge portions of the slide grooves 57, enabling movement over a comparatively long distance in the front-rear direction in the movement regions 57A.

In particular, when the Scott-Russell plate 32 of the Scott-Russell body 31 is abutted against the banknote bundle SB for conveyance in the front-rear direction, there is a possibility that a reaction force in the front-rear direction from the banknote bundle SB could be received due to, for example, friction or the like between the banknote bundle SB and the fixed conveyance guide 23 and so on. In such cases, the posts 36 of the Scott-Russell body 31 could be moved significantly toward the front or rear in the movement regions 57A by the reaction force received from the banknote bundle SB, tilting the Scott-Russell plate 32 heavily with respect to the vertical direction, to the detriment of the stacked state of the banknote bundle SB.

Figure 6B:
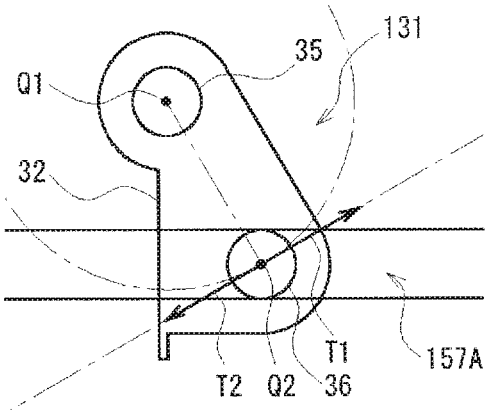
FIG. 6B is a schematic diagram illustrating a configuration of a bundle conveyance unit according to the second exemplary embodiment.

By contrast, when the Scott-Russell body 131 of the second exemplary embodiment is in the conveyance-enabled orientation, the posts 36 are positioned in front of and below the swing shafts 35, rather than directly below the swing shafts 35. Accordingly, in the Scott-Russell body 131, the direction in which the posts 36 are capable of moving with respect to the swing shafts 35, namely a direction tangential to an imaginary circle centered on the center point Q1 and passing through the center point Q2, is that of the arrows T1 and T2 in FIG. 6B. The direction along the arrows T1 and T2 intersects the front-rear direction, this being the direction of progress along the movement regions 157A of the slide grooves 157, so as to an angle of some degree (for example from 30° to 45°) with respect to the front-rear direction.

According to this configuration, the Scott-Russell body 131 moves the posts 36 in the direction along the arrows T1 and T2 in the movement regions 157A even if the Scott-Russell plate 32 receives a reaction force from the banknote bundle SB, enabling the movement amount of the posts 36 in the front-rear direction to be kept small. This thereby enables the angle of inclination of the Scott-Russell body 131 away from the vertical direction to be kept small, and thus enables stable conveyance with hardly any detriment to the stacked state of the banknote bundle SB.

Moreover, in the Scott-Russell mechanism 128 of the bundle conveyance unit 103, the pull-back region 157C is provided on the slide groove 157 below the movement region 157A (FIG. 6A). Accordingly, the bundle conveyance unit 103 is capable of moving the posts 36 from in front of and below the swing shafts 35 to the rear of and below the swing shafts 35, passing directly below the swing shafts 35, simply by moving the Scott-Russell body 131 toward the front and moving the posts 36 along the slide grooves 157. Accompanying this, the orientation of the Scott-Russell body 131 can be changed between the conveyance-enabled orientation and the retracted orientation (FIG. 7A to FIG. 7D).

According to the above configuration, the bundle conveyance unit 103 of the second exemplary embodiment moves the Scott-Russell section 130 toward the front or toward the rear while moving the posts 36 along the slide grooves 157. In the bundle conveyance unit 103 when this is performed, the banknote bundle SB is conveyed forward along the bundle conveyance path 103Y, after which the Scott-Russell body 131 is caused to transition from the conveyance-enabled orientation to the retracted orientation, and the banknote bundle SB is then conveyed toward the rear by the lower conveyor belt 24 and the like before restoring the Scott-Russell body 131 to the conveyance-enabled orientation, thereby enabling conveyance of the banknote bundle SB along the bundle conveyance path 103Y toward the rear. Similarly to in the first exemplary embodiment, the bundle conveyance unit 103 is accordingly capable of switching the conveyance direction of the banknote bundle SB from the forward direction to the rearward direction without providing a motive power source to the Scott-Russell section 130, which moves in the front-rear direction.

3. Third Exemplary Embodiment 3-1. Scott-Russell Section and Moving Section Configuration In a third exemplary embodiment, the banknote bundle SB is conveyed in the front-rear direction along a bundle conveyance path 203Y by a bundle conveyance unit 203 illustrated in FIG. 8A and FIG. 8B, instead of by the bundle conveyance unit 3 of the first exemplary embodiment. The bundle conveyance unit 203 differs from the bundle conveyance unit 3 in the points that the upper conveyor belt 21 and the lower conveyor belt 24 are omitted, and a fixed conveyance guide 223, a pay-out port 226, and a Scott-Russell mechanism 228 are provided instead of the fixed conveyance guide 23, the pay-out port 26, and the Scott-Russell mechanism 28.

The fixed conveyance guide 223 is configured so as to extend further toward the front than the fixed conveyance guide 23. An upper face of the fixed conveyance guide 223 is formed with claw-guide grooves 223D. The Scott-Russell mechanism 228 is configured by a Scott-Russell section 230 and a moving section 250 instead of the Scott-Russell section 30 and the moving section 50 of the Scott-Russell mechanism 28 (FIGS. 2 and FIG. 3).

Figure 8A:
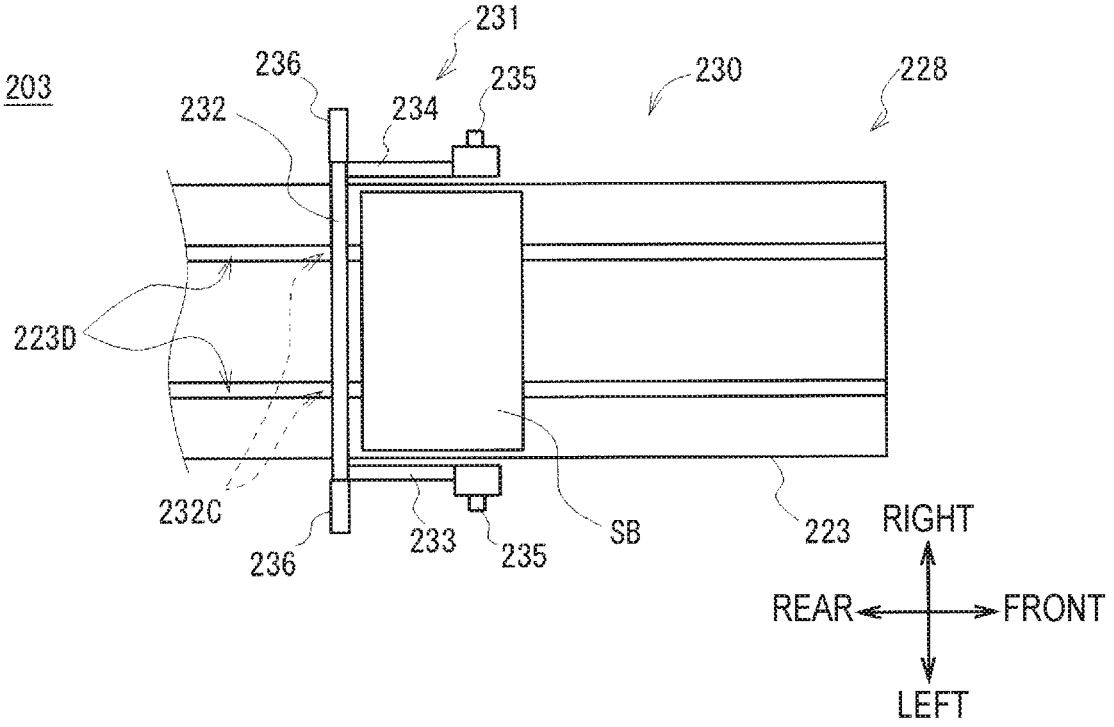
FIG. 8A is a schematic diagram illustrating configuration of a Scott-Russell section according to a third exemplary embodiment.
Figure 8B:
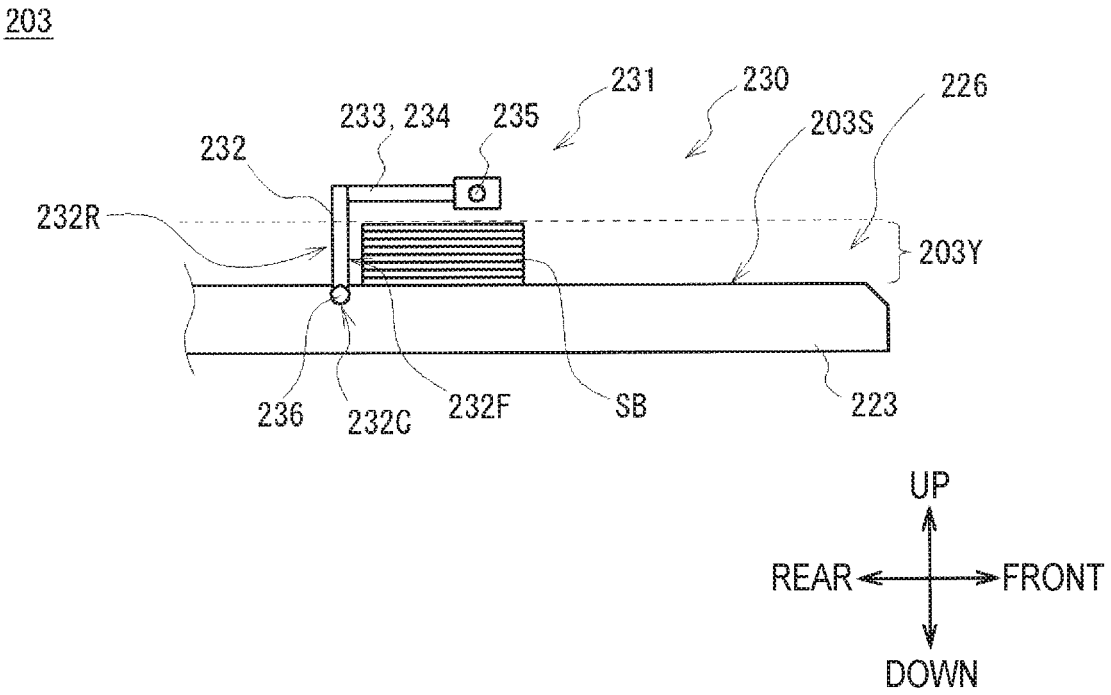
FIG. 8B is a schematic diagram illustrating configuration of a Scott-Russell section according to the third exemplary embodiment.

The Scott-Russell section 230 is configured by a Scott-Russell body 231 instead of the Scott-Russell body 31, and by a support body 41 configured similarly to that of the first exemplary embodiment. As illustrated in FIG. 8A and FIG. 8B, the Scott-Russell body 231 is configured by a Scott-Russell plate 232, a left arm 233, a right arm 234, swing shafts 235, and posts 236. Note that the support body 41 is omitted from illustration in FIG. 8A and FIG. 8B.

The Scott-Russell plate 232 is configured similarly to the Scott-Russell plate 32 of the first exemplary embodiment (FIGS. 2 and FIG. 3), and includes claw-shaped portions 232C. The left arm 233 is provided instead of the left side plate 33 of the first exemplary embodiment, and is formed in a rod shape that is long in the front-rear direction and short in the vertical and left-right directions, and is provided so as to extends forward and perpendicular to a left upper edge of the Scott-Russell plate 232. The right arm 234 is provided instead of the right side plate 34 of the first exemplary embodiment, and is configured with left-right symmetry to the left arm 233.

The swing shafts 235 have the same shape as the swing shafts 35 of the first exemplary embodiment, and extend outward toward the left and right from the vicinity of front ends of the left arm 233 and the right arm 234 respectively. The swing shafts 235 are swingably supported by the support body 41 (FIGS. 2, etc.). The posts 236 have the same shape as the posts 36 of the first exemplary embodiment, and extend outward toward the left and right from the vicinity of lower ends of both left and right edges of the Scott-Russell plate 232.

The moving section 250 differs from the moving section 50 of the first exemplary embodiment (FIGS. 2, FIG. 3, etc.) in the point that it includes a left guide plate 251 and a right guide plate 252 instead of the left guide plate 51 and the right guide plate 52. The moving section 250 is similar to the moving section 50 in other respects.

Figure 9A:
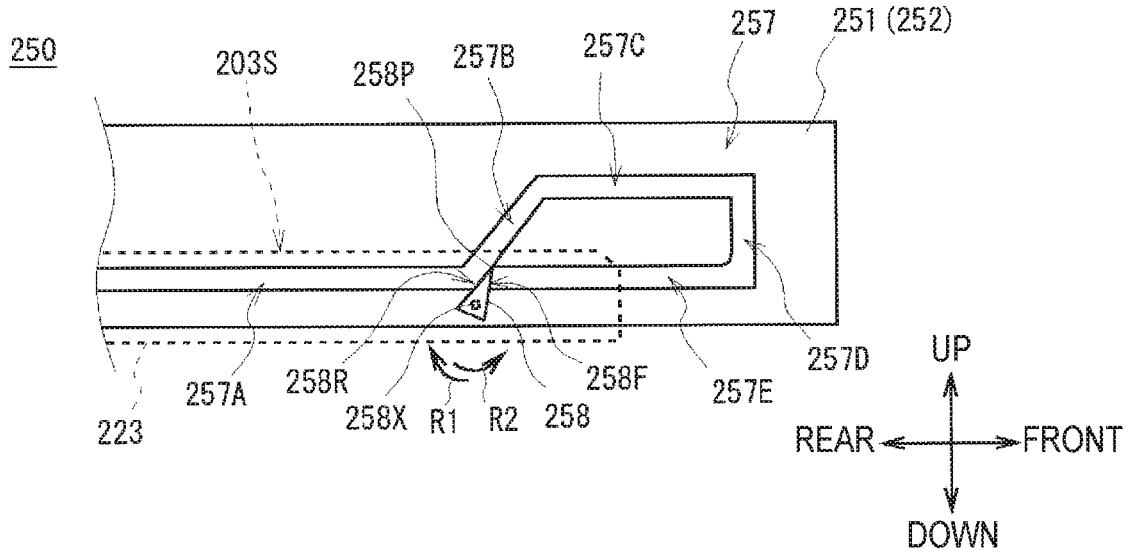
FIG. 9A is a schematic diagram illustrating configuration of a moving section according to the third exemplary embodiment.

As illustrated in FIG. 9A, the left guide plate 251 includes a switch 258 in addition to a slide groove 257 provided instead of the slide groove 57. The left guide plate 251 also includes a rail 56 (FIG. 3, etc.) similar to that of the first exemplary embodiment. The slide groove 257 is broadly divided into five regions of a movement region 257A, an inclined region 257B, a separation region 257C, a lowering region 257D, and a retracted region 257E.

The movement region 257A and the inclined region 257B are configured similarly to the movement region 57A and the inclined region 57B of the first exemplary embodiment, respectively. However, the movement region 257A is disposed slightly lower than a bundle conveyance face 203S, this being an upper face of the fixed conveyance guide 223. The separation region 257C corresponds to the separation region 57C of the first exemplary embodiment, and the front-rear direction length of the separation region 257C is longer than the front-rear direction length of the banknote bundle SB.

The lowering region 257D is formed from a front end of the separation region 257C downward as far as a height equivalent to that of the movement region 257A. The retracted region 257E advances from a lower end of the lowering region 257D toward the rear, and is connected to a location where the movement region 257A and the inclined region 257B are connected together, forming a three-way junction with the movement region 257A and the inclined region 257B. In other words, the retracted region 257E is configured so as to resemble an extension of the movement region 257A toward the front.

The slide groove 257 is thus formed with a quadrilateral shaped circuit path, by the inclined region 257B, the separation region 257C, the lowering region 257D, and the retracted region 257E, which is connected to a front end of the movement region 257A.

The switch 258 is formed in a triangular shape as viewed from along the left-right direction, and is attached to the left guide plate 251 through a swing shaft 258X, so as to be capable of swinging. The switch 258 is biased in the arrow R1 direction (namely, in the clockwise direction in the drawings) by a spring, not illustrated in the drawings. The range in which the switch 258 is capable of swinging is restricted by a stopper, not illustrated in the drawings.

Accordingly, in a state in which the switch 258 is not applied with external force, as illustrated in FIG. 9A, a tip 258P of the switch 258 faces upward, and a bottom edge of the movement region 257A is connected to a front edge of the inclined region 257B by a rear edge 258R of the switch 258 (this is referred to below as the incline guidance mode). At this point, the retracted region 257E is blocked off from the movement region 257A by the switch 258.

Figure 9B:
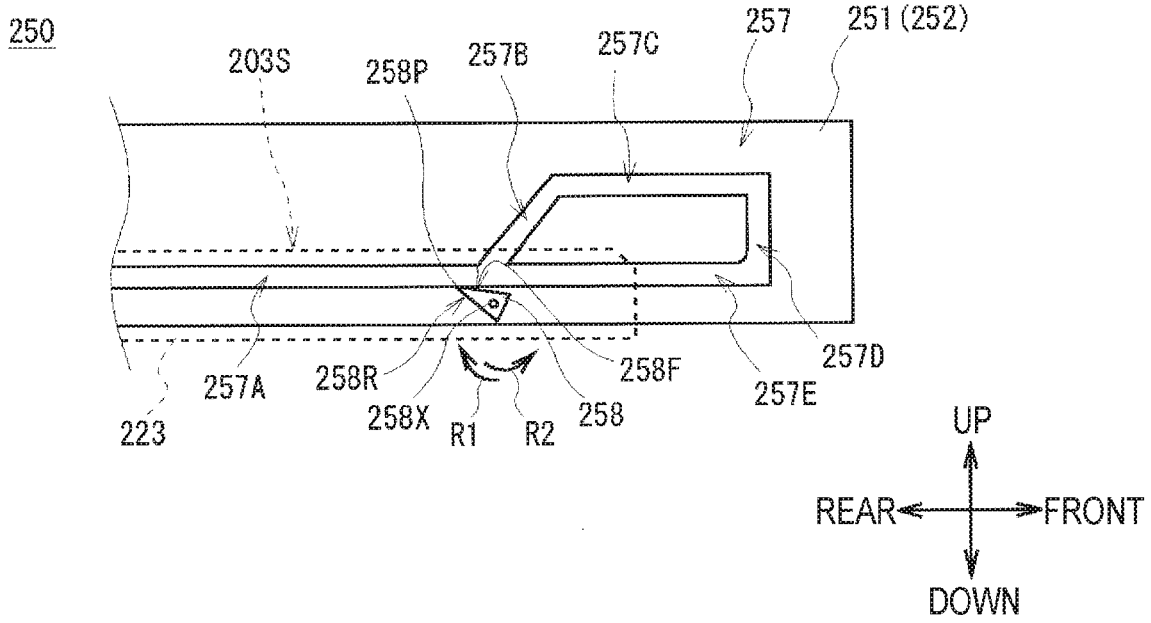
FIG. 9B is a schematic diagram illustrating configuration of a moving section according to the third exemplary embodiment.

Moreover, when an external force in the direction of arrow R2 (namely, counterclockwise in the drawings) is temporarily applied to a front edge 258F of the switch 258, for example, the switch 258 swings such that the tip 258P is pushed over to the rear and downward as illustrated in FIG. 9B, and substantially the entire switch 258, including the tip 258P, is pulled back flush with or lower than the lower edge of the movement region 257A, thus connecting the retracted region 257E and movement region 257A together (this is referred to below as the horizontal guidance mode). The switch 258 then returns from the incline guidance mode (FIG. 9A) to the horizontal guidance mode under the action of the spring when the application of the external force is released.

The right guide plate 252 includes the slide groove 257 and switch 258, similarly to the left guide plate 251.

3-2. Banknote Bundle Conveyance Operation

Next, explanation follows regarding a conveyance operation of the banknote bundle SB by the bundle conveyance unit 203. As illustrated in FIGS. 8, in a pay-out conveyance operation the bundle conveyance unit 203 uses the moving section 250 to move the Scott-Russell section 230 toward the front in a state in which the banknote bundle SB has been placed on the fixed conveyance guide 223.

When this is performed, the left and right posts 236 of the Scott-Russell body 231 of the Scott-Russell section 230 are in the movement regions 257A of the slide grooves 257, and a state is adopted in which a front face 232F of the Scott-Russell plate 232 faces toward the front, and a portion of the front face 232F abuts the banknote bundle SB, similarly to in the first exemplary embodiment. In the present exemplary embodiment, such an orientation in which the front face 232F of the Scott-Russell plate 232 faces toward the front and the Scott-Russell body 231 is capable of conveying the banknote bundle SB is referred to hereafter as the conveyance-enabled orientation. Moreover, in the present exemplary embodiment, a state in which the Scott-Russell body 231 is in the conveyance-enabled orientation, and the Scott-Russell plate 232 is positioned at the rear side of the banknote bundle SB and is capable of conveying the banknote bundle SB toward the front is referred to as the forward conveyance state.

Figure 10A:
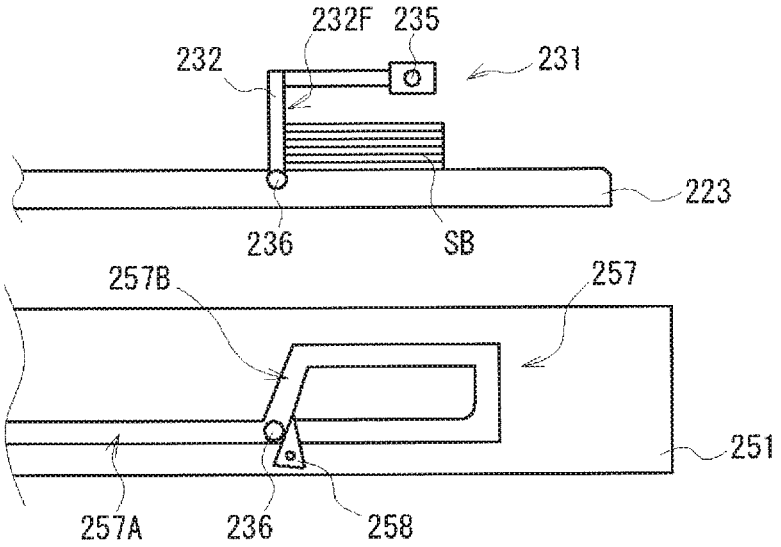
FIG. 10A is a schematic diagram illustrating a conveyance operation (1) of a banknote bundle according to the third exemplary embodiment.

As illustrated in FIG. 10A, corresponding to FIG. 8A and FIG. 9A, in the bundle conveyance unit 203, the posts 236 reach the front end of the movement regions 257A and the posts 236 abut the rear edges 258R of the switches 258 that are in the incline guidance mode. Note that the upper part of FIG. 10A illustrates the Scott-Russell body 231, and the lower part of FIG. 10A illustrates part of the left guide plate 251. At this point, although the rear edges 258R of the switches 258 are being applied with force toward the front by the posts 236, the switches 258 are restricted from swinging by stoppers, not illustrated in the drawings, such that the incline guidance mode is maintained.

The bundle conveyance unit 203 ends the pay-out conveyance operation at this stage, and the banknote bundle SB placed on the fixed conveyance guide 223 in the pay-out port 226 can be taken by the user. Note that when a user forgets to take the banknote bundle SB, the bundle conveyance unit 203 commences the banknote bundle SB take-in conveyance operation.

Figure 10B:
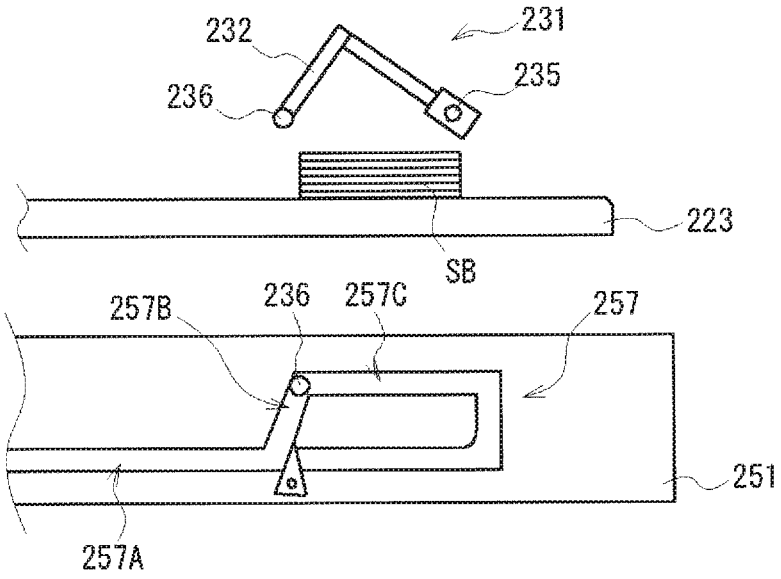
FIG. 10B is a schematic diagram illustrating a conveyance operation (1) of a banknote bundle according to the third exemplary embodiment.

First, the bundle conveyance unit 203 uses the moving section 250 to move the Scott-Russell section 230 toward the front. The posts 236 are thereby guided into the inclined regions 257B whilst sliding against the rear edges 258R of the switches 258 that are in the incline guidance mode. The posts 236 move diagonally upward and toward the front along the inclined regions 257B, and reach the front end of the separation regions 257C, as illustrated in FIG. 10B. At this point, the Scott-Russell body 231 swings about the swing shafts 235 in the clockwise direction in the drawings, and the lower edge of the Scott-Russell plate 232 is lifted further toward the upper side than the upper face of the banknote bundle SB so as to be pulled back from the banknote bundle SB. In the present exemplary embodiment, this orientation is referred to below as the retracted orientation.

Figure 10C:
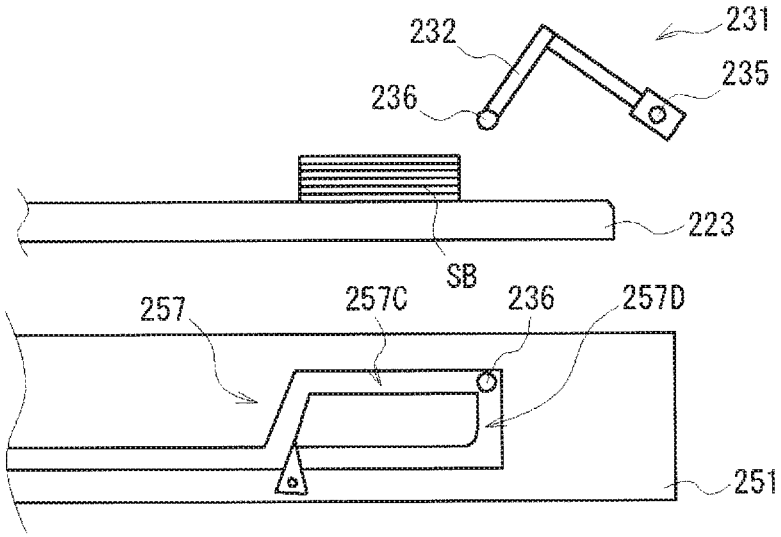
FIG. 10C is a schematic diagram illustrating a conveyance operation (1) of a banknote bundle according to the third exemplary embodiment.

The bundle conveyance unit 203 then uses the moving section 250 to move the Scott-Russell section 230 further toward the front. Accordingly, the posts 236 move along the separation regions 257C toward the front, while maintaining the retracted orientation, and reach the front end of the separation regions 257C, namely the upper end of the lowering regions 257D, as illustrated in FIG. 10C. At this point, the posts 236, together with the lower edge portion of the Scott-Russell plate 232, reach further to the front side than the banknote bundle SB that is stationary on the fixed conveyance guide 223.

Figure 11A:
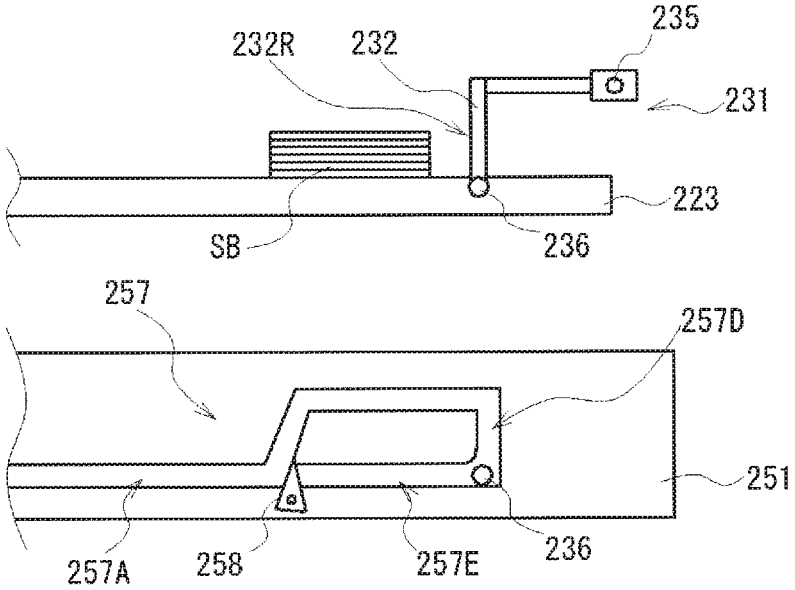
FIG. 11A is a schematic diagram illustrating a conveyance operation (2) of a banknote bundle according to the third exemplary embodiment.

Next, the bundle conveyance unit 203 uses the moving section 250 to move the Scott-Russell section 230 slightly toward the rear. Accordingly, the posts 236 move downward along the lowering regions 257D, and reach the lower end of the lowering regions 257D, namely the front end of the retracted regions 257E, as illustrated in FIG. 11A. At this point, the posts 236, together with the lower edge portion of the Scott-Russell plate 232, are positioned at a height slightly lower than the upper face of the fixed conveyance guide 223. Accordingly, the Scott-Russell body 231 returns to an orientation in which a rear face 232R of the Scott-Russell plate 232 faces toward the rear, namely the conveyance-enabled orientation, and the rear face 232R faces the front side face of the banknote bundle SB. In the present exemplary embodiment, this state in which the Scott-Russell body 231 is in the conveyance-enabled orientation and Scott-Russell plate 232 is positioned at the front side of the banknote bundle SB and is capable of conveying the banknote bundle SB toward the rear is referred to below as the rearward conveyance state.

From another perspective, the inclined regions 257B, the separation regions 257C, and the lowering regions 257D of the slide grooves 257 configure regions for causing the Scott-Russell body 231 to transition from the conveyance-enabled orientation to the retracted orientation, and then to return the Scott-Russell body 231 to the conveyance-enabled orientation. In the following explanation, the inclined region 257B, the separation region 257C, and the lowering region 257D are also referred to collectively as the retraction region.

The bundle conveyance unit 203 then uses the moving section 250 to move the Scott-Russell section 230 further toward the rear. When this is performed, the Scott-Russell section 230 moves the posts 236 rearward along the retracted region 257E, and the rear face 232R of the Scott-Russell plate 232 is abutted against the banknote bundle SB with the Scott-Russell body 231 maintained in the conveyance-enabled orientation, and the banknote bundle SB is pushed and conveyed toward the rear.

Figure 11B:
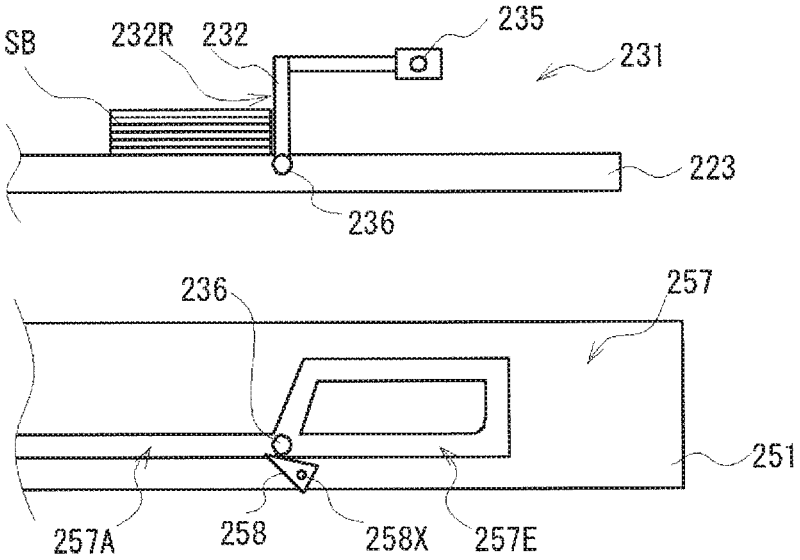
FIG. 11B is a schematic diagram illustrating a conveyance operation (2) of a banknote bundle according to the third exemplary embodiment.

When the posts 236 moving toward the rear finally abut the front edges 258F of the switches 258 disposed in an inclined guide mode (FIG. 9A), the front edges 258F are applied with a force toward the rear, as illustrated in FIG. 11B. Accordingly, the switches 258 continue to receive force from the posts 236 as the posts 236 slide against the front edges 258F, and the switches 258 swing under this force about the swing shafts 258X in the arrow R2 direction, namely in the counterclockwise direction in the drawings, such that the switches 258 transition to the horizontal guidance mode (FIG. 9B).

When the posts 236 move into the movement regions 257A and the location against which the posts 236 are sliding reaches the tips 258P, the switches 258 no longer receive force from the posts 236, and return from the horizontal guidance mode to the incline guidance mode (FIG. 9A) under the action of the springs (not illustrated in the drawings).

The bundle conveyance unit 203 then continues to use the moving section 250 to move the Scott-Russell section 230 toward the rear. When this is performed, the Scott-Russell section 230 moves the posts 236 toward the rear in the movement regions 257A, thereby moving the banknote bundle SB toward the rear with the rear face 232R of the Scott-Russell plate 232 maintained in a state abutting the banknote bundle SB.

When the bundle conveyance unit 203 finally brings the banknote bundle SB as far as the rear end of the fixed conveyance guide 223, the banknote bundle SB is caused to fall into the intake hole 17H (FIG. 1), to be stored inside the reject storage box 17. The bundle conveyance unit 203 then moves the Scott-Russell section 230 to the rearmost position so as to be prepared for the next pay-out conveyance operation, and the take-in conveyance operation is ended.

Note that if the banknote bundle SB is taken by the user in the state illustrated in FIG. 10A, the bundle conveyance unit 203 moves the Scott-Russell section 230 toward the rear side with the Scott-Russell body 231 maintained in the conveyance-enabled orientation, thereby preparing for the next pay-out conveyance operation.

In the above configuration, in the bundle conveyance unit 203 according to the third exemplary embodiment, the slide grooves 257 that are at a different height from the bundle conveyance face 203S in each region are provided to the left guide plate 251 and the right guide plate 252, and the posts 236 provided at substantially the same height as the lower edge of the Scott-Russell plate 232 are inserted through the slide grooves 257. Moreover, the slide groove 257 is formed with a quadrilateral ring-shaped path at the rear end of the straight line shape movement region 257A by the inclined region 257B, the separation region 257C, the lowering region 257D, and the retracted region 257E, with the switch 258 provided at the connection location between the movement region 257A, the inclined region 257B, and the retracted region 257E.

The bundle conveyance unit 203 uses the moving section 250 to move the Scott-Russell section 230 toward the front, thereby moving the posts 236 from the movement regions 257A through the inclined regions 257B and the separation regions 257C to the lowering regions 257D. When this is performed, the lower edge of the Scott-Russell plate 232 of the Scott-Russell section 230 is lifted to above the banknote bundle SB by the inclined regions 257B, and moved toward the front of the banknote bundle SB by the separation regions 257C, and the lower edge (namely, the claw-shaped portions 232C) is then moved downward, further to the lower side than the lower face of the banknote bundle SB by the lowering regions 257D. In other words, the Scott-Russell plate 232 transitions from the conveyance-enabled orientation, through the retracted orientation, and back to the conveyance-enabled orientation so as to pass over the banknote bundle SB, thereby moving from the rear side to the front side of the banknote bundle SB.

From another perspective, the bundle conveyance unit 203 is capable of moving the Scott-Russell plate 232 from the rear side to the front side of the banknote bundle SB, namely of switching between the forward conveyance state and the rearward conveyance state and switching the conveyance direction of the banknote bundle SB from toward the front to toward the rear, simply by moving the Scott-Russell section 230 toward the front and toward the rear. When this is performed, the bundle conveyance unit 203 is capable of moving the posts 236 upward along the inclined regions 257B of the slide grooves 257, forward along the separation regions 257C, and downward along the lowering regions 257D respectively, such that there is no need to provide the Scott-Russell section 230 with another motive power source to move the Scott-Russell plate 232 in the vertical direction.

Accordingly, similarly to in the first exemplary embodiment, the bundle conveyance unit 203 enables suppression to a lower weight and configuration to be made simpler in comparison to a case in which a motive power source such as a motor is incorporated in the moving Scott-Russell section 230. Moreover, the need to raise the rigidity of the respective sections of the moving section 250 is eliminated, enabling a reduction in size of the motor incorporated therein, and thereby enabling the overall configuration to be simplified. This enables a contribution to be made to reducing the size and reducing the power consumption.

Moreover, by combining the slide grooves 257 with the switches 258, the moving section 250 is capable of guiding the posts 236 from the movement regions 257A into the inclined regions 257B when moving the Scott-Russell section 230 toward the front, and is capable of guiding the posts 236 from the retracted regions 257E to the movement regions 257A when moving the Scott-Russell section 230 toward the rear. Namely, in the bundle conveyance unit 203, there is no need to actively switch the swing angle of the switch 258, and the posts 236 can be guided to appropriate regions according to their direction of progress using a simple configuration that utilizes the force applied from the posts 236 and force from the action of springs (not illustrated in the drawings).

Moreover, in the bundle conveyance unit 203, the banknote bundle SB is placed in a state on the fixed conveyance guide 223 in the pay-out port 226 to be taken by the user. Accordingly, the upper conveyor belt 21 and the lower conveyor belt 24 (FIG. 1) provided in the first exemplary embodiment can be omitted from the bundle conveyance unit 203, enabling the configuration to be simplified.

According to the above configuration, in the bundle conveyance unit 203 according to the third exemplary embodiment, the Scott-Russell section 230 is moved toward the front and toward the rear while moving the posts 236 along the slide grooves 257. When this is performed, the bundle conveyance unit 203 conveys the banknote bundle SB along the bundle conveyance path 203Y toward the front, and then causes the Scott-Russell body 231 to transition from the conveyance-enabled orientation to the retracted orientation, and then returns the Scott-Russell body 231 to the conveyance-enabled orientation at the front side of the banknote bundle SB, thereby switching from the forward conveyance state to the rearward conveyance state, enabling the banknote bundle SB to be moved along the bundle conveyance path 203Y toward the rear. Accordingly, the bundle conveyance unit 203 enables the conveyance direction of the banknote bundle SB to be switched from forward to rearward without providing a motive power source to the Scott-Russell section 230, which moves in the front-rear direction.

4. Fourth Exemplary Embodiment 4-1. Scott-Russell Section and Moving Section Configuration In a fourth exemplary embodiment, the banknote bundle SB is conveyed in the front-rear direction along a bundle conveyance path 303Y by a bundle conveyance unit 303 illustrated in FIG. 12A and FIG. 12B, corresponding to FIG. 8A and FIG. 8B, instead of by the bundle conveyance unit 203 of the third exemplary embodiment. The bundle conveyance unit 303 differs from the bundle conveyance unit 203 in the point that a Scott-Russell mechanism 328 is provided instead of the Scott-Russell mechanism 128. The Scott-Russell mechanism 328 is configured by a Scott-Russell section 330 and a moving section 350 instead of the Scott-Russell section 230 and the moving section 250 (FIGS. 8 and FIGS. 9) of the Scott-Russell mechanism 128.

Figure 12A:
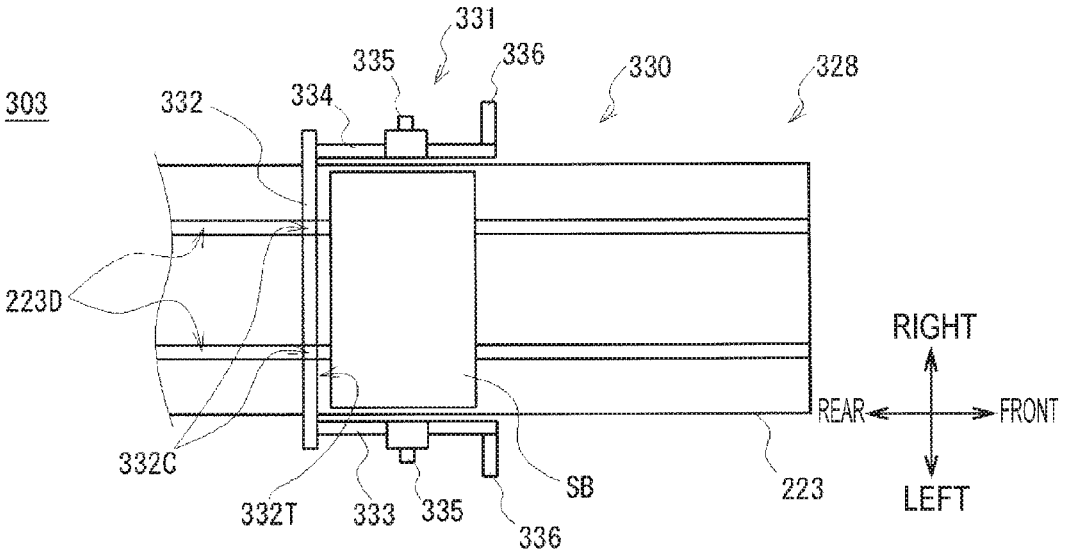
FIG. 12A is a schematic diagram illustrating configuration of a Scott-Russell section according to a fourth exemplary embodiment.
Figure 12B:
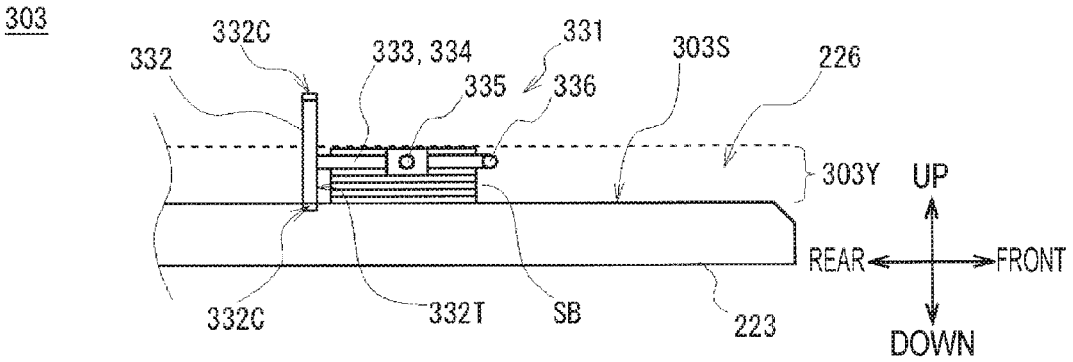
FIG. 12B is a schematic diagram illustrating configuration of a Scott-Russell section according to the fourth exemplary embodiment.

The Scott-Russell section 330 is configured by a Scott-Russell body 331 instead of the Scott-Russell body 231, and a support body 41 configured similarly to in the first and third exemplary embodiments. As illustrated in FIG. 12A and FIG. 12B, the Scott-Russell body 331 is configured by a Scott-Russell plate 332, a left arm 333, a right arm 334, swing shafts 335, and posts 336. Note that the support body 41 is omitted from illustration in FIG. 12A and FIG. 12B.

The Scott-Russell plate 332 extends further in the vertical direction than the Scott-Russell plate 232 according to the third exemplary embodiment (FIG. 8) so as to be approximately twice as long in the vertical direction. The Scott-Russell plate 332 includes claw-shaped portions 332C at a lower edge, similarly to the Scott-Russell plate 232 of the third exemplary embodiment, and also includes claw-shaped portions 332C at an upper edge.

In other words, the Scott-Russell plate 332 has a shape that would be obtained by producing two of the Scott-Russell plates 232, inverting one of the Scott-Russell plate 232 from top-to-bottom, and joining it to the upper edge of the other. In the following explanation, a face on the front side of the Scott-Russell plate 332 in the state illustrated in FIG. 12A and FIG. 12B is referred to as the abutting face 332T.

Similarly to the left arm 233 in the third exemplary embodiment, the left arm 333 is formed in a rod shape that is long in the front-rear direction and short in the vertical and left-right directions, and is positioned so as to extend forward and perpendicular to an vertical direction substantially central portion of the left end of the Scott-Russell plate 332. The right arm 334 is configured with left-right symmetry to the left arm 333.

The swing shafts 335 have the same shape as the swing shafts 235 according to the third exemplary embodiment, and extend outward toward the left and right from substantially the center of the left arm 333 and the right arm 334 in the front-rear direction. The swing shafts 335 are swingably supported by the support body 41 (FIGS. 2, etc.). The posts 336 have the same shape as the posts 236 according to the third exemplary embodiment, and extend outward toward the left and right from the vicinity of respective front ends of the left arm 333 and the right arm 334.

Figure 13:
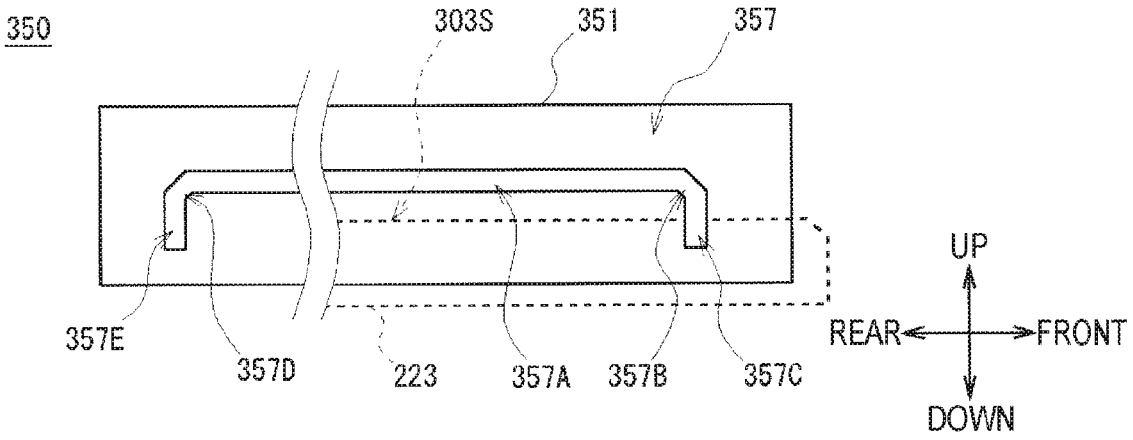
FIG. 13 is a schematic diagram illustrating configuration of a moving section according to the fourth exemplary embodiment.

The moving section 350 differs from the moving section 250 of the third exemplary embodiment (FIG. 9, etc.) in the point that it includes a left guide plate 351 and a right guide plate 352 instead of the left guide plate 251 and the right guide plate 252. The moving section 350 is similar to the moving section 250 in other respects. As illustrated in FIG. 13, the left guide plate 351 includes a slide groove 357 instead of the slide groove 257. The slide groove 357 is broadly divided into five regions of a movement region 357A, an inclined region 357B, a lift-up region 357C, an inclined region 357D, and a lift-up region 357E.

The movement region 357A is configured similarly to the movement region 57A according to the first exemplary embodiment and the movement region 257A according to the third exemplary embodiment. However, the movement region 357A is disposed so as to be slightly higher than a bundle conveyance face 303S, this being the upper face of the fixed conveyance guide 223. The inclined region 357B is connected to a front end of the movement region 357A, and is formed shorter, and lower at a front end, than the inclined region 257B of the third exemplary embodiment, for example, with the vertical incline inverted.

The lift-up region 357C is connected to a front lower end of the inclined region 357B, and is formed so as to head downward. The length of the lift-up region 357C in the vertical direction is, for example, the same as or longer than the length from the swing shaft 335 of the left arm 333 to the post 336. The inclined region 357D is connected to a rear end of the movement region 357A. The inclined region 357D and the lift-up region 357E are formed with front-rear symmetry to the inclined region 357B and the lift-up region 357C respectively.

Accordingly, in the slide groove 357, the front end of the movement region 357A running along the front-rear direction and an upper end of the lift-up region 357C running along the vertical direction are connected together by the inclined region 357B, and the rear end of the movement region 357A and an upper end of the lift-up region 357E running along the vertical direction are connected together by the inclined region 357D. Namely, the slide groove 357 has an overall shape resembling a letter U that has been stretched out along the left-right direction and turned upside-down. The right guide plate 352 includes a slide groove 357 similarly to the left guide plate 351.

4-2. Banknote Bundle Conveyance Operation

Next, explanation follows regarding a conveyance operation of the banknote bundle SB by the bundle conveyance unit 303. As illustrated in FIGS. 12, in a pay-out conveyance operation the bundle conveyance unit 303 uses the moving section 350 to move the Scott-Russell section 330 toward the front in a state in which the banknote bundle SB has been placed on the fixed conveyance guide 223, the Scott-Russell plate 332 has been positioned at the rear side of the banknote bundle SB, and the abutting face 332T of the Scott-Russell plate 332 faces toward the front.

When this is performed, the left and right posts 336 of the Scott-Russell body 331 of the Scott-Russell section 330 are in the movement regions 357A of the slide grooves 357, and since the abutting face 332T of the Scott-Russell plate 332 faces forward, a portion of the abutting face 332T abuts the banknote bundle SB so as to convey the banknote bundle SB toward the front by applying force toward the front. In the following, such an orientation of the Scott-Russell body 331 in which the abutting face 332T of the Scott-Russell plate 332 faces toward the front and is capable of conveying the banknote bundle SB toward the front is referred to as the forward conveyance-enabled orientation. Moreover, in the present exemplary embodiment, a state in which the Scott-Russell body 331 is in the forward conveyance-enabled orientation, and the Scott-Russell plate 332 is positioned at the rear side of the banknote bundle SB and is capable of conveying the banknote bundle SB toward the front is referred to as the forward conveyance state.

Figure 14A:
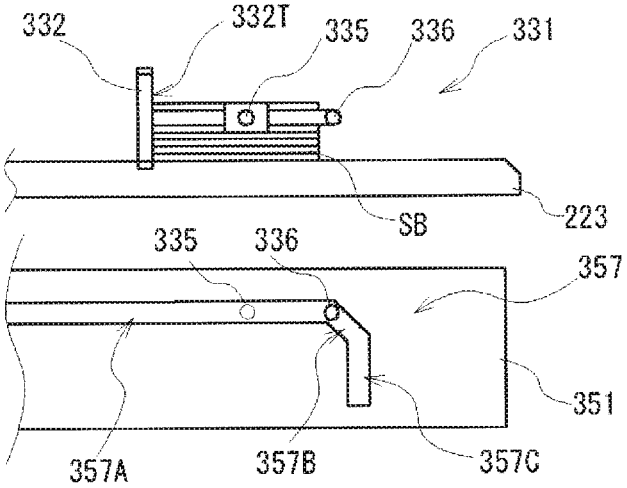
FIG. 14A is a schematic diagram illustrating a conveyance operation (1) of a banknote bundle according to the fourth exemplary embodiment.

As illustrated in FIG. 14A, in the bundle conveyance unit 303, the posts 336 reach the front end of the movement regions 357A. Note that similarly to in FIG. 10A and the like, the upper part of FIG. 14A illustrates the Scott-Russell body 331, and the lower part of FIG. 14A illustrates part of the left guide plate 351. At this stage, the bundle conveyance unit 303 ends the pay-out conveyance operation, and the banknote bundle SB placed on the fixed conveyance guide 223 in the pay-out port 226 can be taken by the user. Note that when a user forgets to take the banknote bundle SB, the bundle conveyance unit 303 commences the banknote bundle SB take-in conveyance operation.

First, the bundle conveyance unit 303 uses the moving section 350 to apply the Scott-Russell section 330 with force toward the front. When this is performed, the Scott-Russell body 331 of the Scott-Russell section 330 applies the swing shafts 335 with force toward the front, and this force is transmitted to the posts 336.

Figure 14B:
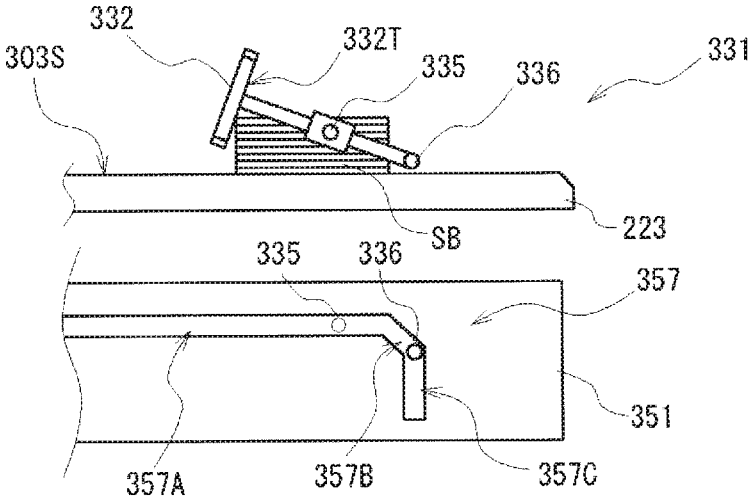
FIG. 14B is a schematic diagram illustrating a conveyance operation (1) of a banknote bundle according to the fourth exemplary embodiment.

Accordingly, the posts 336 gradually descend along the inclined regions 357B of the slide grooves 357, and reach the upper end of the lift-up regions 357C, as illustrated in FIG. 14B. Namely, the posts 336 are positioned lower than the swing shafts 335. In the Scott-Russell body 331, since the height of the support body 41 (FIGS. 2, etc.) is constant, the height of the swing shafts 335 is also constant. Accordingly, the Scott-Russell body 331 swings about the swing shafts 335 in the clockwise direction in the drawings, and the lower edge of the Scott-Russell plate 332 is lifted slightly up from the bundle conveyance face 303 S.

Figure 14C:
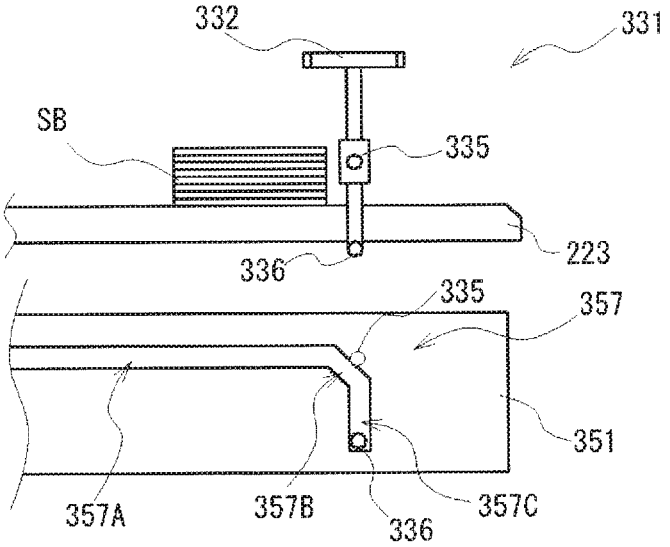
FIG. 14C is a schematic diagram illustrating a conveyance operation (1) of a banknote bundle according to the fourth exemplary embodiment.

The bundle conveyance unit 303 then uses the moving section 350 to apply the Scott-Russell section 330 with further force toward the front. When this is performed, although force from the support body 41 (FIGS. 2, etc.) side is transmitted to the Scott-Russell body 331 of the Scott-Russell section 330 through the swing shafts 335, since the lift-up region 357C of the slide grooves 357 runs in the vertical direction, the posts 336 are caused to descend so as to escape along the lift-up region 357C. Accordingly, since the posts 336 descend with respect to the swing shafts 335, the overall Scott-Russell body 331 swings in the clockwise direction in the drawings, and as illustrated in FIG. 14C, the Scott-Russell plate 332 adopts a state lifted so as to be substantially horizontal when the swing shafts 335 reach substantially directly above the posts 336 in the lift-up regions 357C. In the present exemplary embodiment, such an orientation in which the Scott-Russell plate 332 of the Scott-Russell body 331 is retracted from the bundle conveyance path 303Y is referred to hereafter as the retracted orientation.

Figure 15A:
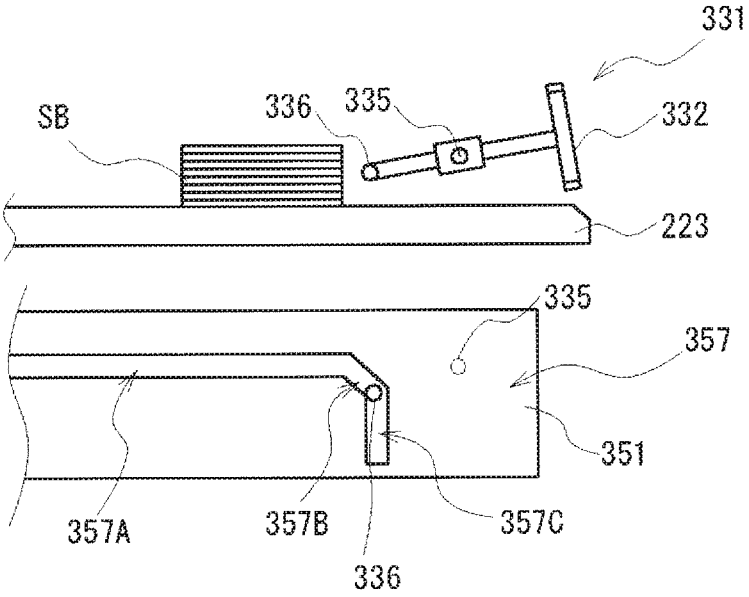
FIG. 15A is a schematic diagram illustrating a conveyance operation (2) of a banknote bundle according to the fourth exemplary embodiment.
Figure 15B:
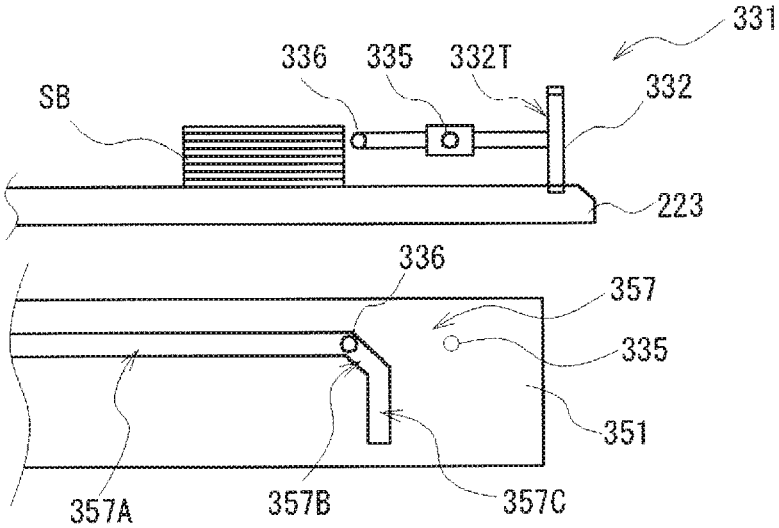
FIG. 15B is a schematic diagram illustrating a conveyance operation (2) of a banknote bundle according to the fourth exemplary embodiment.

The bundle conveyance unit 303 continues to use the moving section 350 to apply the Scott-Russell section 330 with force further toward the front. When this is performed, in the Scott-Russell body 331 of the Scott-Russell section 330, the swing shafts 335 are now positioned further toward the front than the posts 336, such that the posts 336 are pulled upward along the lift-up regions 357C accompanying the movement of the swing shafts 335 toward the front. The Scott-Russell body 331 accordingly further swings overall in the clockwise direction in the drawings, and as illustrated in FIG. 15A, at the stage that the posts 336 reach the upper ends of the lift-up regions 357C, the Scott-Russell plate 332 is positioned at the front side of the banknote bundle SB, and the abutting face 332T faces toward the rear.

In other words, in the Scott-Russell body 331, the swing shafts 335 are moved from the rear side to the front side of the posts 336 while movement of the posts 336 in the front-rear direction is restricted such that the posts 336 move only in the vertical direction. The Scott-Russell plate 332 can thus be moved from the rear side to the front side of the banknote bundle SB while performing half a rotation so as to stride over the banknote bundle SB.

Next, the bundle conveyance unit 303 uses the moving section 350 to apply the Scott-Russell section 330 with force toward the rear. When this is performed, the posts 336 reach the movement regions 357A via the inclined regions 357B, before moving further toward the rear. The overall Scott-Russell body 331 of the Scott-Russell section 330 accordingly moves toward to the rear in a state in which the claw-shaped portions 332C provided at the lower edge have been caused to enter the claw-guide grooves 223D (FIG. 12) of the fixed conveyance guide 223. The abutting face 332T abuts the front face of the banknote bundle SB, conveying the banknote bundle SB toward the rear. In the following explanation, this orientation, in which the abutting face 332T of the Scott-Russell plate 332 of the Scott-Russell body 331 faces toward the rear and is capable of conveying the banknote bundle SB toward the rear is referred to as the rearward conveyance-enabled orientation. Moreover, in the present exemplary embodiment, this state in which the Scott-Russell body 331 is in the rearward conveyance-enabled orientation and the Scott-Russell plate 332 is positioned at the rear side of the banknote bundle SB and is capable of conveying the banknote bundle SB toward the rear is referred to as the rearward conveyance state.

In this manner, the bundle conveyance unit 303 is capable of utilizing the lift-up region 357C to switch the Scott-Russell body 331 from the forward conveyance state to the rearward conveyance state, and switch the conveyance direction of the banknote bundle SB from toward the front to toward the rear. From another perspective, the inclined region 357B and the lift-up region 357C of the slide groove 357 configure regions to cause the Scott-Russell body 331 to transition from the forward conveyance-enabled orientation to the retracted orientation, and then to the rearward conveyance-enabled orientation. The inclined region 357B and the lift-up region 357C are also referred to collectively as the retraction region hereafter.

When the bundle conveyance unit 303 finally brings the banknote bundle SB as far as the rear end of the fixed conveyance guide 223, the banknote bundle SB is caused to fall into the intake hole 17H (FIG. 1), to be stored inside the reject storage box 17. The bundle conveyance unit 303 then moves the Scott-Russell section 330 further toward the rear, and moves the posts 336 as far as the rear ends of the movement region 357A. Note that the bundle conveyance unit 303 utilizes the inclined region 357D and the lift-up region 357E to perform an operation with front-rear symmetry to when utilizing the inclined region 357B and the lift-up region 357C, such that the Scott-Russell plate 332 of the Scott-Russell body 331 is rotated halfway in the counterclockwise direction, to return to the forward conveyance-enabled orientation in which the abutting face 332T faces toward the front. The bundle conveyance unit 303 is thus in a state prepared for the next pay-out conveyance operation, and ends the take-in conveyance operation.

Note that if the banknote bundle SB is taken by the user in the state illustrated in FIG. 14A, the bundle conveyance unit 303 moves the Scott-Russell section 330 toward the rear side while still in the forward conveyance-enabled orientation, thus preparing for the next pay-out conveyance operation.

In the above configuration, in the bundle conveyance unit 303 according to the fourth exemplary embodiment the left guide plate 351 and the right guide plate 352 are provided with the slide grooves 357. The posts 336 provided on the opposite side of the swing shafts 335 to the Scott-Russell plate 332 are inserted through the slide grooves 357. The slide grooves 357 are provided with the inclined regions 357B and 357D at both the front and rear ends of the movement region 357A that runs along the front-rear direction, and the lift-up regions 357C and 357E that run along the vertical direction are connected at the lower sides.

The bundle conveyance unit 303 uses the moving section 350 to move the Scott-Russell section 330 toward the front, thereby moving the posts 336 from the movement regions 357A through the inclined regions 357B and into the lift-up regions 357C. When this is performed, the relative positions of the posts 336 with respect to the swing shafts 335 change from the front side to the rear side in the Scott-Russell section 330, accompanying which the Scott-Russell plate 332 is rotated halfway so as to be lifted up and moved from the rear side to the front side of the banknote bundle SB.

Namely, the bundle conveyance unit 303 is capable of moving the Scott-Russell plate 332 from the rear side to the front side of the banknote bundle SB, namely is capable of switching from the forward conveyance state to the rearward conveyance state and switching the conveyance direction of the banknote bundle SB from toward the front to toward the rear, simply by moving the Scott-Russell section 330 toward the front. When this is performed, the bundle conveyance unit 303 is capable of moving the posts 336 in the vertical direction along the lift-up region 357C of the slide groove 357, such that there is no need to provide the Scott-Russell section 330 with another motive power source to lift up and place the Scott-Russell plate 332 in the retracted orientation.

Similarly to in the first and the third exemplary embodiments, the bundle conveyance unit 303 enables suppression to a lower weight and configuration to be made simpler in comparison to a case in which a motive power source such as a motor is incorporated in the moving Scott-Russell section 330. Moreover, the need to raise the rigidity of the respective sections of the moving section 350 is eliminated, enabling a reduction in size of the motor incorporated therein, and thereby enabling the overall configuration to be simplified. This enables a contribution to be made to reducing the size and reducing the power consumption.

According to the above configuration, the bundle conveyance unit 303 according to the fourth exemplary embodiment moves the Scott-Russell section 330 toward the front or toward the rear while moving the posts 336 along the slide groove 357. When this is performed, the bundle conveyance unit 303 conveys the banknote bundle SB along the bundle conveyance path 303Y toward the front, after which the Scott-Russell body 331 is caused to transition from the forward conveyance-enabled orientation to the rearward conveyance-enabled orientation, and then caused to further transition to the rearward conveyance-enabled orientation at the front side of the banknote bundle SB so as to switch from the forward conveyance state to the rearward conveyance state, enabling the banknote bundle SB to be conveyed along the bundle conveyance path 303Y toward the rear. The bundle conveyance unit 303 is thereby capable of switching the conveyance direction of the banknote bundle SB from toward the front to toward the rear without providing a motive power source to the Scott-Russell section 330 that moves along the front-rear direction.

Figure 16A:
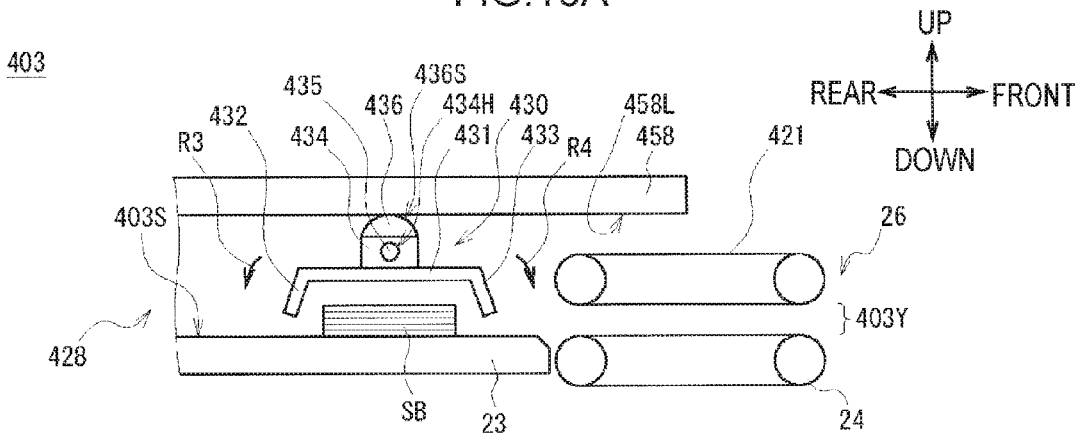
FIG. 16A is a schematic diagram illustrating configuration of a bundle conveyance unit according to a fifth exemplary embodiment.
Figure 16B:
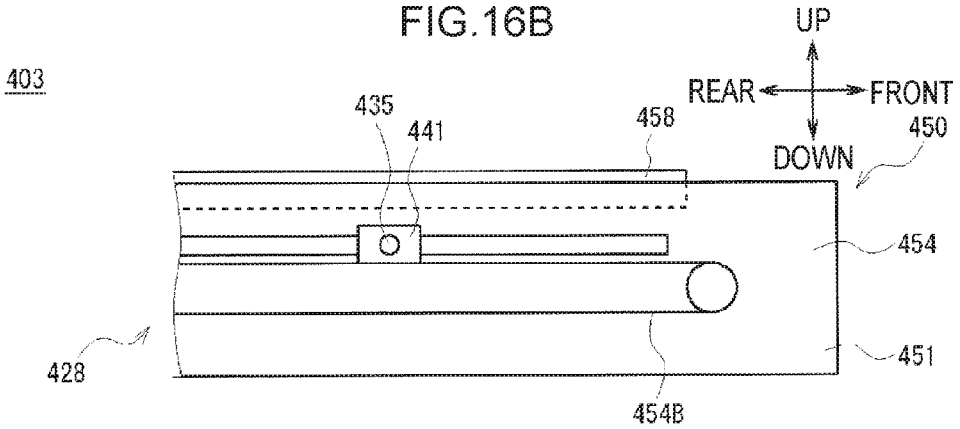
FIG. 16B is a schematic diagram illustrating configuration of a bundle conveyance unit according to the fifth exemplary embodiment.
Figure 16C:
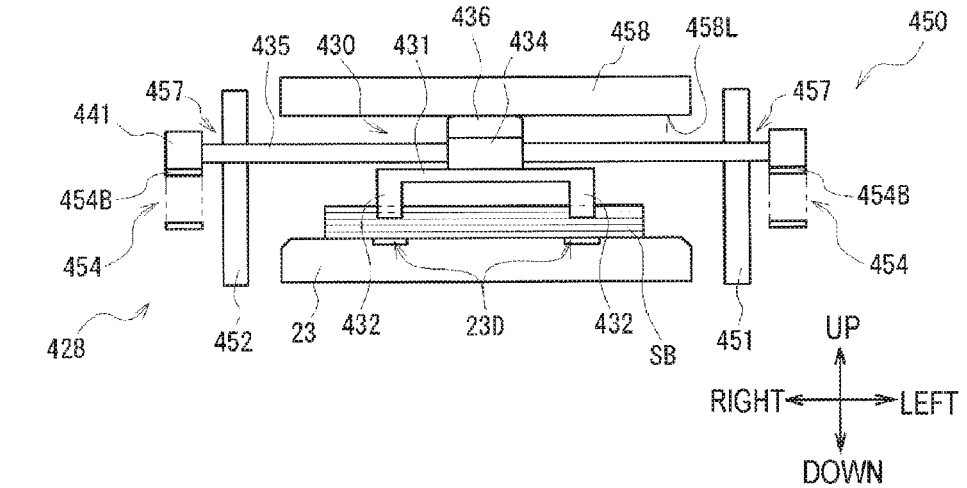
FIG. 16C is a schematic diagram illustrating configuration of a bundle conveyance unit according to the fifth exemplary embodiment.

5. Fifth Exemplary Embodiment 5-1. Scott-Russell Section and Moving Section Configuration In a fifth exemplary embodiment the banknote bundle SB is conveyed in the front-rear direction along a bundle conveyance path 403Y by a bundle conveyance unit 403 instead of by the bundle conveyance unit 3 of the first exemplary embodiment. As illustrated in FIG. 16A to FIG. 16C, the bundle conveyance unit 403 differs from the bundle conveyance unit 3 in the points that upper conveyor belts 421 and a Scott-Russell mechanism 428 are provided instead of the upper conveyor belts 21 and the Scott-Russell mechanism 28.

The upper conveyor belt 421 (FIG. 16A) is shorter in the front-rear direction than the upper conveyor belt 21 of the first exemplary embodiment (FIGS. 2), and is similar in length to the lower conveyor belt 24, and disposed substantially directly above the lower conveyor belt 24. The Scott-Russell mechanism 428 is configured by a Scott-Russell section 430 and a moving section 450 instead of the Scott-Russell section 30 and the moving section 50 of the Scott-Russell mechanism 28 (FIGS. 2, etc.).

The Scott-Russell section 430 differs greatly from the first to the fourth exemplary embodiments in that it covers the entire banknote bundle SB from the upper side. Specifically, the Scott-Russell section 430 is configured around a base 431 having a plate shape that is thin in the vertical direction. The length of the base 431 in the left-right direction is shorter than the long edge of a banknote, and the length of the base 431 in the front-rear direction is longer than the short edge of a banknote. Rear Scott-Russell plates 432 are respectively provided in the vicinity of both left and right ends of a rear edge of the base 431, and front Scott-Russell plates 433 are respectively provided in the vicinity of both left and right ends of a front edge of the base 431.

The rear Scott-Russell plates 432 are formed in thin plate shapes that are thin in the front-rear direction, have a left-right direction length sufficiently shorter than that of the base 431, and extend downward from the rear edge of the base 431. The front Scott-Russell plates 433 are configured with front-rear symmetry to the rear Scott-Russell plates 432, and extend downward from the front edge of the base 431. Note that the rear Scott-Russell plates 432 and the front Scott-Russell plates 433 correspond to the Scott-Russell plate 32 of the first exemplary embodiment (FIGS. 2, FIG. 3, etc.).

A shaft bearing portion 434 is provided in the vicinity of the front-rear and left-right center of an upper face of the base 431. The shaft bearing portion 434 is formed in a rectangular block shape with sufficiently shorter lengths in the front-rear direction and the left-right direction than those of the base 431. Circular shaft holes 434H are provided penetrating both left and right side faces of the shaft bearing portion 434 in the left-right direction in the vicinity of the center of the left and right side faces. A swing shaft 435 is inserted through the shaft holes 434H.

The swing shaft 435 is formed in a circular column shape with its center axis along the left-right direction, and has a longer length in the left-right direction than the fixed conveyance guide 23. The external diameter of the swing shaft 435 is slightly smaller than the diameter of the shaft holes 434H. Accordingly, the Scott-Russell section 430 is capable of swinging about the swing shaft 435 in the arrow R3 direction and the arrow R4 direction, namely in the clockwise direction and the counterclockwise direction in FIG. 16A.

A friction block 436 is attached to an upper face of the shaft bearing portion 434. The friction block 436 is configured by an elastic, high friction body such as rubber, and an upper curved face 436S is formed at an upper side of the friction block 436. As illustrated in FIG. 16A, the upper curved face 436S is formed in a circular arc shape with a common center to the shaft holes 434H and the swing shaft 435, as seen from the left-right direction. The upper curved face 436S of the friction block 436 is thereby capable of maintaining a constantly uniform height at its uppermost location, even when the Scott-Russell section 430 has swung about the swing shaft 435.

The moving section 450 is configured by a left guide plate 451, a right guide plate 452, drive belt sections 454, and an upper guide plate 458, as well as by a motor, gears, and the like, not illustrated in the drawings. The left guide plate 451 corresponds to the left guide plate 51 according to the first exemplary embodiment, and is formed in a plate shape that is thin in the left-right direction and long in the front-rear direction, and is provided with a slide groove 457. The slide groove 457 is formed in a straight line shape running along the front-rear direction, and has a groove width that is slightly larger than the external diameter of the swing shaft 435. The right guide plate 452 is configured with left-right symmetry to the left guide plate 451.

The drive belt sections 454 are disposed at the left side of the left guide plate 451 and at the right side of the right guide plate 452 respectively, and are configured similarly to the drive belt section 54 (FIG. 2) of the first exemplary embodiment so as to drive belts 454B. The swing shafts 435 are fixed to predetermined locations on the belts 454B through fixing members 441. Accordingly, the moving section 450 is capable of moving the swing shafts 435 in the front-rear direction, accompanying which the Scott-Russell section 430 is moved in the front-rear direction, by driving the respective belts 454B in the front-rear direction using the left and right drive belt sections 454.

The upper guide plate 458 is formed in a plate shape that is thin in the vertical direction and long in the front-rear direction. A lower face 458L of the upper guide plate 458 is substantially parallel to a bundle conveyance face 403S, this being the upper face of the fixed conveyance guide 23, and the separation between the lower face 458L and the bundle conveyance face 403S is substantially uniform between each location. In the Scott-Russell section 430, the height of a lower face 458L, serving as a guide face, or more specifically the position thereof in the vertical direction with respect to the slide grooves 457, is adjusted so as to abut an upper end of the friction block 436, namely the highest location on the upper curved face 436S.

In the moving section 450, the lower face 458L of the upper guide plate 458 is thus capable of abutting an apex portion of the friction block 436 in the Scott-Russell section 430, namely the highest location on the upper curved face 436S, at any position to which the Scott-Russell section 430 has been moved in the front-rear direction.

Note that as described above, the friction block 436 is configured from a high friction body, and so when the Scott-Russell section 430 is moved in the front-rear direction by the moving section 450, friction arises between the friction block 436 and the lower face 458L of the upper guide plate 458, and the overall Scott-Russell section 430 is swung by this friction.

Figure 17A:
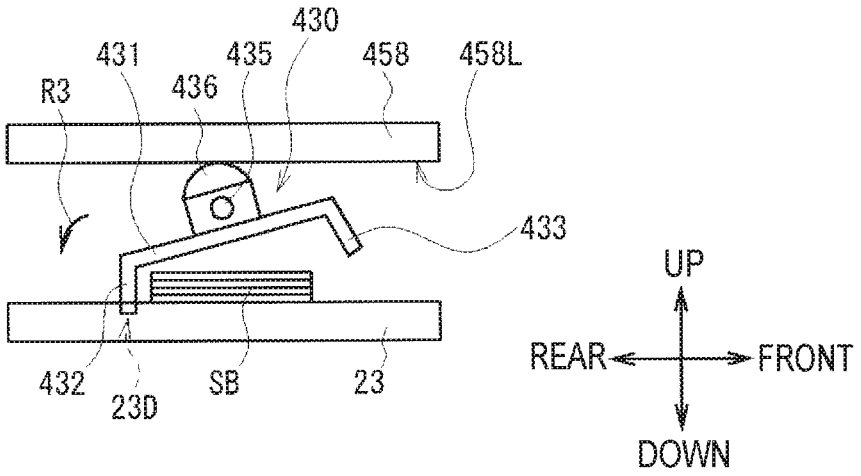
FIG. 17A is a schematic diagram illustrating a change in orientation of a Scott-Russell section according to the fifth exemplary embodiment.

For example, when the Scott-Russell section 430 is moved toward the front by the moving section 450, friction arises between the friction block 436 and the lower face 458L, and the friction block 436 attempts to rotate in the arrow R3 direction in FIG. 16A, namely in the counter-clockwise direction. Accordingly, as illustrated in FIG. 17A, in the Scott-Russell section 430, lower ends of the rear Scott-Russell plates 432 are caused to enter the claw-guide grooves 23D, and front faces of the rear Scott-Russell plates 432 abut the rear side of the banknote bundle SB. This orientation of the Scott-Russell section 430 is referred to hereafter as the forward conveyance orientation. When the Scott-Russell section 430 is moved further toward the front, swinging in the arrow R3 direction is restricted by a stopper, not illustrated in the drawings, and the Scott-Russell section 430 conveys the banknote bundle SB toward the front along the bundle conveyance path 403Y while maintaining the forward conveyance orientation.

Figure 17B:
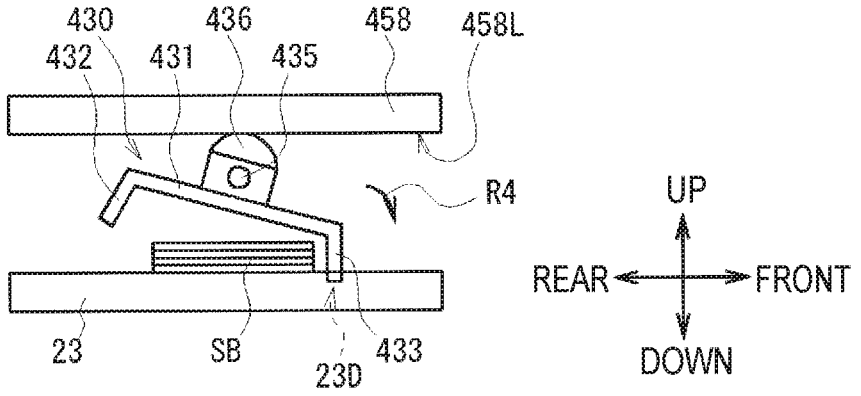
FIG. 17B is a schematic diagram illustrating a change in orientation of a Scott-Russell section according to the fifth exemplary embodiment.

Moreover, when the Scott-Russell section 430 is moved toward the rear by the moving section 450, friction arises between the friction block 436 and the lower face 458L, and the friction block 436 attempts to rotate in the arrow R4 direction in FIG. 16A, namely in the clockwise direction. Accordingly, as illustrated in FIG. 17B, in the Scott-Russell section 430, lower ends of the front Scott-Russell plates 433 are caused to enter the claw-guide grooves 23D, and rear faces of the front Scott-Russell plates 433 abut the front side of the banknote bundle SB. This orientation of the Scott-Russell section 430 is referred to hereafter as the rearward conveyance orientation. When the Scott-Russell section 430 is moved further toward the rear, swinging in the arrow R4 direction is restricted by a stopper, not illustrated in the drawings, and the Scott-Russell section 430 conveys the banknote bundle SB toward the rear along the bundle conveyance path 403Y while maintaining the rearward conveyance orientation.

In this manner, when the Scott-Russell section 430 is moved toward the front or toward the rear by the moving section 450 in a state positioned substantially directly above the banknote bundle SB, the Scott-Russell section 430 is swung by friction arising between the friction block 436 and the lower face 458L so as to adopt the forward conveyance orientation or the rearward conveyance orientation, enabling the banknote bundle SB to be conveyed toward the front or toward the rear. Note that for as long as the Scott-Russell section 430 is moving in the same direction, the Scott-Russell section 430 moves while maintaining its orientation (forward conveyance orientation or rearward conveyance orientation) due to the friction arising between the friction block 436 and the lower face 458L.

5-2. Banknote Bundle Conveyance Operation

Next, explanation follows regarding a conveyance operation of the banknote bundle SB by the bundle conveyance unit 403. As illustrated in FIG. 17A, in a pay-out conveyance operation of the bundle conveyance unit 303, the banknote bundle SB is placed on the fixed conveyance guide 23, and the Scott-Russell section 430 is positioned at the upper side of the banknote bundle SB in the forward conveyance orientation.

Figure 18A:
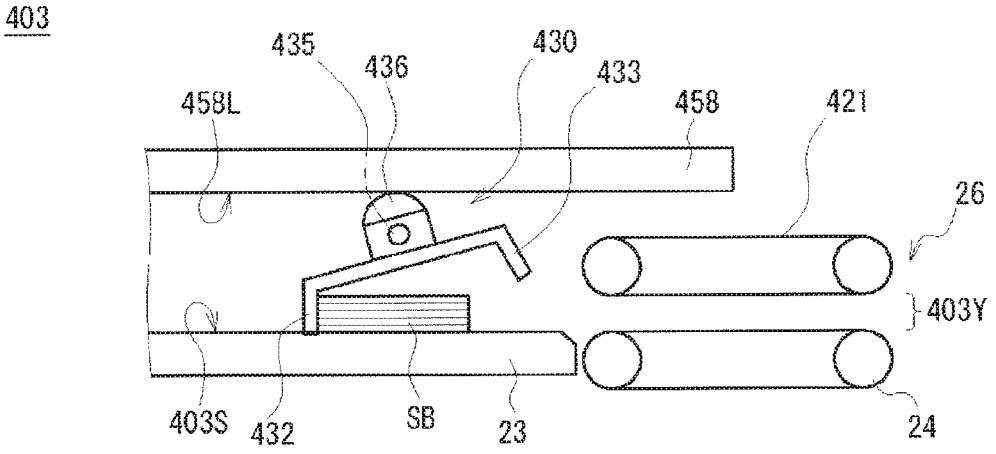
FIG. 18A is a schematic diagram illustrating a conveyance operation (1) of a banknote bundle according to the fifth exemplary embodiment.

The bundle conveyance unit 403 uses the moving section 450 to move the Scott-Russell section 430 toward the front, such that as illustrated in FIG. 18A, the banknote bundle SB is conveyed toward the front by the rear Scott-Russell plates 432 with the Scott-Russell section 430 maintained in the forward conveyance orientation.

Figure 18B:
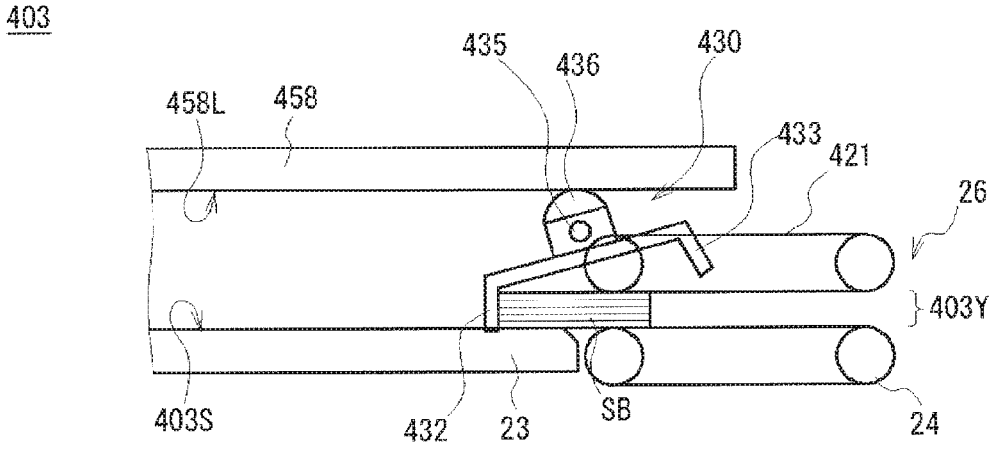
FIG. 18B is a schematic diagram illustrating a conveyance operation (1) of a banknote bundle according to the fifth exemplary embodiment.

When the bundle conveyance unit 403 detects with a sensor, not illustrated in the drawings, that a front side portion of the banknote bundle SB is sandwiched between the upper conveyor belt 421 and the lower conveyor belt 24, as illustrated in FIG. 18B, the bundle conveyance unit 403 stops the movement of the Scott-Russell section 430 by the moving section 450.

Figure 18C:
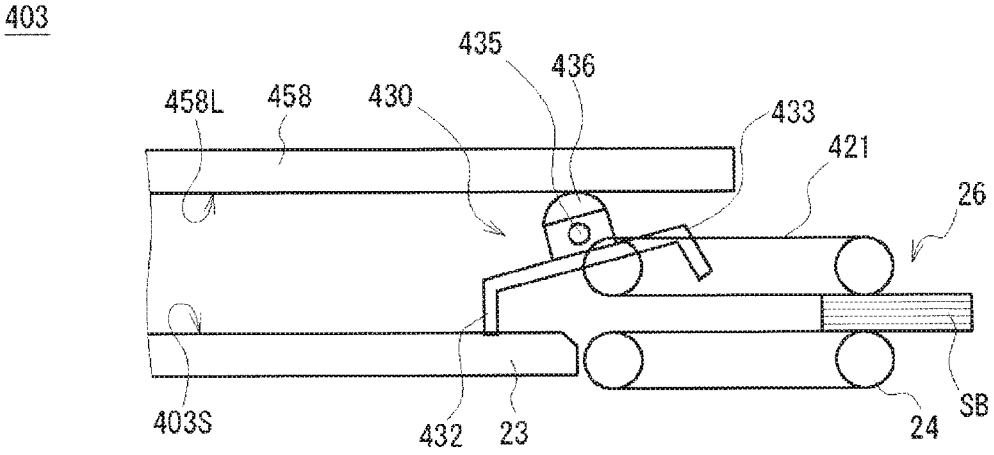
FIG. 18C is a schematic diagram illustrating a conveyance operation (1) of a banknote bundle according to the fifth exemplary embodiment.

Next, the bundle conveyance unit 403 drives the upper conveyor belt 421 and the lower conveyor belt 24 toward the front respectively, thereby conveying the banknote bundle SB toward the front. The bundle conveyance unit 403 thus grips the rear side of the banknote bundle SB with the upper conveyor belt 421 and the lower conveyor belt 24, as illustrated in FIG. 18C which corresponds to FIG. 4C, to adopt a state in which the front side of the banknote bundle SB is exposed in the pay-out port 26, and the user is prompted to take the banknote bundle SB.

Note that when a user forgets to take the banknote bundle SB, the bundle conveyance unit 403 commences the banknote bundle SB take-in conveyance operation. First, the bundle conveyance unit 403 drives the upper conveyor belt 421 and the lower conveyor belt 24 toward the rear, thereby conveying the banknote bundle SB toward the rear along the bundle conveyance path 403Y, and the banknote bundle SB is moved to substantially directly below the Scott-Russell section 430, similarly to as illustrated in FIG. 18B.

Figure 19:
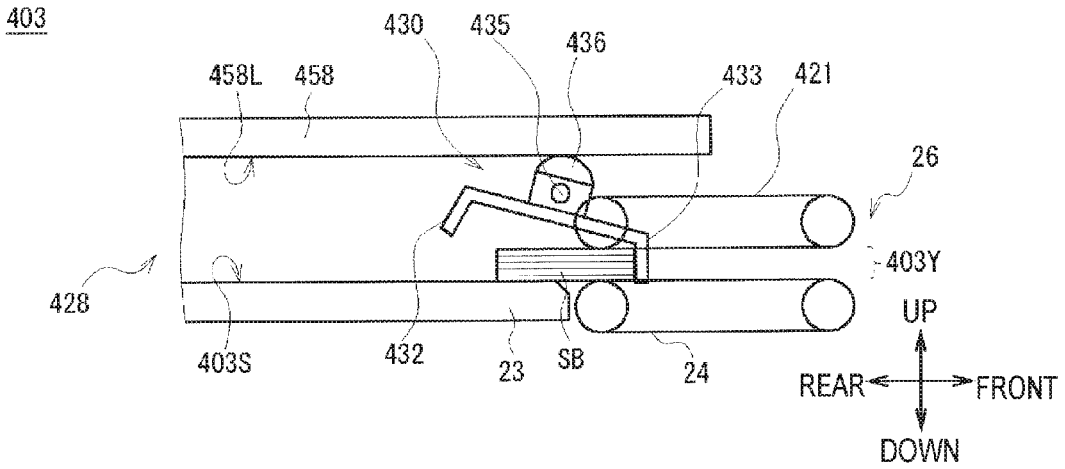
FIG. 19 is a schematic diagram illustrating a conveyance operation (2) of a banknote bundle according to the fifth exemplary embodiment.

Next, the bundle conveyance unit 403 uses the moving section 450 to apply the Scott-Russell section 430 in the forward conveyance orientation with force toward the rear. When this is performed, the Scott-Russell section 430 is applied with force toward the rear by the swing shaft 435, and swings in the arrow R4 direction (FIG. 16A) due to the friction arising between the friction block 436 and the lower face 458L to adopt the rearward conveyance orientation, as illustrated in FIG. 19.

The bundle conveyance unit 403 then uses the moving section 450 to move the Scott-Russell section 430 toward the rear, such that the banknote bundle SB is conveyed toward the rear by the front Scott-Russell plates 433 with the Scott-Russell section 430 maintained in the rearward conveyance orientation.

When the bundle conveyance unit 403 finally brings the banknote bundle SB as far as the rear end of the fixed conveyance guide 23, the banknote bundle SB is caused to fall into the intake hole 17H (FIG. 1), to be stored inside the reject storage box 17. The bundle conveyance unit 403 then moves the Scott-Russell section 430 to the rearmost position and then moves the Scott-Russell section 430 slightly toward the front side. The Scott-Russell section 430 is thereby returned to the forward conveyance orientation (FIG. 17A) and prepared for the next pay-out conveyance operation, and the take-in conveyance operation is then ended.

Note that if the banknote bundle SB is taken by the user in the state illustrated in FIG. 18C, similarly to when the banknote bundle SB has been forgotten, the bundle conveyance unit 403 moves the Scott-Russell section 430 to the rearmost position and then moves the Scott-Russell section 430 slightly toward the front side. The Scott-Russell section 430 is thereby returned to the forward conveyance orientation and prepared for the next pay-out conveyance operation, and the take-in conveyance operation is then ended.

In the above configuration, the bundle conveyance unit 403 according to the fifth exemplary embodiment is provided with the rear Scott-Russell plates 432 and the front Scott-Russell plates 433 at the rear side and the front side of the Scott-Russell section 430 respectively, such that the entire Scott-Russell section 430 is swung about the swing shaft 435, and the friction block 436 is caused to abut the lower face 458L of the upper guide plate 458.

The bundle conveyance unit 403 uses the friction arising between the upper curved face 436S of the friction block 436 and the lower face 458L of the upper guide plate 458 to change the orientation of the Scott-Russell section 430 to the forward conveyance orientation or the rearward conveyance orientation (FIG. 17) accompanying the movement direction of the Scott-Russell section 430 by the moving section 450, and conveys the banknote bundle SB toward the front or toward the rear.

Namely, the bundle conveyance unit 403 changes the orientation of the Scott-Russell section 430, enabling the conveyance direction of the banknote bundle SB to be switched to toward the front or toward the rear, simply by switching the direction in which the Scott-Russell section 430 is moved by the moving section 450. When this is performed, the bundle conveyance unit 403 utilizes the friction arising between the upper curved face 436S and the lower face 458L, such that there is no need to provide a separate motive power source to swing the Scott-Russell section 430.

Similarly to in the first to the fourth exemplary embodiments, the bundle conveyance unit 403 enables suppression to a lower weight and configuration to be made simpler in comparison to a case in which a motive power source such as a motor is incorporated in the moving Scott-Russell section 430. Moreover, the need to raise the rigidity of the respective sections of the moving section 450 is eliminated, enabling a reduction in size of the motor incorporated therein, and thereby enabling the overall configuration to be simplified. This enables a contribution to be made to size reduction and power consumption reduction.

In particular, in the bundle conveyance unit 403, the shape of the upper curved face 436S of the friction block 436 of the Scott-Russell section 430 as viewed along the left-right direction is configured in a circular arc shape centered on the swing shaft 435, and the lower face 458L of the upper guide plate 458 is formed so as to be flattened along the front-rear direction.

Accordingly, in the bundle conveyance unit 403, the upper curved face 436S of the friction block 436 is capable of abutting the lower face 458L of the upper guide plate 458 at all times, irrespective of the orientation of the Scott-Russell section 430 when the Scott-Russell section 430 is being moved in the front-rear direction by the moving section 450. Accordingly, the bundle conveyance unit 403 can be maintained in a fixed orientation for a duration in which the movement direction of the Scott-Russell section 430 by the moving section 450 remains unchanged, thereby enabling stable conveyance of the banknote bundle SB by the rear Scott-Russell plates 432 or the front Scott-Russell plates 433.

Moreover, in the bundle conveyance unit 403, as long as the upper curved face 436S is abutting the lower face 458L, no matter what the position, the orientation of the Scott-Russell section 430 can be switched to the forward conveyance orientation or to the rearward conveyance orientation simply by reversing the movement direction of the Scott-Russell section 430. Accordingly, if, for example, an issue occurs partway through pay-out conveyance processing, the bundle conveyance unit 403 is capable of switching the conveyance direction of banknotes being conveyed along the bundle conveyance path 403Y at any location thereof, so as to convey the banknotes toward the rear without having to convey the banknotes toward the front as far as the pay-out port 26.

Moreover, when the Scott-Russell section 430 is conveying the banknote bundle SB in the forward conveyance orientation (FIG. 17A), the rear Scott-Russell plates 432 abut the rear side of the banknote bundle SB, the base 431 is tilted at the upper side of the banknote bundle SB, and the front Scott-Russell plates 433 is positioned diagonally in front of and above the banknote bundle SB. The Scott-Russell section 430 can thereby restrain floating up of any banknotes from the banknote bundle SB during conveyance to within a certain range. The similar applies when in the rearward conveyance orientation (FIG. 17B).

According to the above configuration, the bundle conveyance unit 403 according to the fifth exemplary embodiment is provided with the rear Scott-Russell plates 432 and front Scott-Russell plates 433 at the rear side and the front side of the Scott-Russell section 430, respectively, and the upper curved face 436S of the friction block 436 disposed at the upper side of the swing shaft 435 abuts the lower face 458L of the upper guide plate 458. Accordingly, the bundle conveyance unit 403 is capable of using the friction arising between the upper curved face 436S and the lower face 458L to change the Scott-Russell section 430 to the forward conveyance orientation or the rearward conveyance orientation according to the direction of movement by the moving section 450, enabling the banknote bundle SB to be conveyed toward the front or toward the rear. The bundle conveyance unit 403 is thereby capable of switching the conveyance direction of the banknote bundle SB to toward the front or toward the rear without providing a motive power source to the Scott-Russell section 430, which moves in the front-rear direction.

6. Sixth Exemplary Embodiment

Figure 20:
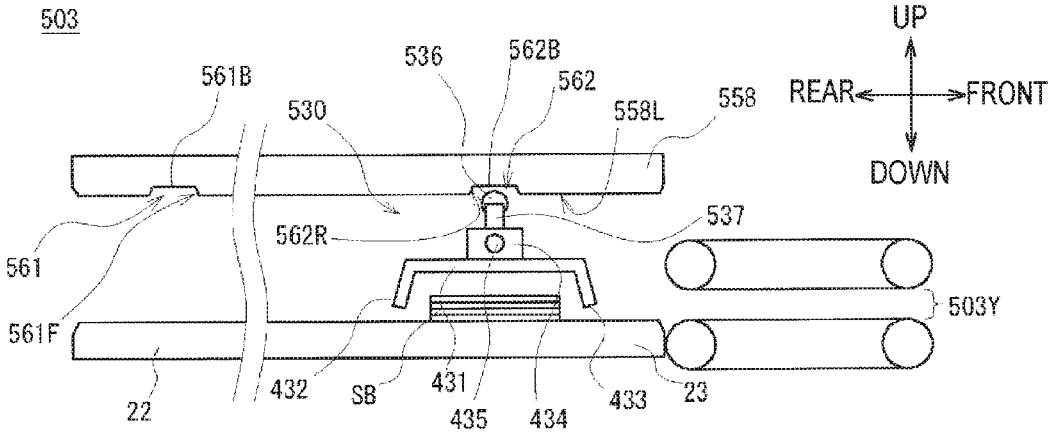
FIG. 20 is a schematic diagram illustrating a configuration of a bundle conveyance unit according to a sixth exemplary embodiment.

In a sixth exemplary embodiment, the banknote bundle SB is conveyed in the front-rear direction along a bundle conveyance path 503Y by a bundle conveyance unit 503 as illustrated in FIG. 20, which corresponds to FIG. 16A, instead of by the bundle conveyance unit 403 of the fifth exemplary embodiment. The bundle conveyance unit 503 differs from the bundle conveyance unit 403 in the point that a Scott-Russell mechanism 528 is provided instead of the Scott-Russell mechanism 428. The Scott-Russell mechanism 528 includes a Scott-Russell section 530 and a moving section 550 instead of the Scott-Russell section 430 and the moving section 450.

The Scott-Russell section 530 differs from the Scott-Russell section 430 according to the fifth exemplary embodiment in the point that the Scott-Russell section 530 includes a roller 536 and a roller support section 537 at the upper side of the shaft bearing portion 434 instead of the friction block 436. The Scott-Russell section 530 is configured similarly to the Scott-Russell section 430 in other respects.

The roller 536 is formed in a small circular column shape with its center axis running in the left-right direction. The roller support section 537 is attached to an upper face of the shaft bearing portion 434 and rotatably supports the roller 536. Note that the height of an upper end portion of the roller 536 is slightly higher than the highest location of the friction block 436 (FIG. 16A) of the fifth exemplary embodiment when the base 431 of the Scott-Russell section 530 is substantially horizontal (FIG. 20; referred to below as the horizontal orientation).

The shape, attachment position, and the like of the roller support section 537 are adjusted such that the roller 536 is positioned substantially directly above the swing shaft 435 when the Scott-Russell section 530 is in the horizontal orientation. Accordingly, the height of the highest location of the roller 536 is highest when the Scott-Russell section 530 is in the horizontal orientation, and becomes lower than this when, for example, the base 431 is tilted in the forward conveyance orientation or the rearward conveyance orientation.

Moreover, the Scott-Russell section 530 is assembled with a spring, not illustrated in the drawings, in the vicinity of the swing shaft 435 and shaft bearing portion 434. Force from this spring acts in a direction to return the Scott-Russell section 530 to the horizontal orientation when the Scott-Russell section 530 has been swung away from the horizontal orientation.

The moving section 550 differs from the moving section 450 according to the fifth exemplary embodiment in the point that an upper guide plate 558 is provided instead of the upper guide plate 458. The moving section 550 is configured similarly to the moving section 450 in other respects. The upper guide plate 558 is, in addition to configuration similar to the upper guide plate 458, further formed with respective cavities 561 and 562 in the vicinity of a front end, and in the vicinity of a rear end, of a lower face 558L. When the Scott-Russell section 530 is in the horizontal orientation, an upper end of the roller 536 is higher than the lower face 558L of the upper guide plate 558, and lower than lower faces 561B and 562B of the cavities 561 and 562.

Accordingly, when the roller 536 is directly below the lower face 558L, namely positioned directly below a portion other than the cavity 561 or 562, the roller 536 abuts the lower face 558L and the Scott-Russell section 530 swings away from the horizontal orientation about the swing shaft 435. The Scott-Russell section 530 accordingly adopts the forward conveyance orientation illustrated in FIG. 21A or the rearward conveyance orientation illustrated in FIG. 21B. When this occurs, the upper end of the roller 536 abuts the lower face 558L. Moreover, in the Scott-Russell section 530, when the swing shaft 435 is positioned directly below the cavity 561 or 562, the upper end of the roller 536 is positioned inside the cavity 561 or 562, enabling the base 431 to become substantially horizontal.

Figure 21A:
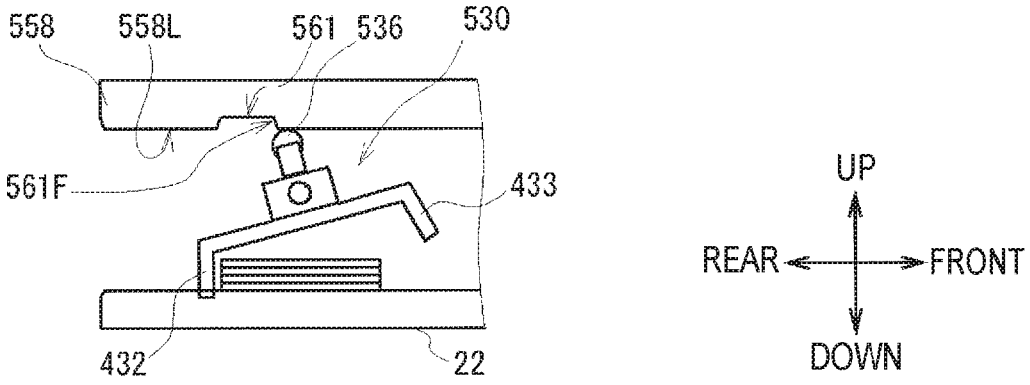
FIG. 21A is a schematic diagram illustrating a change in orientation of a Scott-Russell section according to the sixth exemplary embodiment.

For example, in the bundle conveyance unit 503, in a state in which the Scott-Russell section 530 is positioned substantially directly below the cavity 561 and the upper end of the roller 536 has been caused to enter the cavity 561, namely in the horizontal orientation, the Scott-Russell section 530 is moved toward the front by the moving section 550. When this is performed, in the Scott-Russell section 530, the roller 536 abuts a front side edge 561F of the cavity 561, such that the roller 536 swings about the swing shaft 435 to tilt in a direction downward and toward the rear, and the rear Scott-Russell plates 432 descend to adopt the forward conveyance orientation (FIG. 21A).

Moreover, when the Scott-Russell section 530 has been moved further toward the front by the moving section 550 in this state, due to the action of the spring, not illustrated in the drawings, the upper edge of the roller 536 that is being rotated continues to abut the lower face 558L, and moves toward the front while maintaining the forward conveyance orientation. When this occurs, if the banknote bundle SB is substantially directly below the Scott-Russell section 530, then as illustrated in FIG. 21A, the rear Scott-Russell plates 432 abut the rear side of the banknote bundle SB, and the banknote bundle SB can be conveyed toward the front.

Figure 21B:
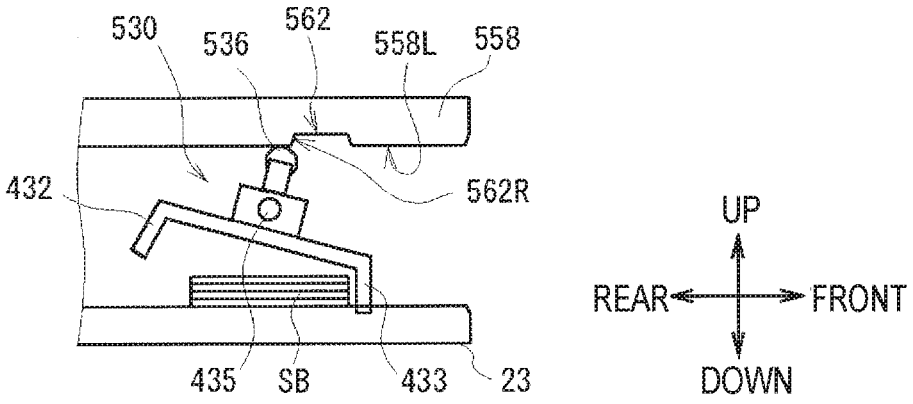
FIG. 21B is a schematic diagram illustrating a change in orientation of a Scott-Russell section according to the sixth exemplary embodiment.

Moreover, in the bundle conveyance unit 503, in a state in which the Scott-Russell section 530 is positioned substantially directly below the cavity 562 and the upper end of the roller 536 has been caused to enter the cavity 562, namely in the horizontal orientation, the Scott-Russell section 530 is moved toward the rear by the moving section 550. When this is performed, in the Scott-Russell section 530, the roller 536 abuts a rear side edge 562R of the cavity 562, such that the roller 536 swings downward toward the front in a tilting-over direction about the swing shaft 435, and the front Scott-Russell plates 433 descend to adopt the rearward conveyance orientation (FIG. 21B).

Moreover, when the Scott-Russell section 530 has been moved further toward the rear by the moving section 550 in this state, due to the action of the spring, not illustrated in the drawings, the upper edge of the roller 536 that is being rotated continues to abut the lower face 558L, and moves toward the rear while maintaining the rearward conveyance orientation. When this occurs, if the banknote bundle SB is substantially directly below the Scott-Russell section 530, then as illustrated in FIG. 21B, the front Scott-Russell plates 433 abut the front side of the banknote bundle SB, and the banknote bundle SB can be conveyed toward the rear.

Namely, in the bundle conveyance unit 503, in a state in which the roller 536 is positioned in the cavity 561 or 562, when the direction of progress of the Scott-Russell section 530 has been switched by the moving section 550, the orientation of the Scott-Russell section 530 is changed to the forward conveyance orientation or the rearward conveyance orientation, enabling the conveyance direction of the banknote bundle SB to be switched and enabling the banknote bundle SB to be conveyed in this state.

In the bundle conveyance unit 503, similarly to as illustrated in FIGS. 17 and FIGS. 18 for the bundle conveyance unit 403 of the fifth exemplary embodiment, the Scott-Russell section 530 is moved toward the front or toward the rear by the moving section 550, enabling pay-out conveyance processing and take-in conveyance processing to be performed.

In the above configuration, the bundle conveyance unit 503 according to the sixth exemplary embodiment is formed with the two cavities 561 and 562 in the lower face 558L of the upper guide plate 558, and the upper end of the roller 536 is higher than the lower face 558L when the Scott-Russell section 530 is in the horizontal orientation.

Accordingly in the bundle conveyance unit 503, when the roller 536 is abutting the lower face 558L, the Scott-Russell section 530 can be moved while maintaining the forward conveyance orientation or the rearward conveyance orientation, enabling the banknote bundle SB to be conveyed along the bundle conveyance path 503Y toward the front or toward the rear. Moreover in the bundle conveyance unit 503, the Scott-Russell section 530 is moved toward the front or toward the rear, and when the upper end of the roller 536 is positioned inside the cavity 561 or 562, the Scott-Russell section 530 returns to the horizontal orientation (FIG. 20). Moreover, reversing the direction of progress enables switching between the forward conveyance orientation and the rearward conveyance orientation.

When this is performed, in the bundle conveyance unit 503, the roller 536 abuts the front side edge 561F of the cavity 561 or the rear side edge 562R of the cavity 562 and a force acts on the Scott-Russell section 530, and so these is no need to provide a separate motive power source to swing the Scott-Russell section 530. Accordingly, similarly to in the first to the fifth exemplary embodiments, the bundle conveyance unit 503 enables suppression to a lower weight and configuration to be made simpler in comparison to a case in which a motive power source such as a motor is incorporated in the moving Scott-Russell section 530. Moreover, the need to raise the rigidity of the respective sections of the moving section 550 is eliminated, enabling a reduction in size of the motor incorporated therein, and thereby enabling the overall configuration to be simplified. This enables a contribution to be made to size reduction and power consumption reduction.

In particular, in the Scott-Russell section 530, the roller 536 is rotatably supported by the roller support section 537, and the roller 536 causes hardly any friction against the lower face 558L of the upper guide plate 558. Accordingly, the Scott-Russell section 530 can be moved smoothly while maintaining the orientation in which the roller 536 abuts the lower face 558L, namely the forward conveyance orientation or the rearward conveyance orientation (FIG. 21), and there is barely any need to consider age-related deterioration such as abrasion, thereby enabling stable conveyance of the banknote bundle SB.

Moreover, a force due to a spring, not illustrated in the drawings, acts on the Scott-Russell section 530 so as to attempt to return the Scott-Russell section 530 to the horizontal orientation. Accordingly, the roller 536 of the Scott-Russell section 530 can be actively made to abut the lower face 558L, enabling the forward conveyance orientation or the rearward conveyance orientation to be stably maintained. Moreover, the roller 536 of the Scott-Russell section 530 is actively caused to enter the cavity 561 or 562 due to the action of the spring, enabling the orientation to be reliably switched between the forward conveyance orientation and the rearward conveyance orientation when the direction of progress is switched.

According to the above configuration, in the bundle conveyance unit 503 of the sixth exemplary embodiment, the roller 536 positioned at the upper side of the swing shaft 435 of the Scott-Russell section 530 is made to abut the lower face 558L of the upper guide plate 558, or the upper end of the roller 536 is made to enter the cavity 561 or 562. The Scott-Russell section 530 is moved toward the front and rear with the roller 536 abutting the lower face 558L, thereby enabling the banknote bundle SB to be conveyed while maintaining the forward conveyance orientation or the rearward conveyance orientation. Moreover, the forward conveyance orientation and the rearward conveyance orientation can be changed by causing the roller 536 to enter the cavity 561 or 562 and switching the direction of progress. The bundle conveyance unit 503 is thereby capable of switching the conveyance direction of the banknote bundle SB to toward the front or toward the rear without providing a motive power source to the Scott-Russell section 530, which moves in the front-rear direction.

7. Seventh Exemplary Embodiment

Figure 22A:
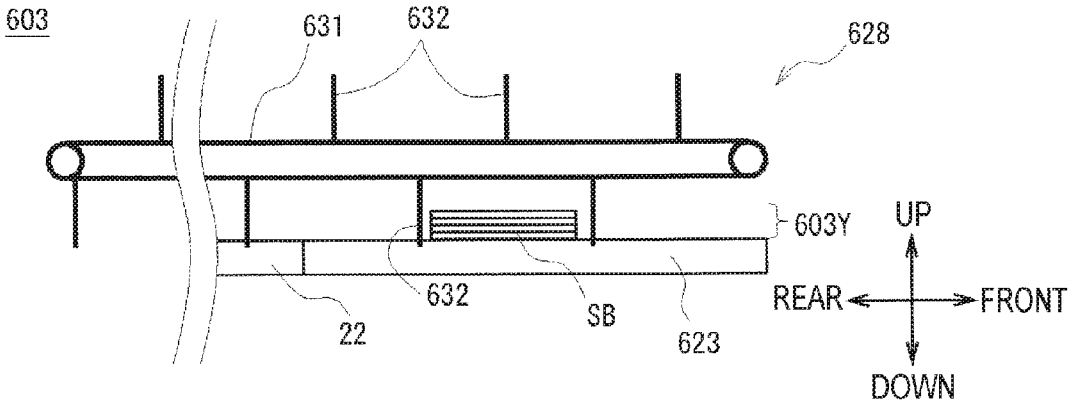
FIG. 22A is a schematic diagram illustrating configuration of a bundle conveyance unit according to a seventh exemplary embodiment.
Figure 22B:
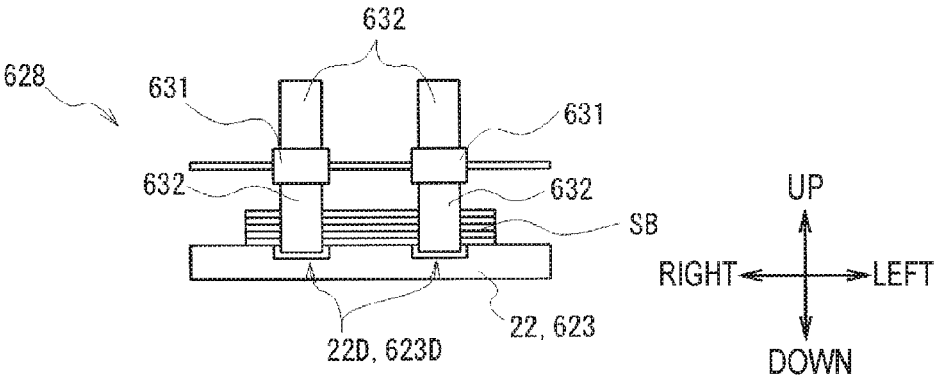
FIG. 22B is a schematic diagram illustrating configuration of a bundle conveyance unit according to the seventh exemplary embodiment.

In a seventh exemplary embodiment, the banknote bundle SB is conveyed in the front-rear direction along a bundle conveyance path 603Y by a bundle conveyance unit 603 instead of by the bundle conveyance unit 3 of the first exemplary embodiment. As illustrated in FIG. 22A and FIG. 22B that correspond to FIG. 2A and FIG. 2B, the bundle conveyance unit 603 differs from the bundle conveyance unit 3 in the point that the upper conveyor belt 21 and the lower conveyor belt 24 are omitted, and a fixed conveyance guide 623 and a Scott-Russell mechanism 628 are provided instead of the fixed conveyance guide 23 and the Scott-Russell mechanism 28.

The fixed conveyance guide 623 is configured similarly to the fixed conveyance guide 223 according to the third exemplary embodiment, and an upper face of the fixed conveyance guide 623 is formed with claw-guide grooves 623D. The Scott-Russell mechanism 628 is configured by a Scott-Russell belt 631 and Scott-Russell plates 632. The Scott-Russell belt 631 is configured similarly to the upper conveyor belts 21, and is entrained around rollers respectively disposed in the vicinity of a rear end and in the vicinity of a front end of the Scott-Russell belt 631. Similarly to the upper conveyor belts 21, when the rollers are rotated by a predetermined motor (not illustrated in the drawings) under the control of the controller 4, a lower face of the Scott-Russell belt 631 runs along the front-rear direction. In the following explanation, similarly to the upper conveyor belts 21, the direction of travel of the lower face portion of the Scott-Russell belt 631 is taken as the direction of travel of the Scott-Russell belt 631.

Each Scott-Russell plate 632 is formed in a plate shape that is thin in the front-rear direction and long in the vertical direction, and is provided so as to extend perpendicularly from the outside of an outer peripheral face of the Scott-Russell belt 631, such that the plate faces face along the direction of progress, for example, such that the plate faces face toward the front and rear for a lower face portion of the Scott-Russell belt 631. Accordingly, by running the Scott-Russell belt 631, the Scott-Russell mechanism 628 is capable of moving the Scott-Russell plates 632 toward the front or toward the rear, particularly along the bundle conveyance path 603Y formed at the lower side of the Scott-Russell belt 631.

Moreover, when positioned at a lower side of the Scott-Russell belt 631, a lower edge of each Scott-Russell plate 632 is caused to enter into the claw-guide grooves 22D and 623D respectively formed in the upper faces of the moving conveyance guide 22 and the fixed conveyance guide 623. Accordingly, in a state in which the banknote bundle SB is placed at either the front side or the rear side of the Scott-Russell plate 632, by driving the Scott-Russell belt 631 and moving the Scott-Russell plates 632 along the front-rear direction, the Scott-Russell mechanism 628 is capable of conveying the banknote bundle SB toward the front or toward the rear along the bundle conveyance path 603Y.

Plural of the Scott-Russell plates 632 are disposed discretely on the outer peripheral face, around the peripheral direction of the Scott-Russell belt 631. A peripheral direction spacing between the Scott-Russell plates 632 is longer than the front-rear direction length of the banknote bundle SB on the bundle conveyance path 603Y.

In the above configuration, the bundle conveyance unit 603 is capable of conveying the banknote bundle SB toward the front or toward the rear with the Scott-Russell plates 632 by driving the Scott-Russell belt 631 of the Scott-Russell mechanism 628 toward the front or toward the rear. Moreover, the bundle conveyance unit 603 is capable of switching the conveyance direction of the banknote bundle SB simply by switching the run direction of the Scott-Russell belt 631, since respective Scott-Russell plates 632 are positioned at the front and rear of the banknote bundle SB on the bundle conveyance path 603Y.

Moreover, since plural of the Scott-Russell plates 632 are provided to the Scott-Russell belt 631, there is no need for the bundle conveyance unit 603 to return the Scott-Russell plate 632 that was used to convey the banknote bundle SB to the rear when pay-out conveyance processing of the banknote bundle SB has ended, for example, since another of the Scott-Russell plates 632 can perform the pay-out conveyance processing for the next banknote bundle SB.

8. Other Exemplary Embodiments

Note that in the first exemplary embodiment described above, explanation has been given regarding a case in which the Scott-Russell body 31 is swingably supported by the support body 41, and the Scott-Russell plate 32 is retracted from the bundle conveyance path 3Y by swinging the Scott-Russell body 31. However, the present disclosure is not limited thereto, and the Scott-Russell plate 32 may be retracted from the bundle conveyance path 3Y by various methods, such as supporting the Scott-Russell body 31 by the support body 41 so that the Scott-Russell body 31 is capable of moving in the vertical direction, and retracting the Scott-Russell plate 32 from the bundle conveyance path 3Y by moving the Scott-Russell body 31 upward, or the like. Similar also applies in the third exemplary embodiment.

Moreover, in the first exemplary embodiment described above, explanation has been given regarding a case in which the left guide plate 51 and the right guide plate 52 are formed with the slide grooves 57, and the posts 36 of the Scott-Russell section 30 are inserted through the slide grooves 57. However, the present disclosure is not limited thereto, and, for example, the portions of the left guide plate 51 and the right guide plate 52 further to the upper side of the slide grooves 57 may be omitted, such that upper edges of the left guide plate 51 and the right guide plate 52 are shaped similarly to lower side portions of the slide grooves 57, and the posts 36 may be made to run along the upper edges of the left guide plate 51 and the right guide plate 52. In short, it is sufficient that an upward force can be applied to the posts 36 as appropriate according to the position of the Scott-Russell section 30 in the front-rear direction. Similar also applies in the third and the fourth exemplary embodiments.

Moreover, in the first exemplary embodiment described above, explanation has been given regarding a case in which the inclined region 57B and the separation region 57C of the slide groove 57 are both formed in straight line shapes. However, the present disclosure is not limited thereto, and at least a portion thereof may be configured with a curved profile. Similar also applies in the third and the fourth exemplary embodiments. Moreover, there is no limitation to the groove width of the entire slide groove 57 being substantially uniform, and, for example, the groove width may be locally enlarged. Similarly also applies in the third and the fourth exemplary embodiments.

Moreover, in the second exemplary embodiment described above, explanation has been given regarding a case in which the posts 36 are disposed in front of and below the swing shafts 35 in the Scott-Russell body 131 (FIG. 6A). However, the present disclosure is not limited thereto, and, for example, the posts 36 may be disposed at the rear of and below of the swing shafts 35. In short, it is sufficient that the posts 36 are at a position that is not directly below the swing shafts 35 when the Scott-Russell body 131 is in the conveyance-enabled orientation.

Moreover, in the second exemplary embodiment described above, explanation has been given regarding a case in which the slide groove 157 is provided with the lowering region 157B and the pull-back region 157C, such that the posts 36 are temporarily positioned substantially directly below the swing shafts 35 when the Scott-Russell body 131 is being transitioned from the conveyance-enabled orientation to the retracted orientation. However, the present disclosure is not limited thereto, and, for example, the lowering region 157B and the pull-back region 157C may be omitted, similarly to in the slide groove 57 of the first exemplary embodiment. In such cases, an orientation in which the Scott-Russell body 131 has been swung such that the front face 32F of the Scott-Russell plate 32 faces upward may be employed as the retracted orientation.

Moreover, in the first exemplary embodiment described above, explanation has been given regarding a case in which the upper conveyor belts 21 are provided in a range including the upper sides of the moving conveyance guide 22 and the fixed conveyance guide 23 (FIG. 1, FIG. 2, etc.). However, the present disclosure is not limited thereto, and, for example, configuration may be made in which the upper conveyor belts 21 shortened in the front-rear direction are provided only at a portion facing the lower conveyor belts 24, as in the fifth exemplary embodiment (FIG. 16), or the upper conveyor belts 21 may be omitted altogether. Alternatively, both the upper conveyor belts 21 and the lower conveyor belts 24 may be omitted, as in the second and the fourth exemplary embodiments. This thereby enables the configuration of the bundle conveyance unit 3 and the like to be simplified.

Conversely, the third and the fourth exemplary embodiments may be provided with upper conveyor belts 21 and lower conveyor belts 24 similarly to in the first exemplary embodiment. Moreover, in the fifth and the sixth exemplary embodiments, the upper conveyor belts 421 may be extended toward the rear, similarly to the upper conveyor belts 21 of the first exemplary embodiment. Moreover, instead of the respective belts, plural rollers may be arranged and rotated, or an appropriate combination of both rollers and belts may be provided. This thereby enables stable conveyance of the banknote bundle SB, such as along the bundle conveyance path 203Y.

Moreover, in the first exemplary embodiment described above, explanation has been given regarding a case in which two of the upper conveyor belts 21 are disposed side-by-side to the left and right in the bundle conveyance unit 3. However, the present disclosure is not limited thereto, and one, or three or more, of the upper conveyor belts 21 may be provided in the bundle conveyance unit 3. Similar applies to the lower conveyor belts 24, and similar also applies in the fifth, sixth, and seventh exemplary embodiments.

Moreover, in the first exemplary embodiment described above, explanation has been given regarding a case in which the claw-shaped portions 32C are formed projecting out further downward than their surroundings at the lower edge of the Scott-Russell plate 32, and the claw-guide grooves 22D and 23D are respectively formed in the upper faces of the moving conveyance guide 22 and the fixed conveyance guide 23. However, the present disclosure is not limited thereto, and, for example, in cases in which a gap between the lower edge of the Scott-Russell plate 32 and the upper faces of the moving conveyance guide 22 and the fixed conveyance guide 23 is small, for example, the claw-shaped portions 32C and the claw-guide grooves 22D and 23D may be omitted. Moreover, the number of the claw-shaped portions 32C and the claw-guide grooves 22D and 23D disposed in the left-right direction is not limited to two, and one or three or more may be provided. Similar also applies in the second to the seventh exemplary embodiments.

Moreover, in the first exemplary embodiment described above, explanation has been given regarding a case in which the Scott-Russell section 30 is configured by the support body 41 that moves along the slide shaft 53 and the rail 56 in the front-rear direction only, and the Scott-Russell body 31 that swings with respect to the support body. However, the present disclosure is not limited thereto, and, for example, configuration may be made in which a Scott-Russell section configured as a single body receives drive force from the moving section 50, is moved in the front-rear direction so as to be swung or moved in the vertical direction according to the shape of the slide groove 57 etc., until a portion of the Scott-Russell plate 32 is in an orientation retracted from the bundle conveyance path 3Y. Similar also applies in the third and the fourth exemplary embodiments.

Moreover, in the first exemplary embodiment described above, explanation has been given regarding a case in which the moving section 50 is provided with the drive belt section 54, and the belt 54B is driven so as to move the Scott-Russell section 30 in the front-rear direction. However, the present disclosure is not limited thereto, and, for example, the moving section 50 may be provided with drive mechanisms of various configurations, for example a combination of a motor and worm gears etc., with this drive mechanism moving the Scott-Russell section 30 in the front-rear direction. Similar also applies in the second to the sixth exemplary embodiments.

Moreover, in the third exemplary embodiment described above, explanation has been given regarding a case in which the posts 236 are provided in the vicinity of the lower edge of the Scott-Russell plate 232, and the left arm 233 and the right arm 234 are provided in the vicinity of the upper edge of the Scott-Russell plate 232. However, the present disclosure is not limited thereto, and the posts 236, the left arm 233, and the right arm 234 may be provided at various locations of the Scott-Russell plate 232. In such cases, the height of the slide grooves 257 formed in the left guide plate 251 and the right guide plate 252 should be adjusted to match to the height of the posts 236.

Moreover, in the third exemplary embodiment described above, explanation has been given regarding a case in which the swing shafts 235 are provided in the vicinity of the front ends of the left arm 233 and the right arm 234. However, the present disclosure is not limited thereto, and, for example, similarly to in the first exemplary embodiment, the swing shafts 235 may be provided almost directly above the posts 236. In such cases, the left arm 233 and the right arm 234 may be shortened in the front-rear direction, or may be omitted.

Moreover, in the fourth exemplary embodiment described above, explanation has been given regarding a case in which the length of the Scott-Russell plate 332 in the vertical direction is extended to approximately twice that of the Scott-Russell plate 232 of the third exemplary embodiment, and the portion that abuts the banknote bundle SB differs depending on the conveyance direction of the banknote bundle SB. However, the present disclosure is not limited thereto, and, for example, the length of the Scott-Russell plate 332 in the vertical direction may be approximately the same as that of the Scott-Russell plate 232, with a substantially constant location abutting the banknote bundle SB, irrespective of the conveyance direction of the banknote bundle SB.

In the fifth exemplary embodiment described above, explanation has been given regarding a case in which friction between the friction block 436 and the lower face 458L of the upper guide plate 458 is utilized to set the orientation of the Scott-Russell section 430 to the forward conveyance orientation or the rearward conveyance orientation, and the Scott-Russell section 430 is moved toward the front or toward the rear while being maintained in this orientation. However, the present disclosure is not limited thereto, and various other forces may be utilized.

Figure 23A:
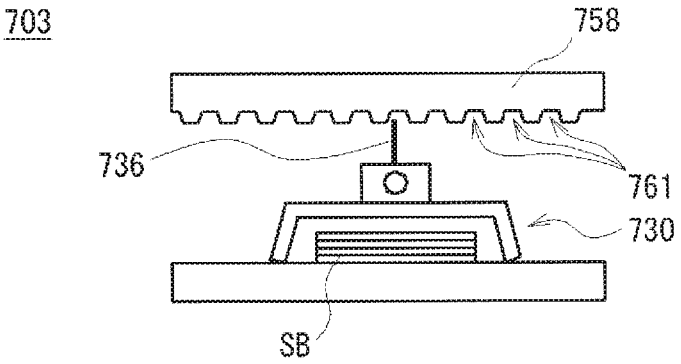
FIG. 23A is a schematic diagram illustrating configuration of a bundle conveyance unit according to another exemplary embodiment.
Figure 23B:
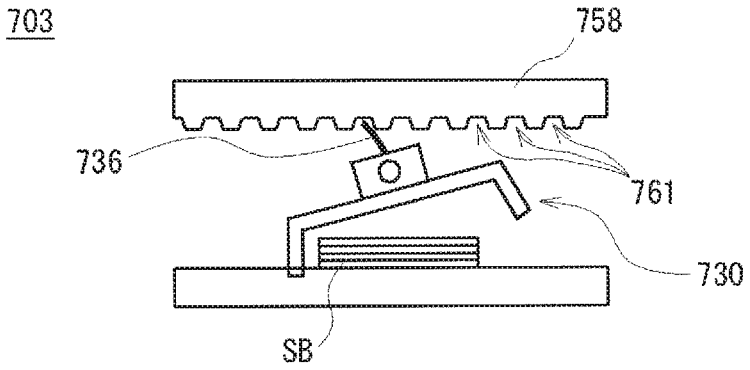
FIG. 23B is a schematic diagram illustrating configuration of a bundle conveyance unit according to another exemplary embodiment

For example, as illustrated in FIG. 23A corresponding to FIG. 16A, a Scott-Russell section 730 of a bundle conveyance unit 703 includes an elastic portion 736 that is capable of elastic deformation instead of the friction block 436. Moreover, a lower face of an upper guide plate 758 is provided with multiple cavities 761, similar to the cavities 561 and 562 of the sixth exemplary embodiment, each disposed at a comparatively short spacing. In the bundle conveyance unit 703, when the Scott-Russell section 730 is moved in the front-rear direction, similarly to in the sixth exemplary embodiment, the elastic portion 736 is applied with force from side edges of the cavities 761, and as illustrated in FIG. 23B, the entire Scott-Russell section 730 is swung, and then the elastic portion 736 undergoes elastic deformation and springs back into the next cavity 761 in sequence, enabling the banknote bundle SB to be conveyed while maintaining the Scott-Russell section 730 in that orientation. Moreover, in the bundle conveyance unit 703 when the direction of progress of the Scott-Russell section 730 is switched, an upper end of the elastic portion 736 escapes into the cavity 761 and the entire Scott-Russell section 730 is swung in the opposite direction to hitherto, enabling the conveyance direction of the banknote bundle SB to be switched.

Moreover, in the first exemplary embodiment described above, explanation has been given regarding a case in which the reject storage box 17 is disposed at the front side of the storage casing 10, and the intake hole 17H is placed in communication with the bundle conveyance path 3Y by moving the moving conveyance guide 22 toward the rear. However, the present disclosure is not limited thereto, and, for example, in cases in which the storage unit 2 is assembled to the bundle conveyance unit 3 so as to be reversed in the front-rear direction, with the reject storage box 17 disposed at the rear side of the storage casing 10, the intake hole 17H may be placed in communication with the bundle conveyance path 3Y by moving the moving conveyance guide 22 toward the front. Similar also applies in the second to the seventh exemplary embodiments.

Moreover, in the first exemplary embodiment described above, explanation has been given regarding a case in which the fixed conveyance guide 23 is provided at the front side of the moving conveyance guide 22, and the lower conveyor belts 24 are provided at the front side of the moving conveyance guide 22. However, the present disclosure is not limited thereto, and, for example, the fixed conveyance guide 23 may be omitted, and the lower conveyor belts 24 may be extended toward the rear so as to reach the vicinity of the front end of the moving conveyance guide 22. Similar also applies in the fourth to the sixth exemplary embodiments. Moreover, in the third and the fourth exemplary embodiments, a lower conveyor belt may be provided instead of the fixed conveyance guide 223.

Moreover, in the first exemplary embodiment described above, explanation has been given regarding a case in which the present disclosure is applied to the bundle conveyance unit 3 that conveys a banknote bundle configured by stacked banknotes as a medium in the banknote pay-out device 1 that pays out banknotes. However, the present disclosure is not limited thereto, and, for example, the present disclosure may be applied to a location that conveys a stacked medium in various devices handling paper sheet shaped media, such as cash vouchers, securities, various types of tickets, or postcards, in a stacked state.

Moreover, the present disclosure is not limited to the respective exemplary embodiments and the other exemplary embodiments described above. Namely, the present disclosure encompasses application to exemplary embodiments arrived at by appropriately combining each exemplary embodiment described above with part or all of other exemplary embodiments described above, and to exemplary embodiments arrived at by extracting a part thereof Moreover, in the first exemplary embodiment described above, explanation has been given regarding a case in which the bundle conveyance unit 3, serving as a medium conveyance device, is configured by the moving conveyance guide 22 and the fixed conveyance guide 23 serving as a placement body, the Scott-Russell body 31 serving as a Scott-Russell body, the moving section 50 serving as a moving section, and the posts 36 and the slide grooves 57 serving as a conveyance state switching section. However, the present disclosure is not limited thereto, and the medium conveyance device may be configured by various other configurations of placement body, Scott-Russell body, moving section, and conveyance state switching section.

Moreover, in the first exemplary embodiment described above, explanation has been given regarding a case in which the banknote pay-out device 1, serving as a medium transaction device, is configured by the stacking section 16 serving as a stacking section, the moving conveyance guide 22 and the fixed conveyance guide 23 serving as a placement body, the Scott-Russell body 31 serving as a Scott-Russell body, the moving section 50 serving as a moving section, and the posts 36 and the slide grooves 57 serving as a conveyance state switching section. However, the present disclosure is not limited thereto, and the medium transaction device may be configured by various other configurations of stacking section, placement body, Scott-Russell body, moving section, and conveyance state switching section.

INDUSTRIAL APPLICABILITY

The present disclosure may, for example, be employed in a banknote pay-out device that pays out banknote bundles of plural stacked banknotes according to user operation.

The disclosure of Japanese Patent Application No. 2015-009468 is incorporated in its entirety in the present specification by reference.

All cited documents, patent applications, and technical standards mentioned in the present specification are incorporated by reference in the present specification to the same extent as if the individual cited document, patent application, or technical standard was specifically and individually indicated to be incorporated by reference.

The invention claimed is:

1. A medium conveyance device comprising:

a placement body including a bundle conveyance face on which a medium bundle configured by stacking a plurality of a medium into a bundle shape is conveyed in a state placed on the bundle conveyance face;

a Scott-Russell body including an abutting portion that abuts the medium bundle;

a moving section that causes at least a portion of the Scott-Russell body to abut against the medium bundle and that moves the Scott-Russell body in a first direction along the bundle conveyance face, or in a second direction opposite to the first direction, so as to move the medium bundle along the bundle conveyance face in the first direction or in the second direction;

a conveyance state switching section that switches to a first conveyance state or a second conveyance state in a case in which the Scott-Russell body is moved by the movement section, the first conveyance state in which at least a portion of the Scott-Russell body is caused to abut against the second direction side of the medium bundle and conveyance of the medium bundle toward the first direction is enabled, the second conveyance state in which at least a portion of the Scott-Russell body is caused to abut against the first direction side of the medium bundle and conveyance of the medium bundle toward the second direction is enabled.

2. The medium conveyance device of claim 1, wherein the conveyance state switching section further comprises:

a retract-and-return section that retracts the Scott-Russell body from a bundle conveyance path through which the medium bundle passes as it moves along the bundle conveyance face, or returns a portion of the Scott-Russell body to within the bundle conveyance path by utilizing a force of the movement section to move the Scott-Russell body; and a relative position switching section that in a retracted state of the Scott-Russell body from the bundle conveyance path switches a position of the Scott-Russell body relative to the medium bundle to the first direction side or to the second direction side.

3. The medium conveyance device of claim 2, wherein:

the retract-and-return section includes a post that is provided to the Scott-Russell body, and a slide groove that lets the post slide accompanying movement of the Scott-Russell body by the movement section; and the slide groove is formed with a shape following the bundle conveyance face in a movement region in which the medium bundle is moved by the Scott-Russell body, and is formed along a direction intersecting the first direction or the second direction in a retraction region where the Scott-Russell body is retracted from the bundle conveyance path.

4. The medium conveyance device of claim 3, wherein when in an orientation for moving the medium bundle the Scott-Russell body positions the post further to the first direction side or further to the second direction side than a swing shaft about which the Scott-Russell body swings.

5. The medium conveyance device of claim 4, wherein within the retraction region the slide groove includes a pull-back region in which the post is pulled back further from the swing shaft in a direction intersecting the bundle conveyance face than in the movement region.

6. The medium conveyance device of claim 3, wherein in the retraction region the Scott-Russell body retracts from the bundle conveyance path by transitioning to an orientation different from an orientation of the Scott-Russell body when in the movement region.

7. The medium conveyance device of claim 6, wherein the slide groove forms a circuit path including the retraction region, and is provided with a switch to switch a direction of progress of the post at a connection portion to the movement region.

8. The medium conveyance device of claim 3, wherein:

in the Scott-Russell body the abutting portion is disposed on the opposite of the post, with respect to a swing shaft about which the Scott-Russell body swings; and with respect to the movement region, the retraction region is formed running toward the opposite direction to a direction in which the abutting portion is pulled back from the bundle conveyance face.

9. The medium conveyance device of claim 2, wherein the relative position switching section moves the medium bundle toward the first direction or toward the second direction of the Scott-Russell body.

10. The medium conveyance device of claim 9, wherein the relative position switching section is provided on the first direction side of the placement body, and is configured by a placement conveyor belt that conveys the medium bundle toward the first direction or toward the second direction.

11. The medium conveyance device of claim 2, wherein the relative position switching section moves the Scott- Russell body to the first direction side or to the second direction side of the medium bundle.

12. The medium conveyance device of claim 11, wherein:

the retract-and-return section includes a post that is provided to the Scott-Russell body, and a slide groove that lets the post slide accompanying movement of the Scott-Russell body by the movement section; and the slide groove is formed with a shape following the bundle conveyance face in a movement region in which the medium bundle is moved by the Scott-Russell body, and is formed with a region that moves the post toward the first direction or toward the second direction in a retraction region where the Scott-Russell body is retracted from the bundle conveyance path.

13. The medium conveyance device of claim 1, wherein:

the bundle conveyance face of the placement body includes a groove formed running in the first direction or in the second direction; and the Scott-Russell body includes a claw-shaped portion that, when the medium bundle is being moved along the bundle conveyance face in the first direction or the second direction, extends toward the placement body from an abutting area abutting the medium bundle so as to be positioned inside the groove.

14. The medium conveyance device of claim 1, further comprising an opposing conveyor belt that runs along an opposing face opposing the bundle conveyance face, and that conveys the medium bundle sandwiched between the bundle conveyance face and the opposing conveyor belt.

15. The medium conveyance device of claim 1, wherein:

the Scott-Russell body includes a first abutting portion that abuts the medium bundle if the Scott-Russell body has approached the bundle conveyance face on the first direction side of the medium bundle, a second abutting portion that abuts the medium bundle if the Scott-Russell body has approached the bundle conveyance face on the second direction side of the medium bundle, a coupling portion that couples the first abutting portion and the second abutting portion together, and a swing section that swings the coupling portion, the first abutting portion, and the second abutting portion further away from the bundle conveyance face than the medium bundle; and the conveyance state switching section causes either the first abutting portion or the second abutting portion to approach the bundle conveyance face, and causes the other of the first abutting portion or the second abutting portion to be distanced further from the bundle conveyance face, by utilizing force of the movement section to move the Scott-Russell body so as to swing the Scott-Russell body about the swing section.

16. The medium conveyance device of claim 15, wherein:

the conveyance state switching section includes a guide face along the first direction or the second direction;

the Scott-Russell body includes a contact portion that contacts the guide face during movement of the Scott-Russell body in the first direction or the second direction; and the conveyance state switching section switches the Scott-Russell body to either the first conveyance state or the second conveyance state by switching a direction of progress of the Scott-Russell body.

17. The medium conveyance device of claim 16, wherein:

the guide face is formed at one or more locations with a cavity that is a greater distance from the bundle conveyance face than the periphery of the cavity; and the contact portion is configured such that in an orientation of the Scott-Russell body in which both the first abutting portion and the second abutting portion are pulled back from the bundle conveyance face a portion of the contact portion reaches inside the cavity, and when the contact portion abuts the guide face at a location other than the cavity, either the first abutting portion or the second abutting portion is caused to approach the bundle conveyance face, and the other out of the first abutting portion or the second abutting portion is distanced further from the bundle conveyance face.

18. The medium conveyance device of claim 17, wherein:

the contact portion is configured by a rotatable roller; and the guide face is provided at one or more locations with a recess that increases the distance from the Scott-Russell body, and, when the direction of progress of the Scott-Russell body is switched, the guide face causes the roller to temporarily engage with the recess so as to switch the Scott-Russell body to the first conveyance state or to the second conveyance state.

19. The medium conveyance device of claim 17, wherein:

the contact portion is capable of elastic deformation toward the opposite side to the direction of progress of the Scott-Russell body; and the guide face includes a plurality of the cavities disposed along the first direction or the second direction, and after the direction of progress of the Scott-Russell body has been switched, the guide face causes the contact portion to temporarily abut a side edge of one of the cavities so as to swing the Scott-Russell body and switch the Scott-Russell body to the first conveyance state or to the second conveyance state.

20. A medium transaction device comprising:

a stacking section that creates a medium bundle by stacking a plurality of a medium to be transacted into a bundle shape;

a placement body including a bundle conveyance face on which the medium bundle is conveyed in a state placed on the bundle conveyance face;

a Scott-Russell body including an abutting portion that abuts the medium bundle;

a moving section that causes at least a portion of the Scott-Russell body to abut against the medium bundle and that moves the Scott-Russell body along the bundle conveyance face in a first direction, or in a second direction opposite to the first direction, so as to move the medium bundle along the bundle conveyance face in the first direction or in the second direction;

a conveyance state switching section that switches to a first conveyance state or a second conveyance state in a case in which the Scott-Russell body is moved by the movement section, the first conveyance state in which at least a portion of the Scott-Russell body is caused to abut against the second direction side of the medium bundle and conveyance of the medium bundle toward the first direction is enabled, the second conveyance state in which at least a portion of the Scott-Russell body is caused to abut against the first direction side of the medium bundle and conveyance of the medium bundle toward the second direction is enabled.

* * * * *